US011971022B2

(12) United States Patent
Sinders et al.

(10) Patent No.: US 11,971,022 B2
(45) Date of Patent: Apr. 30, 2024

(54) SYSTEM FOR DISPENSING ABRASIVE MATERIAL

(71) Applicant: Graco Minnesota Inc., Minneapolis, MN (US)

(72) Inventors: Steven R. Sinders, North Canton, OH (US); John R. Scopelite, Louisville, OH (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 17/688,344

(22) Filed: Mar. 7, 2022

(65) Prior Publication Data

US 2022/0299017 A1 Sep. 22, 2022

Related U.S. Application Data

(60) Provisional application No. 63/299,613, filed on Jan. 14, 2022, provisional application No. 63/162,358, filed on Mar. 17, 2021.

(51) Int. Cl.
*F04B 15/02* (2006.01)
*F04B 13/00* (2006.01)
(Continued)

(52) U.S. Cl.
CPC ..... *F04B 15/02* (2013.01); *F04B 13/00* (2013.01); *F04B 19/22* (2013.01); *F04B 53/008* (2013.01);
(Continued)

(58) Field of Classification Search
CPC ..... F04B 15/02; F04B 13/00; F04B 19/22; F04B 53/008; F04B 53/02; F04B 53/10;
(Continued)

(56) References Cited

U.S. PATENT DOCUMENTS 3,640,433 A 2/1972 Rodth
4,044,655 A 8/1977 Kennicott
(Continued)

FOREIGN PATENT DOCUMENTS

CN 1129776 A 8/1996
CN 201884236 U 6/2011
(Continued)

OTHER PUBLICATIONS

Extended European Search Report for EP Application No. 22162619.5, dated Nov. 17, 2022, pp. 9.
(Continued)

*Primary Examiner* — Kenneth J Hansen
*Assistant Examiner* — David N Brandt
(74) *Attorney, Agent, or Firm* — Kinney & Lange, P. A.

(57) ABSTRACT

A system for dispensing abrasive materials includes a transfer pump configured to pump abrasive material to a metering pump configured to pump the abrasive material to an application. Dynamic interfaces within the pumps are at least partially formed by sleeved components of the pump interfacing with a seal configured to engage with the sleeved surface during relative movement between the sleeved surface and the seal. The smooth exterior surfaces of the sleeves interface with the seals to prevent abrasive particulate in the material from adhering to the sleeve, preventing the abrasive particulate from being pulled between the sleeve and the seal.

19 Claims, 15 Drawing Sheets

(51) Int. Cl.

| | |
|---|---|
| ***F04B 19/08*** | (2006.01) |
| ***F04B 19/22*** | (2006.01) |
| ***F04B 23/06*** | (2006.01) |
| ***F04B 53/00*** | (2006.01) |
| ***F04B 53/02*** | (2006.01) |
| ***F04B 53/10*** | (2006.01) |
| ***F04B 53/12*** | (2006.01) |
| ***F04B 53/14*** | (2006.01) |
| ***F04B 53/16*** | (2006.01) |

(52) U.S. Cl.
CPC ..... *F04B 53/02* (2013.01); *F04B 53/143* (2013.01); *F04B 53/146* (2013.01); *F04B 53/164* (2013.01); *F04B 19/08* (2013.01); *F04B 23/06* (2013.01); *F04B 53/1087* (2013.01); *F04B 53/121* (2013.01); *F04B 53/168* (2013.01)

(58) Field of Classification Search
CPC ..... F04B 53/143; F04B 53/146; F04B 53/16; F04B 53/164; F04B 53/166; F04B 13/02; F04B 19/08; F04B 23/04; F04B 23/06; F04B 53/1087; F04B 53/12; F04B 53/121; F04B 53/168
See application file for complete search history.

(56) References Cited

U.S. PATENT DOCUMENTS

| | | | | |
|---|---|---|---|---|
| 4,397,407 | A | 8/1983 | Skoupi et al. | |
| 5,147,188 | A * | 9/1992 | Shaefer | F04B 53/122 417/511 |
| 5,211,611 | A * | 5/1993 | Lammers | F04B 9/04 475/178 |
| 5,605,446 | A * | 2/1997 | Handzel | F04B 15/02 417/489 |
| 5,740,718 | A | 4/1998 | Rathweg | |
| 8,337,180 | B2 | 12/2012 | Whaley et al. | |
| 8,549,987 | B2 * | 10/2013 | Ross | F04B 53/143 92/165 R |
| 10,514,030 | B2 | 12/2019 | Horning et al. | |
| 2007/0256556 | A1 | 11/2007 | Rawlings | |
| 2010/0001100 | A1 | 1/2010 | Fontaine | |
| 2011/0186018 | A1 * | 8/2011 | Inoue | F02M 59/025 123/514 |
| 2013/0039778 | A1 * | 2/2013 | Blackson | F04B 49/20 417/44.1 |
| 2016/0319936 | A1 * | 11/2016 | Dubois | F16J 15/3212 |
| 2018/0238324 | A1 * | 8/2018 | Horning | F04B 53/146 |
| 2020/0071845 | A1 * | 3/2020 | Zhang | C25D 11/026 |
| 2020/0088190 | A1 | 3/2020 | Horning et al. | |
| 2020/0224654 | A1 | 7/2020 | Horning et al. | |

FOREIGN PATENT DOCUMENTS

| | | | |
|---|---|---|---|
| CN | 102639873 | A | 8/2012 |
| CN | 207138219 | U | 3/2018 |
| CN | 108457852 | A | 8/2018 |
| WO | 9816742 | A1 | 4/1998 |
| WO | 2013117420 | A1 | 8/2013 |
| WO | 2020112809 | A1 | 6/2020 |

OTHER PUBLICATIONS

First Chinese Office Action for CN Application No. 202210258372.9, Dated Dec. 13, 2023, pp. 20.

* cited by examiner

SYSTEM FOR DISPENSING ABRASIVE MATERIAL

CROSS-REFERENCE TO RELATED APPLICATION(S)

This claims priority to U.S. Provisional Application No. 63/162,358 filed Mar. 17, 2021, and entitled "SYSTEM FOR DISPENSING ABRASIVE MATERIAL" and claims priority to U.S. Provisional Application No. 63/299,613 filed Jan. 14, 2022, and entitled "RESILIENT APPLICATOR FOR A MATERIAL DISPENSING SYSTEM," the disclosures of which are hereby incorporated by reference in their entireties.

BACKGROUND

This disclosure relates generally to plural component dispensing systems and more particularly to drive systems for pumps within plural component dispensing systems.

Plural component materials are formed by two or more constituent materials combining to form the plural component material. The constituent materials are individually pumped and are typically combined immediately prior to application. One type of plural component material is thermal interface materials (TIMs). TIMs are configured to be inserted between parts to enhance thermal coupling between components. For example, TIMs are often applied in electronics to dissipate heat in the electronic device. TIMs typically include a high concentration of thermally conductive abrasive materials, such as aluminum oxide, to enhance the conductivity of the material.

A typical multiple component applicator system includes positive displacement pumps that individually draw the component materials from separate storage vessels and pump the pressurized component materials to the dispensing device for mixing and application. The thermally conductive materials in the TIMs are highly abrasive and have high hardness. Due to the abrasive particles that are suspended in the liquid of the highly abrasive materials, they tend to be extremely thick and require the use of a self-priming reciprocating piston pumps. The use of this type of pump is typical for thick materials and for the transfer of thick materials from the storage vessel to other metering pumps or to the dispense point if accuracy wasn't required. The design of this type of pump requires several moving components that slide against each other; these components separate the high pressure material side from the low pressure side of the pump. These sliding components trap microscopic particles of the abrasive material in the surface blemishes of the metal components and wear the both the metal components and the seals that separate the high pressure side from the low pressure side of the pump. After leaving the transfer pump the highly abrasive material is carried through a conduit "hoses or metal piping" to the metering pumps, which receive the material through the inlet ports and increase the pressure of the material before exiting to the dispense point. Seals and dynamic components of the pumps and applicators to experience significant wear due to a variety of factors, such as the pressures generated during pumping, the relative movement between interfacing parts, and the abrasive nature of the TIMs. If components such as applicator stems, pump pistons, and seals become worn the entire component must be replaced.

SUMMARY

According to one aspect of the disclosure, a pump for pumping an abrasive material includes a pump body; a first seal supported by the pump body; a piston at least partially disposed within the pump body and configured to reciprocate along a pump axis; a first piston sleeve mounted on the piston, wherein the first piston sleeve interfaces with the first seal during reciprocation of the piston; a second piston sleeve mounted on the piston and spaced axially from the first piston sleeve along the piston; and an intake valve disposed within the pump body, wherein the intake valve includes an intake seal assembly disposed on the piston, wherein the intake seal assembly interfaces with the second piston sleeve during reciprocation of the piston, and wherein the intake valve is actuatable between an open state with the intake seal assembly disengaged from an intake seat and a closed state with the intake seal assembly disengaged from the intake seat.

According to an additional or alternative aspect of the disclosure, a pump for pumping an abrasive material includes a pump body having an intake housing, a valve housing mounted to the intake housing, a pump cylinder mounted to an end of the valve housing opposite the intake housing, an outlet housing mounted to an end of the pump cylinder opposite the valve housing, and a throat cartridge mounted to an end of the outlet housing opposite the pump cylinder; a first seal supported by the throat cartridge; a piston at least partially disposed within the pump body and configured to reciprocate along a pump axis; a first piston sleeve mounted on the piston, wherein the first piston sleeve interfaces with the first seal during reciprocation of the piston; a second piston sleeve mounted on the piston and spaced axially from the first piston sleeve along the piston; a cylinder sleeve mounted to the pump cylinder such that an interior radial surface is exposed within a material flowpath through the pump body; an intake valve disposed within the pump body, wherein the intake valve includes an intake seal assembly disposed on the piston, wherein the intake seal assembly interfaces with the second piston sleeve during reciprocation of the piston, and wherein the intake valve is actuatable between a first open state with the intake seal assembly disengaged from an intake seat and a first closed state with the intake seal assembly disengaged from the intake seat; and a piston valve disposed within the pump body, wherein the piston valve includes a piston seal assembly disposed on the piston, wherein the piston seal assembly interfaces with the cylinder sleeve during reciprocation of the piston, and wherein the piston valve is actuatable between a second open state with the piston seal assembly disengaged from a piston valve seat and a second closed state with the piston seal assembly disengaged from the piston valve seat.

According to another additional or alternative aspect of the disclosure, a pump for pumping an abrasive material includes a pump body; a first seal supported by the pump body; a cylinder sleeve supported by the pump body; a piston at least partially disposed within the pump body and configured to reciprocate along a pump axis; a piston sleeve mounted on the piston, wherein the first piston sleeve interfaces with the first seal during reciprocation of the piston; and a piston seal mounted on the piston and interfacing with the cylinder sleeve, wherein the piston seal is an only portion of the piston interfacing with the cylinder sleeve during reciprocation of the piston.

According to another additional or alternative aspect of the disclosure, a pumping system for pumping abrasive material includes a transfer pump configured to draw material from a vessel and pump the material downstream through a first conduit and a metering pump connected to the first conduit to receive the material from the transfer pump, the metering pump configured to pump the material downstream through a downstream conduit to an applicator. The transfer pump includes a transfer pump body; a first transfer seal supported by the transfer pump body; a transfer piston at least partially disposed within the transfer pump body and configured to reciprocate along a transfer pump axis; a first transfer piston sleeve mounted on the transfer piston, wherein the first transfer piston sleeve interfaces with the first transfer seal during reciprocation of the transfer piston; a second transfer piston sleeve mounted on the transfer piston and spaced axially from the first transfer piston sleeve along the transfer piston; and an intake valve disposed within the pump body, wherein the intake valve includes an intake seal assembly disposed on the transfer piston, wherein the intake seal assembly interfaces with the second transfer piston sleeve during reciprocation of the transfer piston, and wherein the intake valve is actuatable between an open state with the intake seal assembly disengaged from an intake seat and a closed state with the intake seal assembly disengaged from the intake seat. The metering pump includes a metering pump body; a first metering seal supported by the metering pump body; a metering cylinder sleeve supported by the metering pump body; a metering piston at least partially disposed within the metering pump body and configured to reciprocate along a metering pump axis; a metering piston sleeve mounted on the metering piston, wherein the metering piston sleeve interfaces with the first metering seal during reciprocation of the metering piston; and a metering piston seal mounted on the metering piston and interfacing with the metering cylinder sleeve, wherein the metering piston seal is an only portion of the metering piston interfacing with the metering cylinder sleeve during reciprocation of the metering piston.

According to another additional or alternative aspect of the disclosure, an applicator for a dispensing system includes an applicator body having a first flowpath extending therethrough; and a control valve disposed within the applicator body. The control valve includes a first seat disposed in the first flowpath; and a valve member configured to shift between a first position in which a first needle of the valve member is engaged with the first seat such that the control valve is in a closed state and a second position in which the first needle is disengaged from the first seat such that the control valve is in an open state. The first needle is elongate along a needle axis and an exterior surface of the first needle has a mean roughness depth (Rz) of up to 0.8 micrometers.

According to another additional or alternative aspect of the disclosure, a needle for use in an applicator includes a needle body elongate along an axis between a first end and a second end and an exterior surface having a mean roughness depth (Rz) of up to 0.8 micrometers.

DETAILED DESCRIPTION

This disclosure is related to a process and apparatus for dispensing of highly abrasive materials at a dispensing point. The applicator of a dispensing system includes needles that control the flow of component materials to a mixer for dispensing. The exterior surfaces of the moving components in contact with the abrasive materials has a smooth surface finish to prevent the abrasive particulate from adhering to the surface and being pulled between the moving exteriors and seals interfacing with exterior. The smooth exterior surfaces prevent wear damage to both the moving component and the seals.

The pumps of the dispensing system pump the abrasive materials to the applicator for dispensing. The pumps include moving piston components that move axially within pump housings. The piston components interface with the housings at sealed interfaces to facilitate pumping of the abrasive materials. The pump components are sleeved at the sliding interfaces to protect the metallic bases of the components from the abrasive materials. The exterior surfaces of the sleeve are formed with smooth surface finishes to prevent the abrasive particulate from adhering to the surface and being pulled between the seals and the smooth exterior of the sleeved component. The smooth exterior surfaces prevent wear damage to the pump components at the sealing interfaces.

Figure 1:
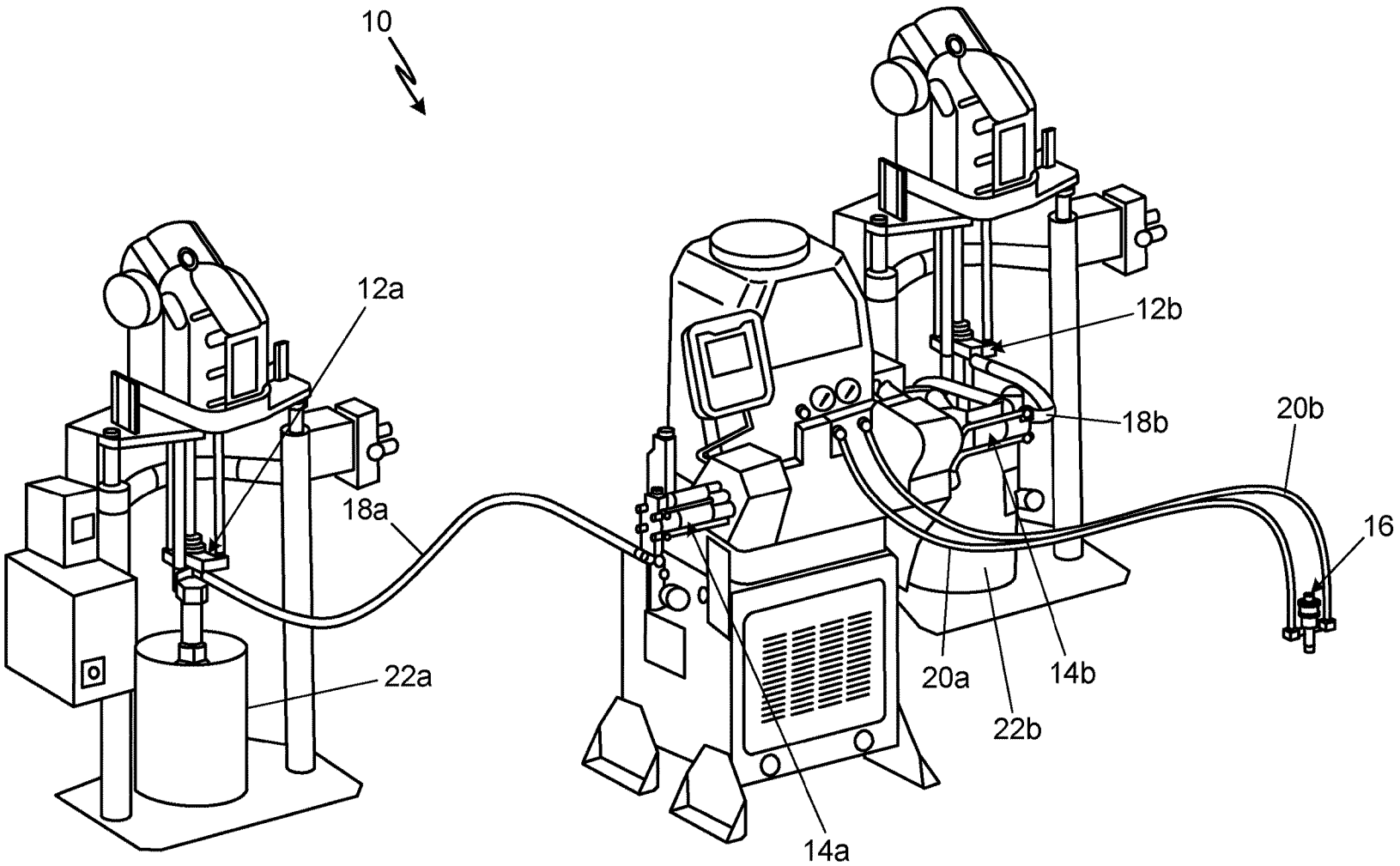
FIG. 1 is an isometric view of a component dispensing system.

FIG. 1 is an isometric view of a dispensing system 10. Dispensing system 10 includes transfer pumps 12*a*, 12*b*; metering pumps 14*a*, 14*b*; applicator 16; upstream conduits 18*a*, 18*b*; downstream conduits 20*a*, 20*b*; and vessels 22*a*, 22*b*.

Dispensing system 10 is configured to dispense thick, abrasive materials at application points. For example, dispensing system 10 can be configured to dispense thermal interface materials (TIMs), configured to dissipate heat, such as in electronics. Component materials of the TIMs include highly abrasive particulate, such as aluminum oxide among other thermally conductive particulate, carried by a carrier material. In some examples, the abrasive particulate forms 60-90% of the component materials. The carrier materials are configured to mix and react to form the plural component material that hardens and can fix components together. For example, the carrier materials can be formed by a catalyst and a base that combine and react to form the TIMs.

Transfer pumps 12*a*, 12*b* are mounted relative to vessels 22*a*, 22*b*, respectively, to draw the components materials from vessels 22*a*, 22*b*. Transfer pumps 12*a*, 12*b* remove the highly abrasive materials from the storage vessels 22*a*, 22*b* and drive the component materials to metering pumps 14*a*, 14*b* disposed downstream from the transfer pumps 12*a*, 12*b*.

Due to the abrasive particles that are suspended in the component materials, the materials tend to be extremely thick such that transfer pumps 12*a*, 12*b* are formed as self-priming reciprocating piston pumps.

In the example shown, the component materials are pumped downstream by transfer pumps 12*a*, 12*b* to metering pumps 14*a*, 14*b*. Upstream conduits 18*a*, 18*b* extend between and connect outlets of the transfer pumps 12*a*, 12*b* with inlets of the metering pumps 14*a*, 14*b*. The metering pumps 14*a*, 14*b* meter the material to the desired flow rate or volume and drive the component materials downstream to applicator 16 through downstream conduits 20*a*, 20*b*. Metering pumps 14*a*, 14*b* increase the accuracy at which the component materials are displaced to maintain a desired ratio between the component materials at the applicator 16. This increased accuracy is used for precise quantity of material for single component applications where exact quantities are required and in multi-component applications where exact ratio and controlled quantities are required. It is understood, however, that some examples of dispensing system 10 can have transfer pumps 12*a*, 12*b* directly connected to applicator 16 by conduit in examples that do not require precise metering of the component materials. It is further understood that single component applications can include a single one of transfer pumps 12*a*, 12*b* and, in examples requiring precise metering, a single one of metering pumps 14*a*, 14*b*.

Transfer pumps 12*a*, 12*b* feed the inlet of the metering pumps 14*a*, 14*b*. These metering pumps 14*a*, 14*b* then meter the outbound volume of material, which is pumped downstream by the metering pumps 14*a*, 14*b* through downstream conduits 20*a*, 20*b* to applicator 16. Applicator 16 controls the starting and stopping of the flow of the highly abrasive material out of dispensing system 10 and to the application point. Applicator 16 can mix the component materials together to form the plural component material. Applicator 16 is configured to output the materials at the desired application point.

The internal pumping components of the transfer pumps 12*a*, 12*b* and metering pumps 14*a*, 14*b* and the internal flow control components of the applicator 16 are exposed to the abrasive materials throughout operation of dispensing system 10. The smoothness of the components interfacing with seals, such as the pistons of the transfer pumps 12*a*, 12*b* and metering pumps 14*a*, 14*b* and the moving valve member within the applicator 16, must be maintained over the life of pumps/applicator so protecting these surfaces is critical. C3 submicron tungsten carbide can be used to form the smooth sliding surfaces, such as formed by sleeves, due to its superior surface finish, but other types of tungsten or ceramic can be utilized as long as a highly polished surface finish can be achieved. The smooth surface finish inhibits adhesion of the abrasive materials on the surfaces, preventing the abrasive particulate from being pulled under the seals at the sealing interface. The mean roughness depth (Rz) of the surfaces is controlled to provide the smooth surface that prevents adhesion of the abrasive particulate. The Rz can be determined by measuring the vertical distance from the highest peak to the lowest valley within five sampling lengths, then averaging these distances. The Rz averages the five tallest peaks and the five lowest valleys to provide an indication of the smoothness of the surface finish. Typically, a surface finish having an Rz of less than about 0.8 micrometers (μm) (about 31.5 microinches (μin)) is required to achieve a mirror finish. The Rz of the exterior surface of the one or more sleeves of the sleeve assembly 48 can be up to about 0.8 μm (about 31.5 μin). In some examples, the Rz of the sleeve surfaces is up to about 0.3 μm (about 11.8 μin). Some examples of the sleeve surfaces have a Rz of up to about 0.25 μm (about 9.8 μin).

The surface finish can, in some examples, be enhanced by the use of any one of physical vapor deposition (PVD), plasma assisted chemical vapor deposition (PACVD), and chemical vapor deposition (CVD) coatings, which increase the hardness of the surface of the highly polished surface and which can assist in protecting the surface finish. The smooth exterior surfaces interface with the seal at sliding interfaces and are in the flowpath of the abrasive component materials.

Figure 2A:
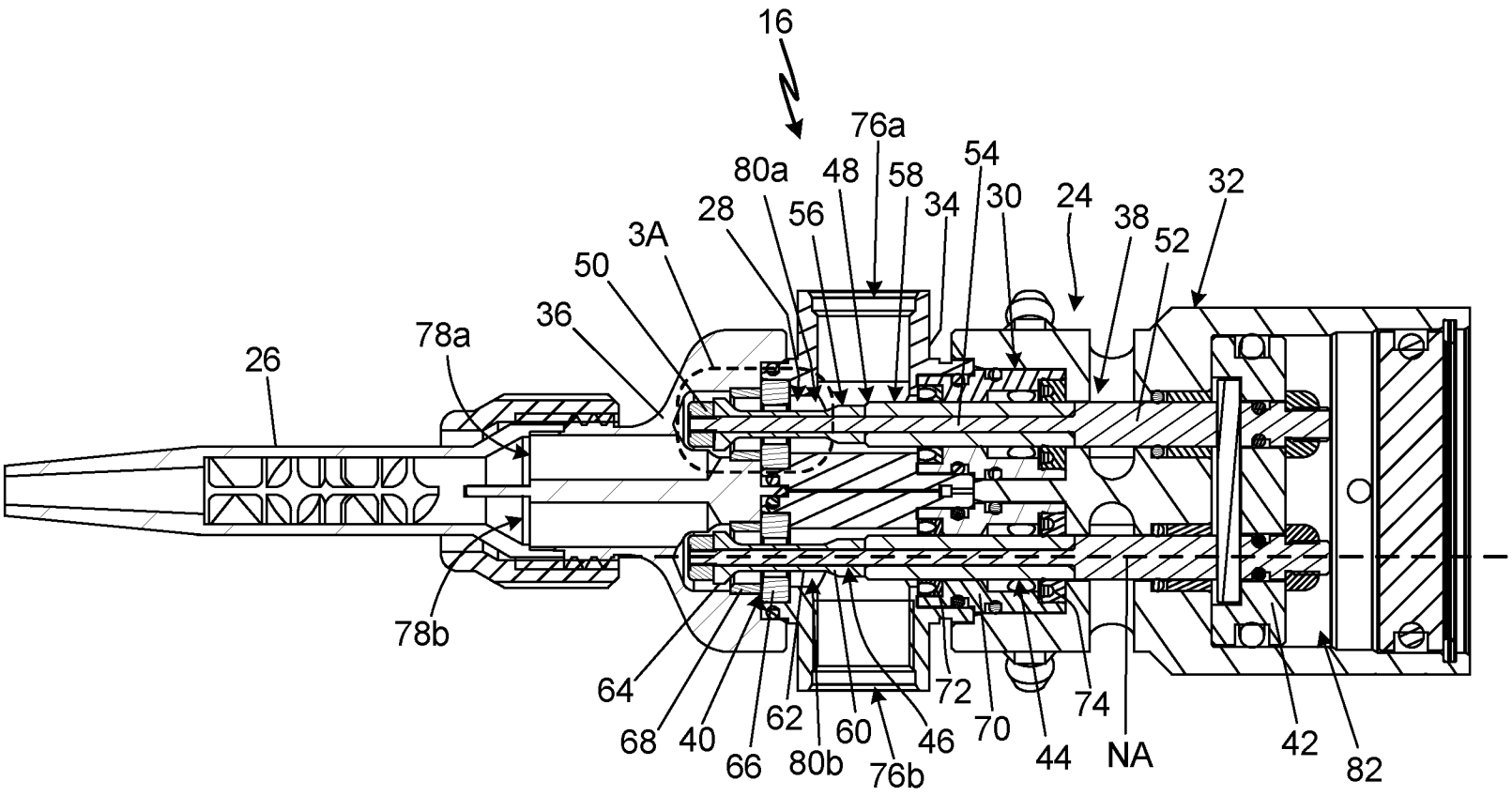
FIG. 2A is a cross-sectional view of an applicator in a dispensing state.
Figure 2B:
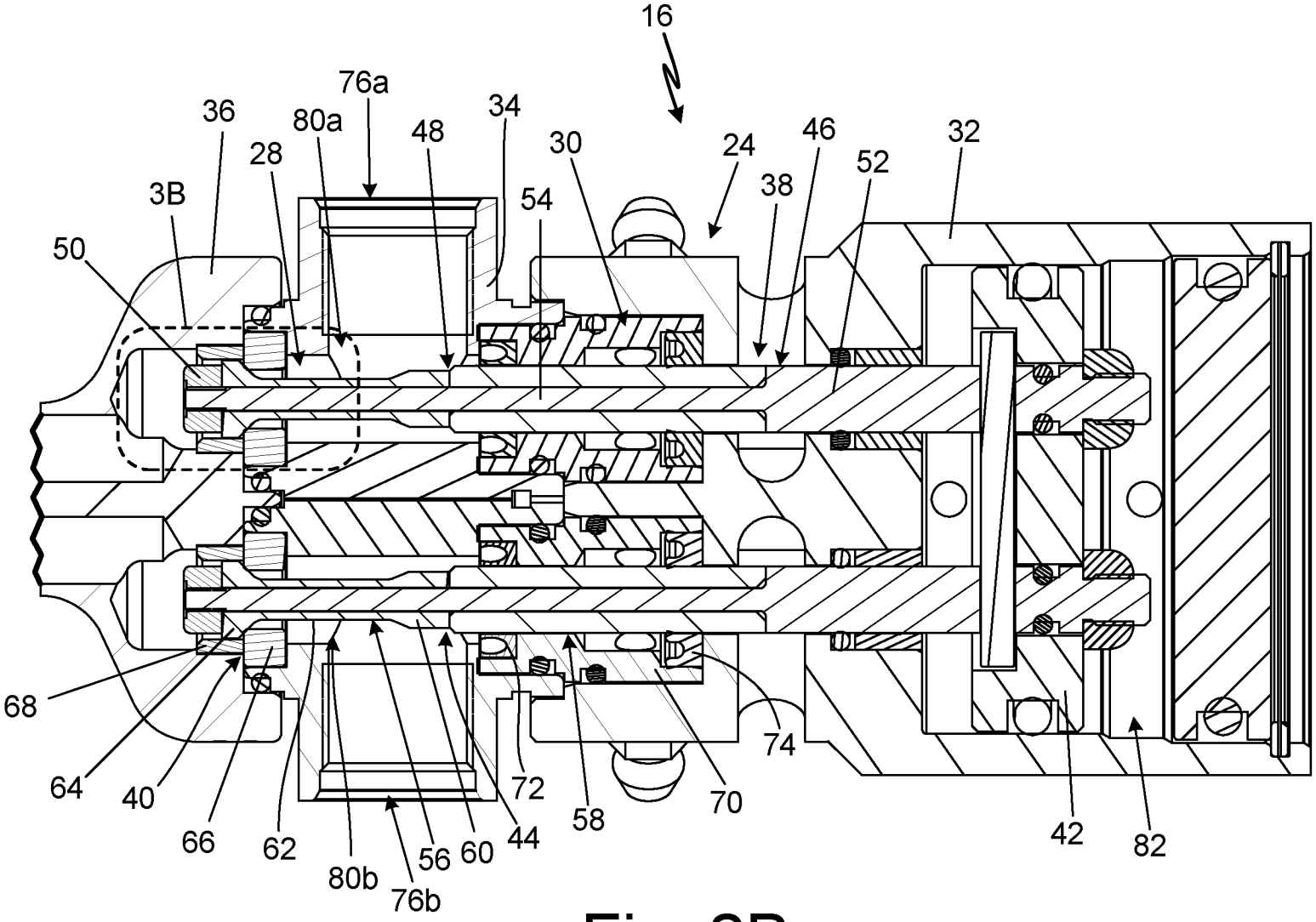
FIG. 2B is a cross-sectional view of the applicator of FIG. 2A in a holding, non-dispense state.

FIG. 2A is a cross-sectional view of applicator 16 in a dispensing state. FIG. 2B is a cross-sectional view of applicator 16 in a holding, non-dispense state. FIGS. 2A and 2B will be discussed together. Applicator 16 includes applicator body 24, mixer 26 (FIG. 2A), control valve 28, and seal cartridges 30. Applicator body 24 includes actuator housing 32, material receiver 34, and connector 36. Control valve 28 includes valve member 38 and seat assemblies 40. Valve member 38 includes actuator piston 42 and needles 44. Each needle 44 includes needle body 46, sleeve assembly 48, and retainer 50. Needle body 46 includes barrel 52 and stem 54. Sleeve assembly 48 includes first sleeve 56 and second sleeve 58. First sleeve 56 includes base 60, neck 62, and head 64. Each seat assembly 40 includes seat 66 and seat ring 68. Each seal cartridge 30 includes cartridge body 70, first seal 72, and second seal 74.

Applicator 16 is configured to mix individual component materials to form the plural component material and dispense the resulting plural component material at a desired application point. Actuation chamber 82 is formed within applicator actuator housing 32. Actuation chamber 82 can be connected to a source of driving fluid, such as compressed air or hydraulic liquid. The driving fluid can be provided to actuation chamber 82 on opposite axial sides of actuator piston 42 to cause actuation of control valve 28.

Material receiver 34 is mounted to actuator housing 32. Material inlet 76*a* is disposed on a first side of material receiver 34 and provides a pathway for a first component material to enter into applicator 16. For example, a conduit, such as downstream conduit 20*a* (FIG. 1), can be connected to material receiver 34 at material inlet 76*a*. Material inlet 76*b* is disposed on a second side of material receiver 34 and provides a pathway for a second component material to enter into applicator 16. For example, a conduit, such as downstream conduit 20*b* (FIG. 1), can be connected to material receiver 34 at material inlet 76*b*.

Seal cartridges 30 are disposed within applicator body 24. In the example shown, seal cartridges 30 are disposed at the interface between material receiver 34 and actuator housing 32. More specially, cartridge body 70 extends from within actuator housing 32 and into material receiver 34. First seal 72 and second seal 74 are supported by cartridge body 70. Needles 44 extend through seal cartridges 30 and interface with first seal 72 and second seal 74. The interface between needles 44 and first seal 72 and second seal 74 prevent leakage of the component materials. In the example shown, first seals 72 are formed as cup seals with the open portion of the cup oriented towards flowpaths 80*a*, 80*b* through material receiver 34. First seal 72 can be formed from an ultra-high molecular weight (UHMW) polyethylene, among other options, to provide a robust seal resistant to wear by the abrasive particulate in the component materials. As known in the art, UHMW polyethylene is a polymer material, available from a number of manufacturers, with extremely long chains with a molecular mass typically between 3.5 and 7.5 million atomic mass units. In some examples, first seal 72 can be formed from microsphere-filled UHMW. In some examples, first seal 72 is formed from Ceram P® UHMW polyethylene, which is manufactured by Mitsubishi Chemical Advanced Materials. The material forming first seal 72 and the cup configuration of first seal 72 prevent the abrasive particulate within the component material from migrating between the first seal 72 and needle 44. The material forming first seal 72 is highly resistant to wear providing an improved operational life.

Connector 36 is disposed at an opposite axial end of material receiver 34 from actuator housing 32. Connector 36 can be mounted to material receiver 34. Material outlets 78*a*, 78*b* are formed in connector 36. Mixer 26 is mounted to connector 36 to receive the individual component materials from connector 36. Flowpaths 80*a*, 80*b* extend from material inlets 76*a*, 76*b* through material receiver 34 and connector 36 to material outlets 78*a*, 78*b*. The flowpaths 80*a*, 80*b* are maintained separate through material receiver 34 and connector 36. The flowpaths 80*a*, 80*b* do not combine until within mixer 26 to prevent mixing of the component materials within any portion of the applicator 16 other than the mixer 26.

Control valve 28 is disposed in applicator body 24. Control valve 28 controls flow of the component materials through applicator 16 and to mixer 26. Seat assemblies 40 are disposed at the interface between connector 36 and material receiver 34 in the example shown. The flowpaths 80*a*, 80*b* pass through the seat assemblies 40 between the portions of the flowpaths 80*a*, 80*b* within the material receiver 34 and the portions of the flowpaths 80*a*, 80*b* within the connector 36. In the example shown, each seat assembly 40 includes seat 66 that is configured to interface with a portion of the needle 44 that extends through that seat 66 when the control valve 28 is in the closed state. Seat ring 68 is disposed on an opposite axial side of each seat 66 from seal cartridge 30. Seat rings 68 are disposed on the downstream side of seats 66. Seat rings 68 interface with the downstream axial faces of seats 66. Seat 66 can provide support to seats rings 68.

Valve member 38 is configured to interface with seat assemblies 40 to control the flow of the component materials through applicator 16. More specifically, needles 44 interface with seats 66 to prevent or stop the flows of the component materials, and needles 44 disengage from seats 66 to allow flow of the component materials. Actuator piston 42 is disposed within actuation chamber 82 and is configured to be actuated axially in the first axial direction AD1 and the second axial direction AD2 by the driving fluid provided to the actuation chamber 82. Each needle 44 is connected to actuator piston 42 to be actuated axially by the actuator piston 42. Needles 44 extend from actuator piston 42, thorough seal cartridges 30, and through seats 66, in the example shown. In the example shown, valve member 38 is configured to shift in first axial direction AD1 from the closed stated (shown in FIG. 2B) to the open state (shown in FIG. 2A). Valve member 38 is configured to shift in second axial direction AD2 from the open state to the closed state.

Each needle 44 includes needle body 46 that extends from actuator piston 42 along a needle axis NA, through seal cartridge 30, and through seat 66. Barrel 52 is a larger diameter portion of needle body 46 that is connected to actuator piston 42. Stem 54 extends axially from barrel 52 and is elongate along the needle axis NA. Stem 54 is a smaller diameter portion of needle body 46. Sleeve assemblies 48 are mounted to needle bodies 46. Sleeve assemblies 48 are mounted to needle bodies 46 to protect the needle bodies 46 from the abrasive particulate in the component materials. Specifically, each sleeve assembly 48 is mounted on the needle body 46 of the respective needle 44. More specifically, each sleeve assembly 48 is mounted on stem 54 of the needle body 46. Stem 54 extends fully through each of the first sleeve 56 and the second sleeve 58.

In the example shown, sleeve assembly 48 is formed by first sleeve 56 mounted on stem 54 and second sleeve mounted on stem 54. First sleeve 56 can be considered to form a distal one of the sleeves of sleeve assembly 48. First sleeve 56 extends through seat 66. Base 60 of first sleeve 56 is configured to abut second sleeve 58. In the example shown, base 60 has a smaller diameter than second sleeve 58. Base 60 has a diameter smaller than the diameter through seat 66 to facilitate assembly of needle 44, as discussed in more detail below. Neck 62 extends axially between base 60 and head 64. Neck 62 extends through seat 66. Head 64 is disposed at a distal end of first sleeve 56 opposite base 60. Head 64 is disposed at an end of first sleeve 56 opposite second sleeve 58. Head 64 is disposed at a distal end of sleeve assembly 48. Head 64 is disposed on an opposite axial side of seat 66 from base 60. Head 64 is disposed on an opposite axial side of seat 66 from actuator piston 42. Head 64 has a larger diameter than the opening through seat 66 so head 64 can interface with seat 66 to prevent flow of the component materials downstream through seat 66. In the example shown, head 64 is configured to interface with the downstream side of seat 66 with control valve 28 in the closed state.

Retainer 50 is disposed at the distal end of needle body 46 opposite actuator piston 42. Retainer 50 is mounted to stem 54 and is configured to retain sleeve assembly 48 on needle body 46. Retainer 50 interfaces with sleeve assembly 48 and retains sleeve assembly 48 on needle body 46. In the example shown, retainer 50 interfaces with first sleeve 56 and compresses first sleeve 56 and second sleeve 58 between retainer 50 and barrel 52. More specifically, retainer 50 interfaces with a downstream side of head 64. In the example shown, retainer 50 has a smaller diameter than head 64 such that head 64 shields retainer 50 from the component materials flowing applicator 16. Retainer 50 can be connected to stem 54 in any desired manner. In the example shown, retainer 50 is a threaded retainer 50 that connects to stem 54 by interfaced threading. Specifically, retainer 50 includes interior threads that interface with exterior threads on stem 54 to connect retainer 50 to stem 54.

Second sleeve 58 is disposed axially between first sleeve 56 and barrel 52. Second sleeve 58 is configured to interface with the first seal 72 and second seal 74 of seal cartridge 30. The interface between sleeve assembly 48 and first seal 72 prevents migration of the component materials from the flowpaths 80*a*, 80*b* into seal cartridge 30 and then out of applicator body 24.

In the example shown, each needle 44 is assembled by fitting second sleeve 58 onto stem 54. Second sleeve 58 slides onto stem 54 such that stem passes fully through second sleeve 58. In the example shown, second sleeve 58 has a larger diameter than the diameter through seat 66 such that second sleeve 58 cannot pass through seat 66. In some examples, second sleeve 58 can be fixed to stem 54, such as by adhesive. Material receiver 34 is assembled to actuator housing 32 such that stem 54 passes through seat 66. First sleeve 56 is then slid onto stem 54 such that base 60 and neck 62 pass through seat 66. Base 60 and neck 62 have smaller diameters than the opening through seat 66 such that those portions of first sleeve 56 can pass through seat 66. Head 64 has a larger diameter than the opening through seat 66 such that head 64 cannot pass through seat 66. Retainer 50 is secured to the distal end of stem 54 and compresses sleeve assembly 48 on needle body 46. Connector 36 can then be mounted to material receiver 34 and mixer 26 can be mounted to connector 36.

It is understood that, while sleeve assembly 48 is shown as formed by multiple sleeves (first sleeve 56 and second sleeve 58 in the example shown) sleeve assembly 48 can be formed by a single sleeve or more than two sleeves. In the example shown, sleeve assembly 48 is formed by the multiple sleeves to facilitate assembly of needle 44 and assembly of applicator 16 due to the diameter of second sleeve 58 being larger than the diameter of the opening through seat 66. As such, second sleeve 58 is assembled to needle 44 prior to passing needle 44 through seat 66 and then assembling first sleeve 56 to needle 44. In other examples, the first sleeve 56 and second sleeve 58 can be formed together as a single sleeve that is mounted on stem 54. For example, the portion of sleeve assembly 48 forming second sleeve 58 can be formed with a smaller diameter, such as the same diameter of base 60 of first sleeve 56, and the seals of seal cartridge 30 can similarly be formed with a smaller diameter to mate with and seal against the smaller diameter sleeve assembly 48. Additionally or alternatively, the opening through seat 66 can be enlarged such that portions of sleeve assembly 48 having the diameter of second sleeve 58 can pass through seat 66. In such examples, needle 44 can be connected to actuator piston 42 and material receiver 34 mounted to actuator housing 32. The unitary sleeve forming sleeve assembly 48 can then be slid onto stem 54 and through seat 66. Retainer 50 is then mounted to stem 54 to secure the unitary sleeve on stem 54.

The one or more sleeves forming the sleeve assembly 48 are disposed over the metallic needle bodies 46 to protect those components from the highly abrasive component materials. Each sleeve comprises highly polished exterior surfaces that reduce or eliminate the microscopic abrasive particles from attaching to the exterior surfaces of the sleeves. The particulate can attach to blemishes of the sliding surfaces but such attachment is prevented by the smoothness of the exterior surfaces, thus reducing or eliminating wear on the seals, such as first seals 72 that are intended to be exposed to the component materials, and sleeved components, formed by needles 44.

The smoothness of the sliding sleeve assembly 48 must be maintained over the life of the applicator 16, so protecting these surfaces is critical. C3 submicron tungsten carbide can be used to form the sleeves of the sleeve assembly 48 due to its superior surface finish, but other types of tungsten or ceramic can be utilized as long as a highly polished surface finish can be achieved. The smooth surface finish inhibits adhesion of the abrasive materials on the surfaces of the sleeve assembly 48, preventing the moving needles 44 from pulling the abrasive particulate under the seals and between the seal and the moving needle 44 component. The mean roughness depth (Rz) of the exterior sliding surfaces is controlled to provide the smooth surface that prevents adhesion of the abrasive particulate. The Rz can be determined by measuring the vertical distance from the highest peak to the lowest valley within five sampling lengths, then averaging these distances. The Rz averages the five tallest peaks and the five lowest valleys to provide an indication of the smoothness of the surface finish. Typically, a surface finish having an Rz of less than about 0.8 micrometers (μm) (about 31.5 microinches (μin)) is required to achieve a mirror finish. The Rz of the exterior surface of the one or more sleeves of the sleeve assembly 48 can be up to about 0.8 μm (about 31.5 μin). In some examples, the Rz of the sleeve surfaces is up to about 0.3 μm (about 11.8 μin). Some examples of the sleeve surfaces have a Rz of up to about 0.25 μm (about 9.8 μin).

The surface finish can, in some examples, be enhanced by the use of any one of physical vapor deposition (PVD), plasma assisted chemical vapor deposition (PACVD), and chemical vapor deposition (CVD) coatings, which increase the hardness of the surface of the highly polished surface and which can assist in protecting the surface finish. The exterior surfaces of the sleeve assembly 48 is the portion of the needle 44 interfacing with and sliding against the seals and is the portion of needles 44 in the direct flowpath of the component materials such that the component materials impinge on the exterior of the sleeve assembly 48. For example, the component materials can impinge on the flared head 64 of the sleeve assembly 48 as the component materials flow downstream through seat assembly 40 with control valve 28 in the open state. The exterior surfaces of sleeve assembly 48 are the smooth surfaces. The smooth exterior surfaces can be formed by tungsten or ceramic and slide against the mating seal surfaces.

The smooth exterior surfaces significantly increase the operating lifespan of applicator 16. In some examples, the sleeved configuration of applicator 16 increased the operational lifespan from about 10,000 cycles and about 13,000 cubic centimeters (cc) dispersed (for a soft, energized seat configuration) to more than 2.07 million cycles and about 2.8 million cc dispersed, a cycle increase of more than 20,600%. In some examples, the sleeved configuration of applicator 16 increased the operational lifespan from about 190,000 cycles and about 250,000 cc dispersed (for a hard carbide seat configuration), to more than 2.07 million cycles and about 2.8 million cc dispersed, a cycle increase of more than 990%. The smooth exterior surfaces may provide even greater benefits than those discussed as the applicator 16 did not fail during the tests, but instead the testing was stopped for other reasons.

During operation, control valve 28 is initially in the closed state shown in FIG. 2B. Driving fluid is provided to actuation chamber 82 to drive actuator piston 42 in first axial direction AD1. Actuator piston 42 drives needles 44 in first axial direction AD1 to shift the needles 44 from the closed state shown in FIG. 2B to the fully open state shown in FIG. 2A. The heads 64 of needles 44 disengage from seats 66, opening the flowpaths through applicator 16 and allowing the component materials to flow downstream from material receiver 34, to connector 36, and to mixer 26 for application.

To stop dispensing of the material, control valve 28 is actuated from the open state shown in FIG. 2A to the closed state shown in FIG. 2B. In the example shown, driving fluid is provided to actuation chamber 82 to drive actuator piston 42 in second axial direction AD2. It is understood, however, that some examples of actuator can be spring actuated or spring assisted such that a spring interfaces with actuator piston 42 to drive actuator piston in the second axial direction AD2. Actuator piston 42 pulls needles 44 in second axial direction AD2 from the open state to the closed state. Heads 64 engage with seats 66 to stop flow through applicator 16.

As control valve 28 transitions to the closed state, heads 64 pass through seat rings 68 prior to engaging with seats 66. Simultaneously, portions of second sleeve 58 pass out of the flowpaths 80*a*, 80*b* and slide past first seals 72. Heads 64 passing through seat rings 68 can push some of the component material upstream past the seat 66 and back into the portion of the flowpaths 80*a*, 80*b* defined by material receiver 34. The portions of the second sleeves 58 exiting from the portion of the flowpaths 80*a*, 80*b* defined by material receiver 34 increases the volume within the material receiver 34 available to receive component material, facilitating the needles 44 pushing the component material back into material receiver 34. The needles 44 pushing the component materials upstream through seats 66 prevents dripping and dispense of the plural component material after shut-off. Such a configuration facilitates precise dispensing of desired volumes of the plural component material and quick shut off of the flow of the dispensed material.

Applicator 16 provides significant advantages. Sleeve assemblies 48 are formed with smooth exterior surfaces that inhibit adhesion of the particulate in the component materials, thereby preventing the particulate from being pulled between the sliding component and an interfacing seal. The particulate being pulled between such components causes accelerated wear and degradation of the components. The smooth exterior surfaces inhibit such migration, providing a more robust applicator 16 having a longer operational life. Sleeve assembly 48 is mounted on needle body 46 such that if wear is experienced by the sleeve assembly 48, the sleeve assembly 48 can be removed and replaced without requiring replacement of the full needle 44, thereby reducing costs.

Figure 3A:
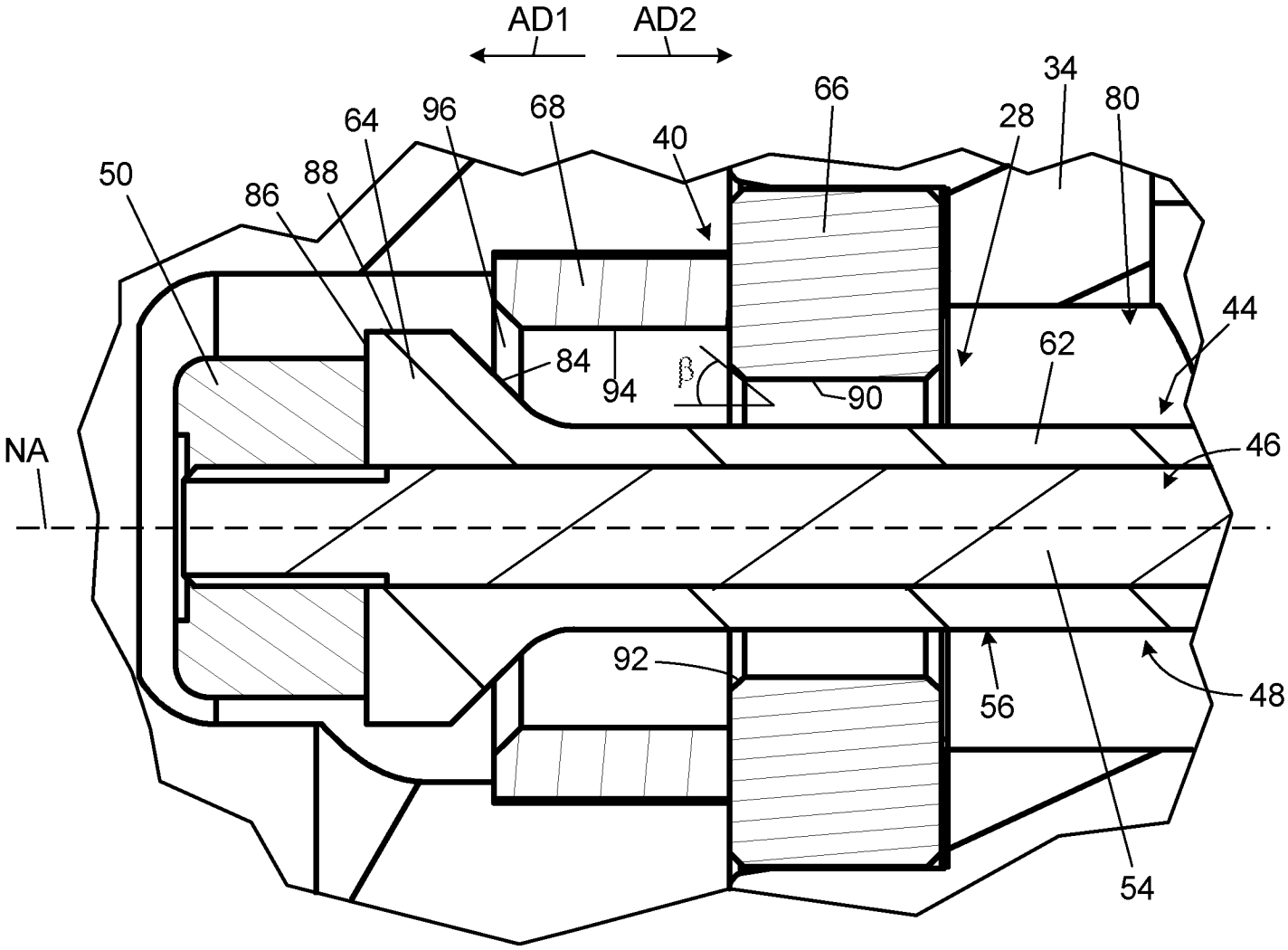
FIG. 3A is an enlarged cross-sectional view showing detail 3A in FIG. 2A.
Figure 3B:
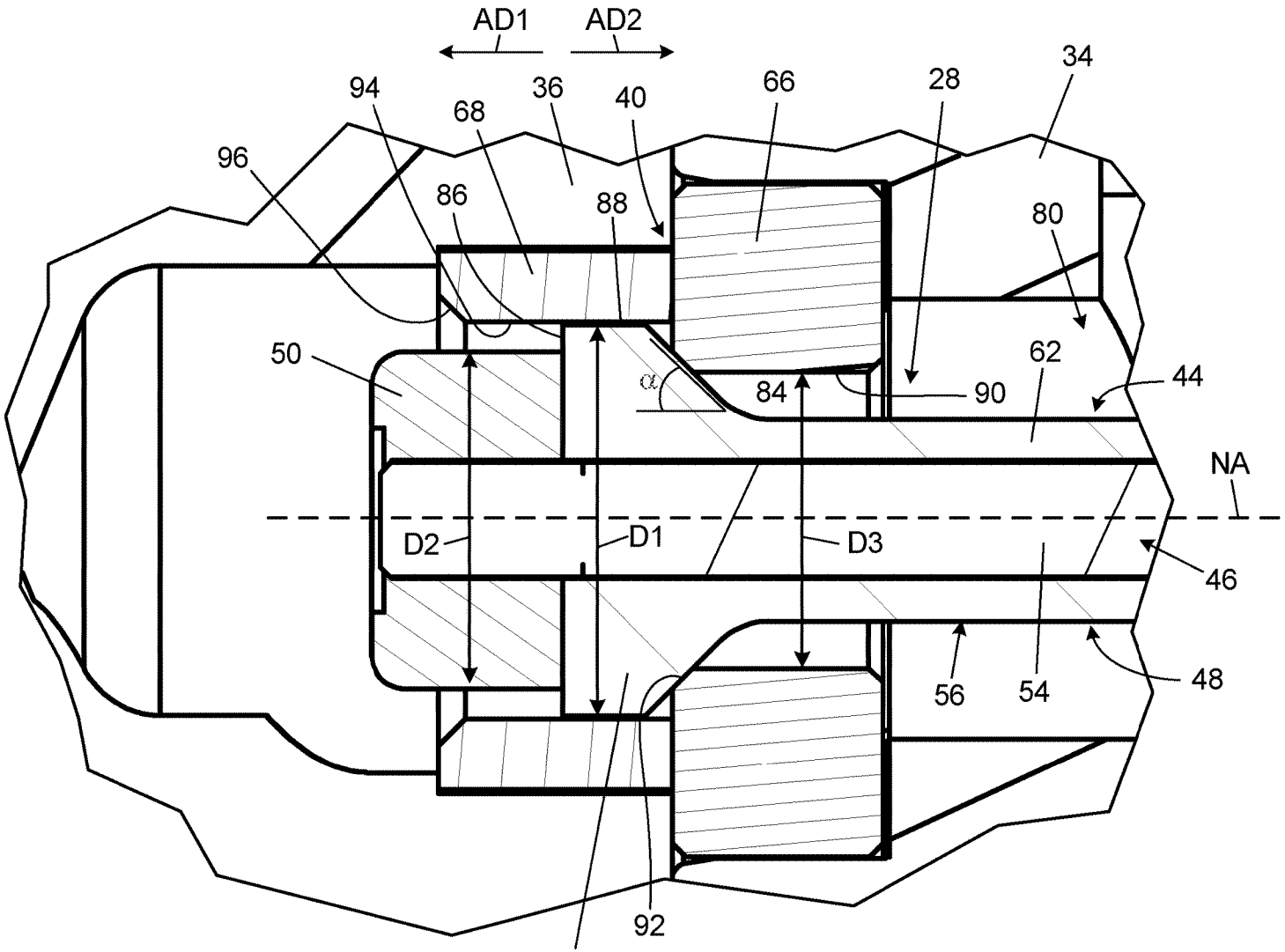
FIG. 3B is an enlarged cross-sectional view showing detail 3B in FIG. 2B.

FIG. 3A is an enlarged cross-sectional view of detail 3A in FIG. 2A. FIG. 3B is an enlarged cross-sectional view of detail 3B in FIG. 2B. FIGS. 3A and 3B will be discussed together. Portions of control valve 28 are shown. Specifically, the interface between needle 44 and seat 66 is shown in FIGS. 3A and 3B. First sleeve 56, stem 54, and retainer 50 of needle 44 are shown. Head 64 and neck 62 of first sleeve 56 are shown. Head 64 incudes upstream face 84, downstream face 86, and outer edge 88. Seat assembly 40 is shown and includes seat 66 and seat ring 68. Seat 66 includes inner seat surface 90 and seat lip 92. Seat ring 68 includes inner ring surface 94 and ring lip 96.

First sleeve 56 is mounted on stem 54. First sleeve 56 covers the exterior of stem 54 such that the surface of stem 54 extending circumferentially about the needle axis NA is not exposed to the particulate flowing through applicator 16. Neck 62 is a smallest diameter portion of first sleeve 56 and extends through seat 66. Head 64 is disposed on a downstream side of seat 66. Head 64 includes upstream face 84 oriented in second axial direction AD2 and towards seat 66. Upstream face 84 is sloped between neck 62 and the outer edge 88 of head 64. Upstream face 84 is oriented transverse to and non-orthogonal with the needle axis NA. Upstream face 84 can be considered to be frustoconical in the example shown.

Upstream face 84 is disposed at angle α relative to needle axis NA. In the example shown, angle α is formed as a 45-degree angle, through it is understood that angle α can be another acute angle, such as 30-degrees, 60-degrees, or another acute angle. The angled upstream face 84 deflects the flow of the component material around head 64. The angled upstream face 84 facilitates even and balanced wear of the upstream face 84 about the needle axis NA. The even and balanced wear around the needle axis NA facilitates maintaining the seal between first sleeve 56 and seat 66 and provides an increased operational lifespan.

Outer edge 88 extends between upstream face 84 and downstream face 86. The portion of head 64 between upstream face 84 and downstream face 86 can be considered to be cylindrical. Downstream face 86 is disposed on an opposite axial side of head 64 from upstream face 84. Downstream face 86 is oriented in first axial direction AD1. In the example shown, downstream face 86 is a flat face oriented in first axial direction AD1. Downstream face 86 is formed as a ring disposed orthogonal to the needle axis NA in the example shown.

Retainer 50 is mounted to stem 54 and maintains sleeve assembly 48 on stem 54. Retainer 50 interfaces with head 64 to secure sleeve assembly 48 on stem 54. Retainer 50 can compress sleeve assembly 48 on stem 54. Retainer 50 interfaces with downstream face 86 of head 64 to retain sleeve assembly 48 on stem 54 and, in some examples, exert the compressive force on sleeve assembly 48. In the example shown, head 64 has a diameter D1 at the outer edge 88 of head 64 and retainer 50 has diameter D2. Diameter D1 is larger than diameter D2. The larger diameter D1 of head 64 than the diameter D2 of retainer 50 shields retainer 50 from the flow of the component material. Head 64 deflects the component material such that the component material does not impinge on retainer 50. Head 64 protecting retainer 50 from the flow of the component material prevents impingement to maintain the integrity of the retainer 50, allowing the retainer 50 to be formed from a less resilient material than first sleeve 56, reducing costs.

First sleeve 56 is configured to interface with seat 66 with control valve 28 in the closed state (FIG. 3B) and first sleeve 56 is disengaged from seat 66 with control valve 28 in the open state (FIG. 3A). Inner seat surface 90 extends about needle axis NA and defines a passage that extends through seat 66 and provides a flowpath for the component material. More specifically, inner ring surface 94 defines a cylindrical passage. Inner ring surface 94 extends about needle axis NA and defines a passage though seat ring 68 that provides a flowpath for the component material. More specifically, inner ring surface 94 defines a cylindrical flowpath. The diameter of the passage through seat ring 68 is larger than the diameter of the passage through seat 66 such that seat ring 68 does not restrict the flow of the component material. The diameter D1 of the head 64 is larger than the diameter D3 of the passage through seat 66 such that head 64 engages with seat 66 with control valve 28 in the closed state. More specifically, upstream face 84 of head 64 engages with seat lip 92 with control valve 28 in the closed state.

Seat lip 92 is formed on a downstream side of seat 66. An additional seat lip 92 can be formed on the upstream side of seat 66 to facilitate installation of seat 66 with either axial face facing in first axial direction AD1. Seat lip 92 extends between the downstream face of seat 66 and the inner seat surface 90. Seat lip 92 is sloped relative to needle axis NA. Seat lip 92 extends transverse to and non-orthogonal with needle axis NA. Seat lip 92 is disposed at angle β relative to needle axis NA. In the example shown, angle β is formed as a 45-degree angle, through it is understood that angle β can be another acute angle, such as 30-degrees, 60-degrees or another acute angle. Angle β can be the same as angle α to facilitate mating between the sloped upstream face 84 and the sloped seat lip 92. The interface formed between upstream face 84 and seat lip 92 can be considered to be frustoconical. The sloped interface between upstream face 84 and seat lip 92 facilitates tight sealing to prevent leakage of the component materials. The sloped interface between upstream face 84 and seat lip 92 also encourages uniform, balanced wear on both head 64 and seat 66 that provides increased operational life for control valve 28.

Seat ring 68 interfaces with the downstream face of seat 66. Ring lip 96 is disposed on a downstream end of seat ring 68 opposite the upstream end of seat ring 68 that interfaces with seat 66. Ring lip 96 is sloped relative to needle axis NA. Ring lip 96 can be formed at the same or a different angle than angle α and/or angle β. Ring lip 96 is formed at an acute angle, similar to angles α and β. For example, ring lip 96 can be formed at 30-degrees, 45-degrees, 60-degrees, among other options. In the example shown, ring lip 96 is formed at the same angle αs angle α. The common sloped configurations of upstream face 84 of head 64 and ring lip 96 forms a flowpath of a uniform width along its length between upstream face 84 and ring lip 96. The uniform size of the flowpath facilitates laminar flow of the component material therethrough, preventing turbulent flow, increased pressure due to a narrowing flowpath, and increased velocity due to a widening flowpath, which can cause undesired wear. The flowpath between head 64 and seat ring 68 can be considered to be frustoconical in the example shown.

During operation, needle 44 is initially in the closed state shown in FIG. 3B. Needle 44 is actuated from the closed state to the open state shown in FIG. 3A. Upstream face 84 disengages from seat lip 92 and head 64 shifts in first axial direction AD1 from the closed state to the open state. Head 64 shifts axially through seat assembly 40 to the fully open state shown in FIG. 3A. With needle 44 in the fully open state, outer edge 88 of head 64 is fully out of seat ring 68. An axial gap is formed between the interface between upstream face 84 and outer edge 88 and the interface between ring lip 96 and the downstream side of seat ring 68. The component material flows downstream through seat 66 and seat ring 68 for application. The component material impinges on the sloped upstream face 84 of head 64 and head 64 deflects the component material radially outward relative to needle axis NA. Head 64 shields the retainer 50 to inhibit impingement of the component material on the retainer 50. The annular impingement on upstream face 84 encourages uniform wear on head 64.

Needle 44 shifts in the second axial direction AD2 from the fully open state to the closed state to stop the flow of the component material. Head 64 initially passes through seat ring 68. The diameter D1 of head 64 is smaller than the diameter of the passage through seat ring 68, but the diameters of head 64 and the passage through seat ring 68 can be similarly sized to inhibit flow through the narrow annular gap between outer edge 88 and the inner ring surface 94 of seat ring 68. The similar sizes of the head 64 and the passage through seat ring 68 facilitate needle 44 pulling component material still within seat assembly 40 and downstream of the interface between head 64 and seat 66 upstream through seat 66 and into the portion of the flowpath 80 within material receiver 34. Pulling the component material upstream and through seat 66 facilitates quick reaction and shut off of flow when applicator 16 is detriggered and prevents leakage and overapplication of the component materials. Needle 44 continues to shift in second axial direction AD2 until upstream face 84 engages with seat lip 92. Upstream face 84 engaging with seat lip 92 places control valve 28 in the fully closed state.

Needle 44 provides significant advantages. First sleeve 56 is the portion of needle 44 that the component material impinges on. First sleeve 56 is formed from a harder material than needle body 46 to protect the needle body 46 from the abrasive component materials. For example, the first sleeve 56 can be formed from C3 tungsten carbide or ceramic while the needle body 46 can be formed from stainless steel. Head 64 is directly in the flowpath of the component materials such that the component materials impinge on the head 64 as the component materials flow downstream. Specifically, upstream face 84 is oriented in second axial direction AD2 such that the component materials impinge on upstream face 84. Upstream face 84 is sloped to deflect the component materials and encourage uniform wear that facilitates sealing with seat lip 92, whereas non-uniform wear can lead to leakage and premature failure. Head 64 has a larger diameter than retainer 50 to shield retainer 50 from the flow of the component materials, as retainer 50 can be formed from a material that is less costly than first sleeve but is more susceptible to wear, such as 18-8 stainless steel. Head 64 is also sized to pull component material back through seat assembly 40 and into material receiver 34 as needle 44 transitions to the closed state, preventing leakage and facilitating precise application volumes.

Figure 4A:
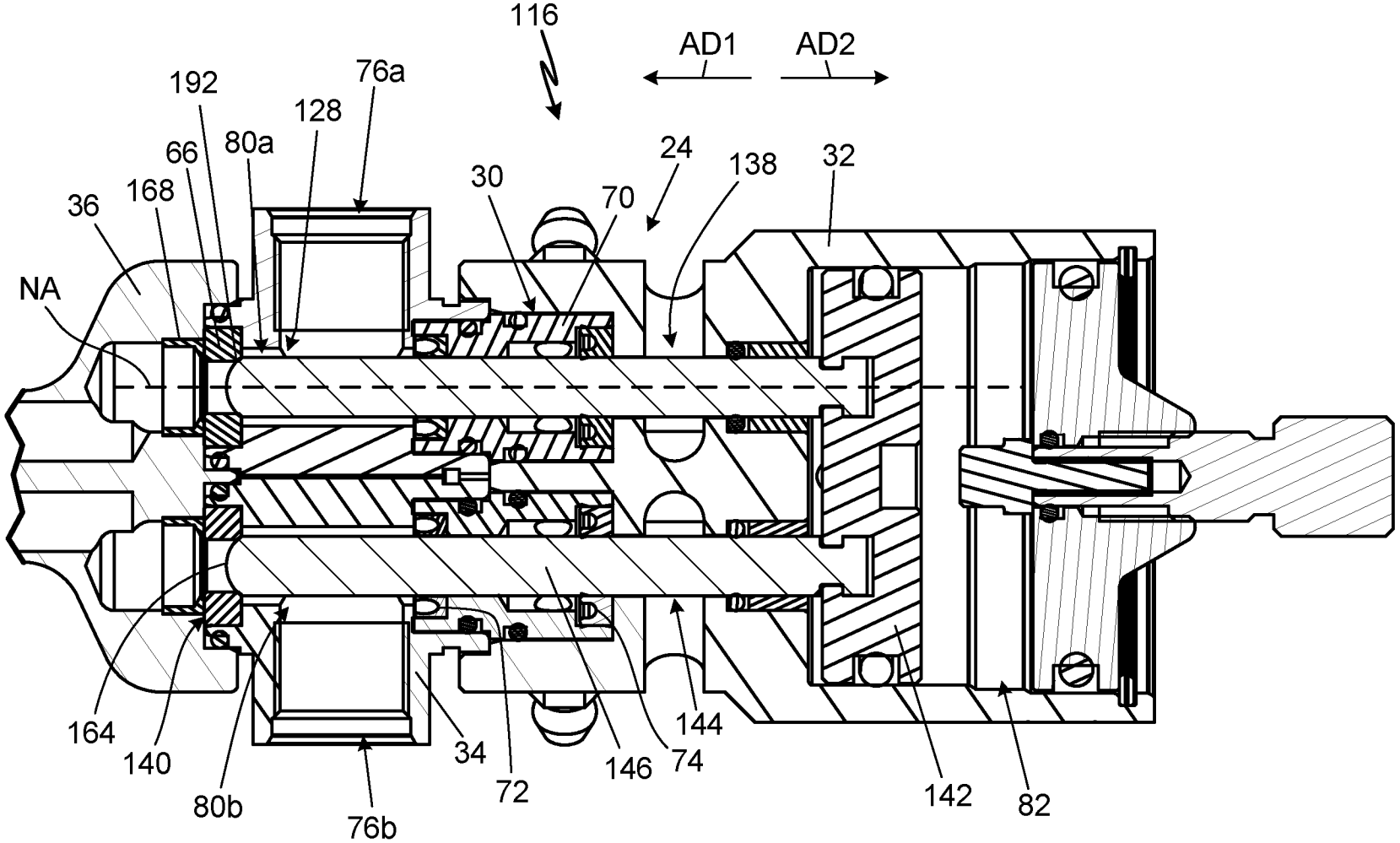
FIG. 4A is a cross-sectional view of an applicator in a holding, non-dispense state.
Figure 4B:
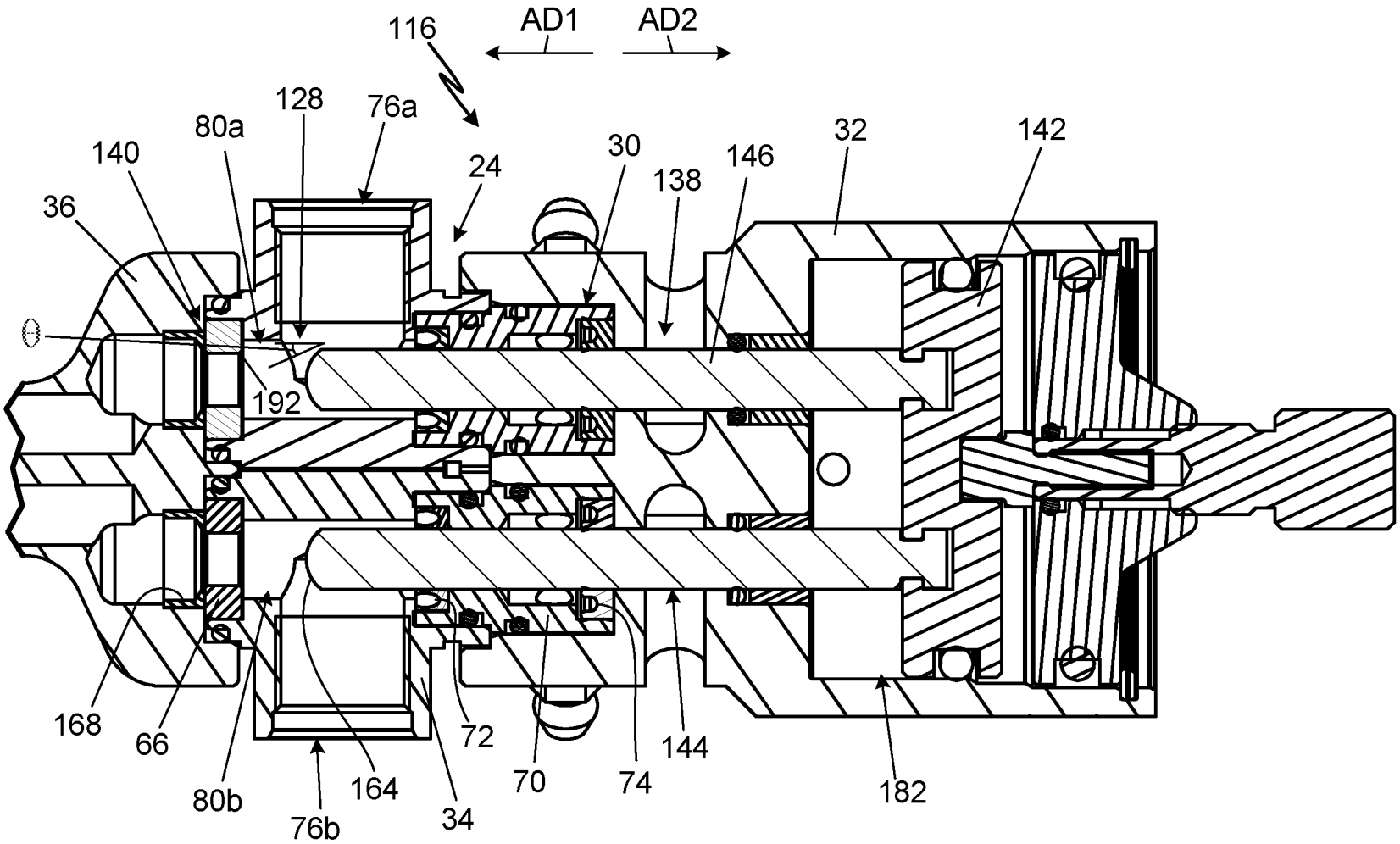
FIG. 4B is a cross-sectional view of the applicator of FIG. 4A in a dispense state.

FIG. 4A is a cross-sectional view of applicator 116 in a holding, non-dispense state. FIG. 4B is a cross-sectional view of applicator 116 in a dispensing state. FIGS. 4A and 4B will be discussed together. Applicator 116 is substantially similar to applicator 16 (best seen in FIGS. 2A and 2B), except that control valve 128 of applicator 116 shifts in first axial direction AD1 from the open state to the closed state and shifts in second axial direction AD2 from the closed state to the open state. Like components between applicator 16 and applicator 116 are labeled with a reference numeral increased by "100" with reference to applicator 116.

Applicator 116 includes applicator body 24, control valve 128, and seal cartridges 30. Applicator body 24 includes actuator housing 32, material receiver 34, and connector 36. Control valve 128 includes valve member 138 and seat assemblies 140. Valve member 138 includes actuator piston 142 and needles 144. Each needle 144 includes needle body 146 and head 164. Each seat assembly 140 includes seat 66 and seat ring 168. Each seal cartridge 30 includes cartridge body 70, first seal 72, and second seal 74.

Applicator 116 is configured to dispense abrasive material at a desired application point. In the example shown, applicator 116 is configured to mix individual component materials to form the plural component material and dispense the resulting plural component material at a desired application point. Material receiver 34 is mounted to actuator housing 32. Material inlets 76*a*, 76*b* provide pathways for the component materials to enter into applicator 116.

Seal cartridges 30 are disposed in applicator body 24. In the example shown, seal cartridges 30 are disposed at the interface between material receiver 34 and actuator housing 32. First seal 72 and second seal 74 are supported by cartridge body 70. Needles 144 extend through seal cartridges 30 and interface with first seal 72 and second seal 74. The interface between needles 144 and first seal 72 and second seal 74 prevent leakage of the component materials. In the example shown, first seals 72 are formed as cup seals with the open portion of the cup oriented towards the flowpath 80*a*, 80*b* through material receiver 34. First seal 72 can be formed from an ultra-high molecular weight (UHMW) polyethylene, among other options. In some examples, first seal 72 can be formed from microsphere filled UHMW. In some examples, first seal 72 is formed from Ceram P®. The material forming first seal 72 and the cup configuration of first seal 72 prevent the abrasive particulate within the component material from migrating between the first seal 72 and needle 144. The material forming first seal 72 is highly resistant to wear.

Connector 36 is disposed at an opposite axial end of material receiver 34 from actuator housing 32. Connector 36 can be mounted to material receiver 34. A mixer, such as mixer 26 (FIG. 2A), is mounted to connector 36 to receive the individual component materials from connector 36. Flowpaths 80*a*, 80*b* extend from material inlets 76*a*, 76*b* through material receiver 34 and connector 36 and are maintained separate through material receiver 34 and connector 36.

Control valve 128 controls flow of the component materials through applicator 116. Seat assemblies 140 are disposed at the interface between connector 36 and material receiver 34. The flowpaths 80*a*, 80*b* pass through the seat assemblies 140 between the portions of the flowpaths 80*a*, 80*b* within the material receiver 34 and the portions of the flowpaths 80*a*, 80*b* within the connector 36. In the example shown, each seat assembly 140 includes seat 66 that is configured to interface with a portion of the needle 144 when the control valve 128 is in the closed state. Seat ring 168 is disposed on an opposite axial side of each seat 66 from needle 144, in the example shown.

Valve member 138 is configured to interface with seat assemblies 140 to control the flow of the component materials. More specifically, needles 144 interface with seats 66 to prevent or stop the flows of the component materials and needles 144 disengage from seats 66 to allow flow of the component materials. Actuator piston 142 is disposed within actuation chamber 82 and is configured to be actuated axially in the first axial direction AD1 and the second axial direction AD2 by driving fluid (e.g., pneumatic or hydraulic) provided to the actuation chamber 82. Each needle 144 is connected to actuator piston 142 to be actuated axially by the actuator piston 142. Needles 144 extend from actuator piston 142, thorough seal cartridges 30, and into the portions of the flowpaths 80*a*, 80*b* within material receiver 34. Needles 144 do not extend through seats 66 in the example shown. Needles 144 are configured to be axially actuated by actuator piston 142 along needle axes NA. In the example shown, valve member 138 is configured to shift in second axial direction AD2 from the closed stated (shown in FIG. 4A) to the open state (shown in FIG. 4B). Valve member 138 is configured to shift in first axial direction AD1 from the open state to the closed state.

Each needle 144 includes needle body 146 that extends from actuator piston 142 along a needle axis NA, through seal cartridge 30, and into material receiver 34. Head 164 is formed at a distal end of needle body 146 opposite the end connected to actuator piston 142. Head 164 is a sloped tip of needle 144. The downstream face of head 164 is the sloped tip of needle 144 that interfaces with seat 66. Head 164 is configured to interface with an upstream side of seat 66 with control valve 128 in the closed state. As discussed above with regard to FIGS. 3A and 3B, seat 66 includes a sloped or otherwise contoured seat lip 92 that is configured to interface with head 164 to form the seal therebetween. In the example shown, the seat lip 92 is disposed on the upstream side of seat 66.

In the example shown, head 164 is sloped at an angle θ to mate with seat lip 92 on the upstream side of seat 66. Seat lip 192 is sloped at the same angle β as seat lip 92. In the example shown, seat lip 92 is formed as a 45-degree angle, through it is understood that angle θ can be another acute angle, such as 30-degrees, 60-degrees or another acute angle. Angle θ of head 164 can be the same as the angle β to facilitate mating therebetween. In the example shown, angle θ is formed as a 45-degree angle, through it is understood that angle θ can be another acute angle, such as 30-degrees, 60-degrees or another acute angle. In some examples, head 164 is radiused. In such an example, head 164 can be considered to be formed as a domed tip of needle 144.

In the example shown, needle 144 does not include a sleeve mounted to needle body 146. Instead, needle body 146 is formed from the smooth material resistant to wear by the abrasive particulate in the component materials. Each needle 144 comprises highly polished exterior surfaces that reduce or eliminate the microscopic abrasive particles from attaching to the exterior surfaces of the needles 144. The particulate can attach to blemishes of the sliding surfaces but such attachment is prevented by the smoothness of the exterior surface, thus reducing or eliminating wear on the seals, such as first seals 72 that are intended to be exposed to the component materials, and the active sealing and sliding components formed by needles 144. The smoothness of the sliding needles 144 must be maintained over the life of the applicator 116, so protecting these surfaces is critical. C3 submicron tungsten carbide can be used to form the needles 144 due to its superior surface finish, but other types of tungsten or ceramic can be utilized as long as a highly polished surface finish can be achieved. The smooth surface finish inhibits adhesion of the abrasive materials on the surfaces of the needle 144, preventing the moving needles 144 from pulling the abrasive particulate under the seals and between the seal and the moving needle 144 component. The Rz of the exterior surface of the needle 144 can be up to about 0.8 μm (about 31.5 μin). In some examples, the Rz of the needle 144 surfaces is up to about 0.3 μm (about 11.8 μin). Some examples of the needle 144 surfaces have a Rz of up to about 0.25 μm (about 9.8 μin).

Maintaining the surface finish can, in some examples, be enhanced by the use of any one of physical vapor deposition (PVD), plasma assisted chemical vapor deposition (PACVD), and chemical vapor deposition (CVD) coatings, which increase the hardness of the surface of the highly polished surface and which can assist in protecting the surface finish. The exterior surfaces of the needle 144 is the portion of the needle 144 interfacing with and sliding against the seals and is the portion in the direct flowpath of the component materials such that the component materials impinge on the exterior of the needle 144. The exterior surfaces of needles 144 are the smooth surfaces, such as made out of tungsten or ceramic, that slide against the mating seal surfaces. The interface between the exterior of needles 144 and first seals 72 prevents migration of the component materials from the flowpaths 80*a*, 80*b* into seal cartridge 30 and then out of applicator body 24.

Figure 5:
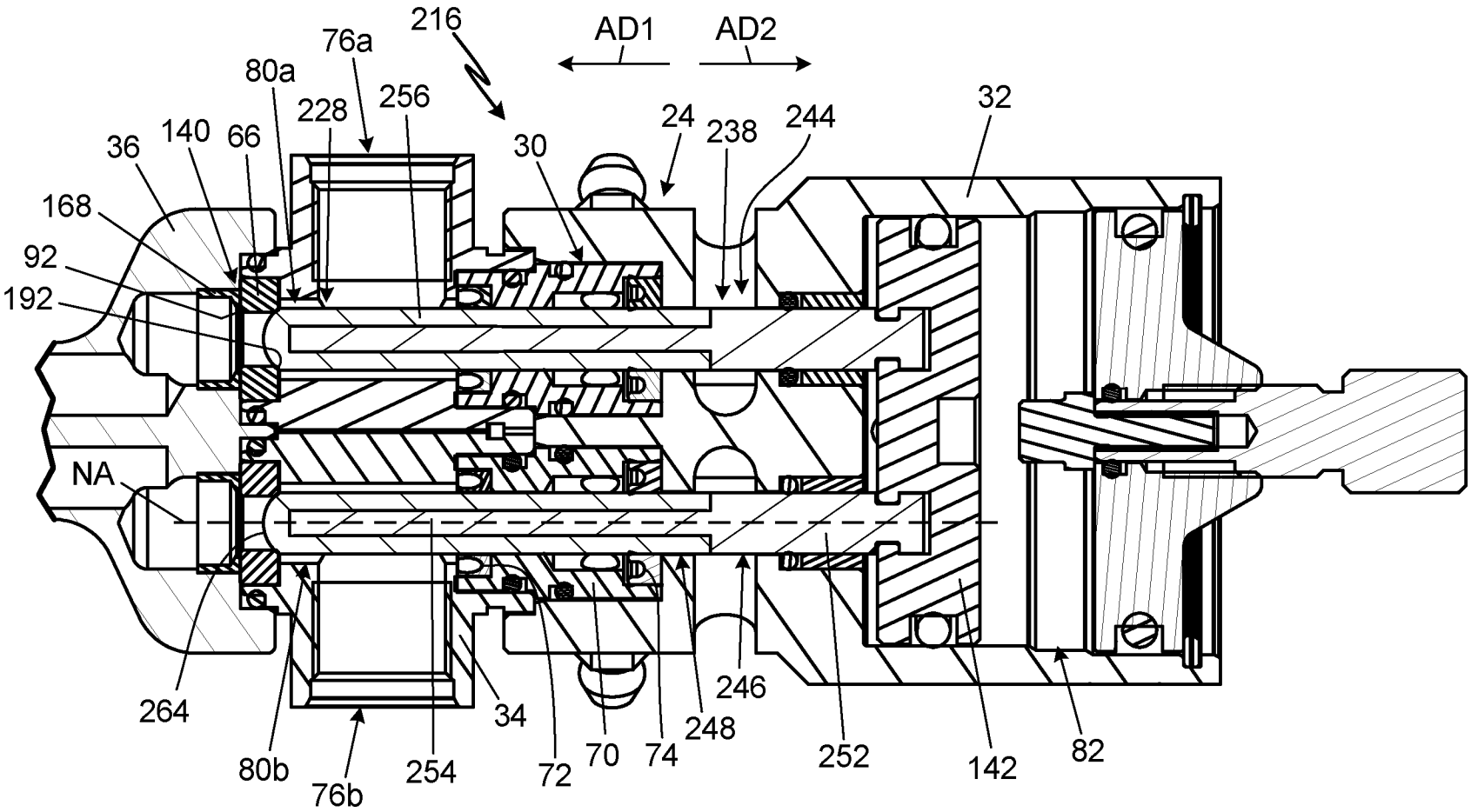
FIG. 5 is a cross-sectional view of an applicator in a holding, non-dispense state.

While needles 144 are shown as unitary structures, it is understood that some examples of needles 144 can include one or more sleeves mounted on the needle body 146, the sleeves forming the smooth exterior surface configured to interface with seat 66 and first seal 72. For example, needle body 146 can be formed with a barrel and stem, similar to needles 44 (best seen in FIGS. 2A and 2B), and a sleeve can be mounted on the stem of the needle body (as shown in FIG. 5).

During operation, control valve 128 is initially in the closed state shown in FIG. 4A. Driving fluid is provided to actuation chamber 182 to drive actuator piston 142 in second axial direction AD2. Actuator piston 142 drives needles 144 in second axial direction AD2 to shift the needles 144 from the closed state shown in FIG. 4A to the fully open state shown in FIG. 4B. The heads 164 of needles 144 disengage from seats 66, opening the flowpaths through applicator 116 and allowing the component materials to flow downstream through applicator body 24 for application.

To stop dispensing of the material, control valve 128 is actuated from the open state shown in FIG. 4B to the closed state shown in FIG. 4A. In the example shown, driving fluid is provided to actuation chamber 82 to drive actuator piston 142 in first axial direction AD1. It is understood, however, that some examples of actuator can be spring actuated or spring assisted such that a spring interfaces with actuator piston 142 to drive actuator piston in the first axial direction AD1. Actuator piston 142 drives needles 144 in first axial direction AD1 from the open state to the closed state. Needles 144 engage with seats 66 to stop flow through applicator 116. More specifically, heads 164 engage with seat lips 192 to stop the flow through applicator 116.

Applicator 116 provides significant advantages. Needles 144 are formed with smooth exterior surfaces that inhibit adhesion of the particulate in the component materials, thereby preventing the particulate from being pulled between the sliding component and an interfacing seal. The particulate being pulled between such components causes accelerated wear and degradation of the components. The smooth exterior surfaces inhibit such migration, providing a more robust applicator 116 having a longer operational life.

The smooth exterior surfaces significantly increase the operating lifespan of applicator 116. In some examples, the sleeved configuration of applicator 16 increased the operational lifespan from about 10,000 cycles and about 13,000 cubic centimeters (cc) dispersed (for a soft, energized seat configuration) to more than 1.77 million cycles and about 2.38 million cc dispersed, a cycle increase of more than 17,600%. In some examples, the sleeved configuration of applicator 16 increased the operational lifespan from about 190,000 cycles and about 250,000 cc dispersed (for a hard, carbide seat configuration) to more than 1.77 million cycles and about 2.38 million cc dispersed, a cycle increase of more than 830%. The smooth exterior surfaces may provide even greater benefits than those discussed as the applicator 116 did not fail during the tests, but instead the testing was stopped for other reasons.

FIG. 5 is a cross-sectional view of applicator 216 in a holding, non-dispense state. Applicator 216 is substantially similar to applicator 16 (best seen in FIGS. 2A and 2B), except that control valve 228 of applicator 216 shifts in first axial direction AD1 from the open state to the closed state and shifts in second axial direction AD2 from the closed state to the open state. Applicator 216 is substantially similar to applicator 116 (FIGS. 4A and 4B), except that needles 244 of applicator 216 includes sleeve assembly 248 mounted on needle body 246. Like components between applicator 216 and applicator 116 are labeled with a reference numeral increased by "100" with reference to applicator 216. Like components between applicator 216 and applicator 16 are labeled with a reference numeral increased by "200" with reference to applicator 216.

Valve member 238 includes needles 244 and actuator piston 142. In the example shown, needle 244 includes needle body 246 and sleeve assembly 248. Needle body 246 includes barrel 252 connected to actuator piston 142 and stem 254 extending axially from needle body 246. Sleeve assembly 248 is formed by sleeve 256. Head 264 is formed at a distal end of sleeve 256. Sleeve assembly 248 is mounted to needle body 246 to form needle 244. For example, sleeve assembly 248 can be fixed to needle body 246 by an adhesive, among other fixation options.

In the example shown, sleeve 256 interfaces with the first seal 72 and second seal 74 of seal cartridge 30 throughout operation. Sleeve 256 interfaces with seat 66 with control valve 228 in the closed state. Sleeve 256 is disengaged from seat 66 with control valve 228 in the open state. More specifically, head 264 of sleeve 256 interfaces with seat lip 192 with control valve 228 in the closed state and head 264 of sleeve 256 is disengaged from seat 66 with control valve 228 in the open state.

The exterior of sleeve 256 is formed as the smooth surface that prevents the abrasive particulate from adhering to the exterior surface. Sleeve 256 protects the needle body 246 from the abrasive particulate in the component materials.

Figure 6A:
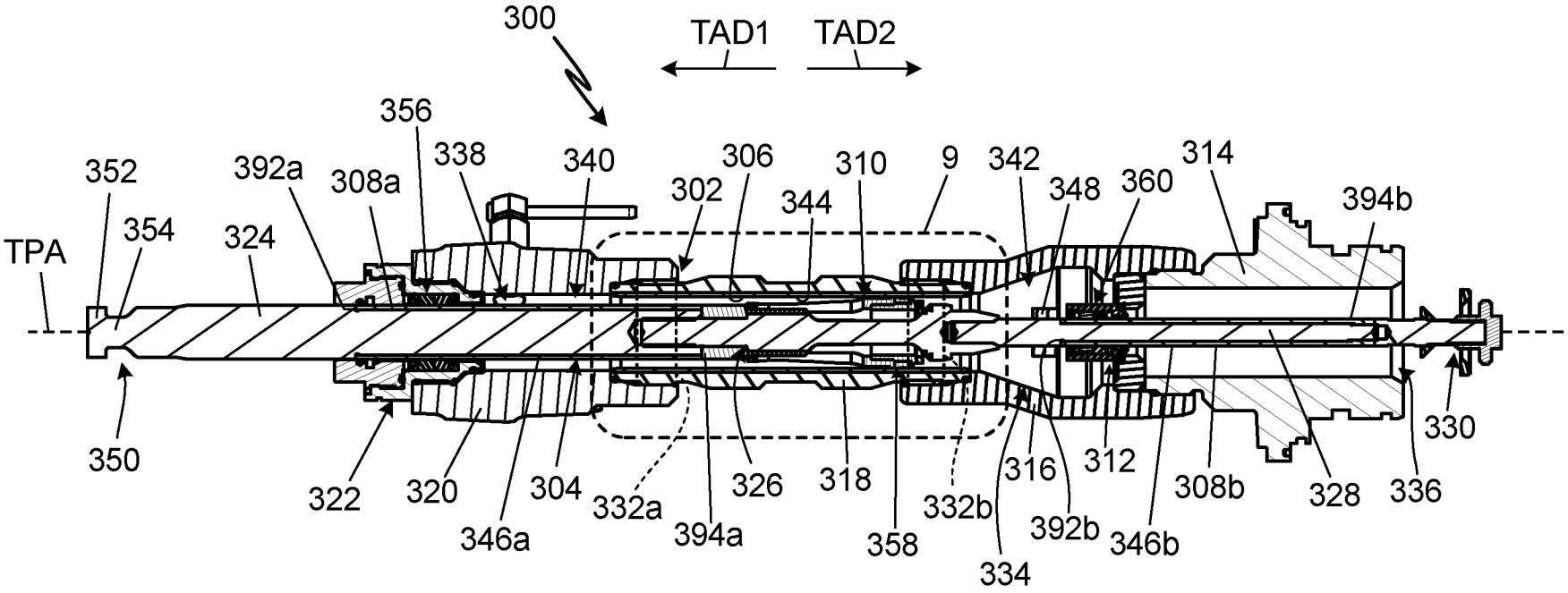
FIG. 6A is a cross-sectional view of a transfer pump in a first state.
Figure 6B:
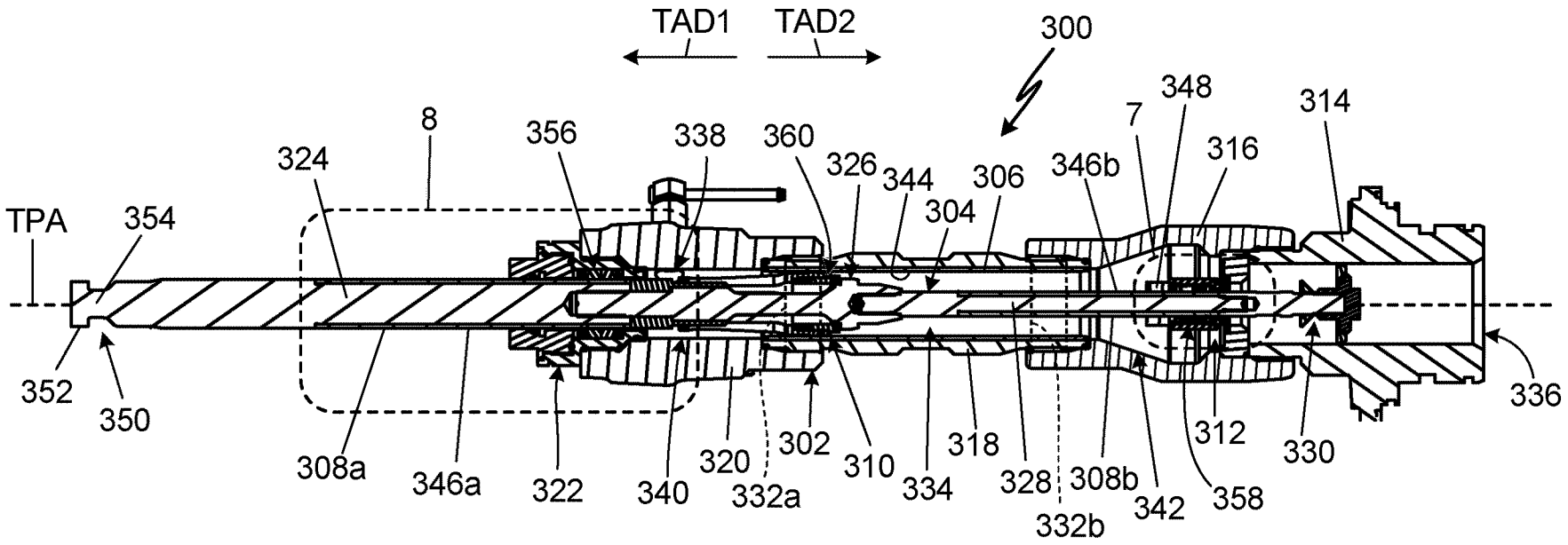
FIG. 6B is a cross-sectional view of the transfer pump in a second state.

FIG. 6A is a first cross-sectional view of transfer pump 300. FIG. 6B is a second cross-sectional view of transfer pump 300. FIGS. 6A and 6B will be discussed together. Transfer pump 300 includes transfer pump body 302, transfer piston 304, cylinder sleeve 306, transfer piston sleeve 308*a*, and transfer piston sleeve 308*b*, piston valve 310, and intake valve 312. Transfer pump body 302 includes inlet housing 314, valve housing 316, transfer pump cylinder 318, outlet housing 320, and throat cartridge 322. Transfer piston 304 includes proximal rod 324, intermediate rod 326, distal rod 328, and scoop assembly 330.

Figure 10A:
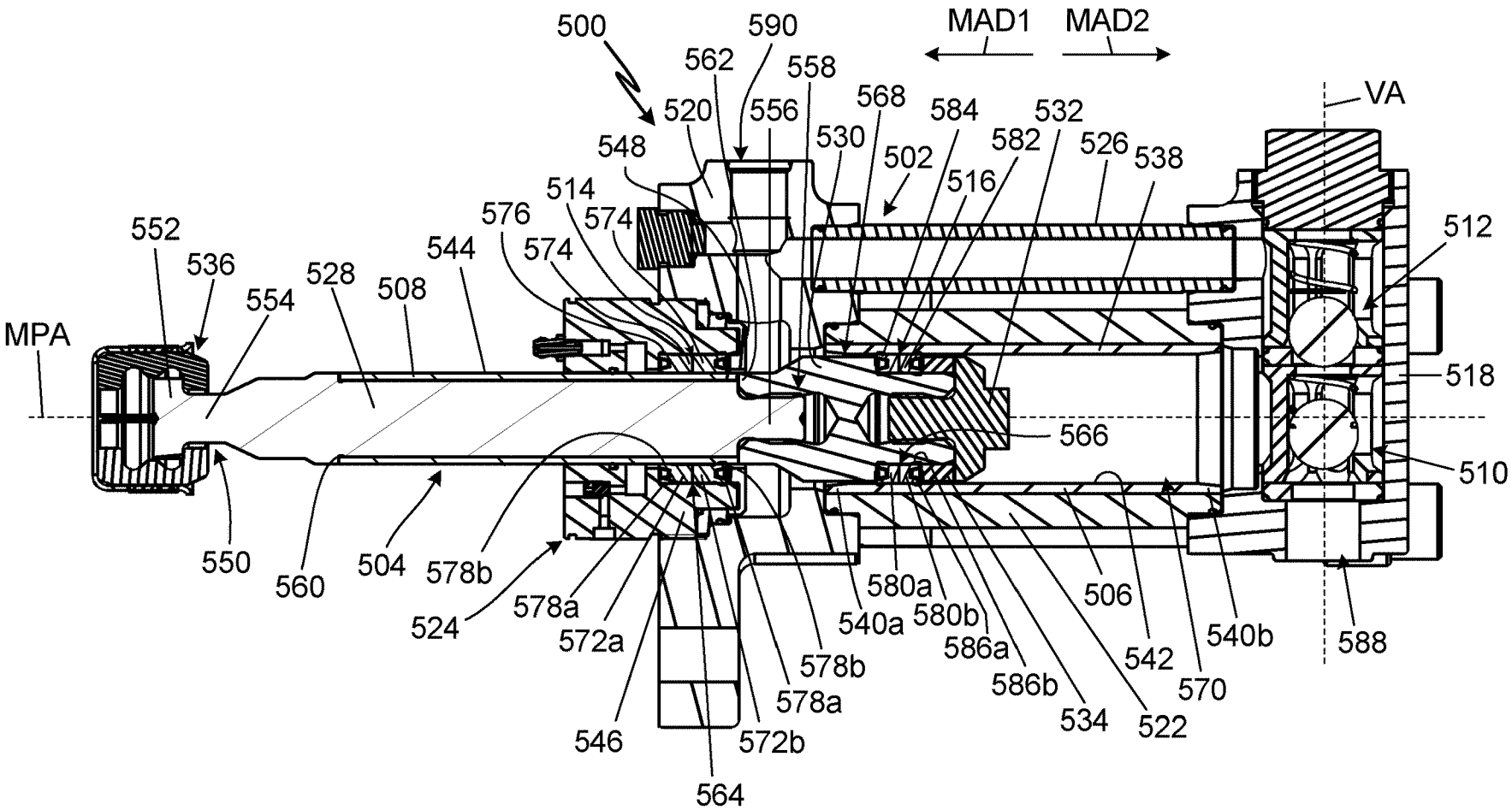
FIG. 10A is a cross-sectional view of a metering pump in a first state.
Figure 10B:
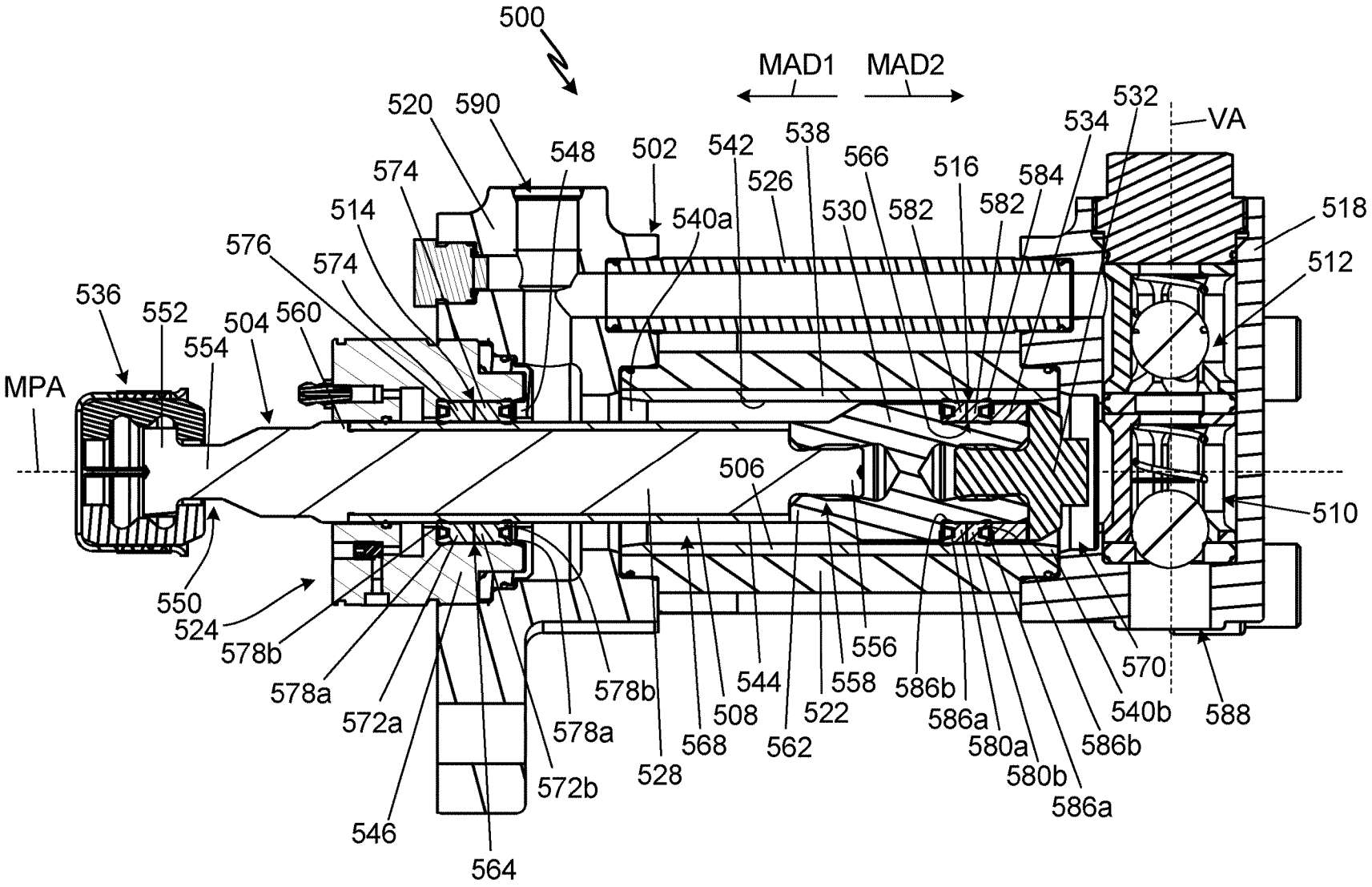
FIG. 10B is a cross-sectional view of the metering pump in a second state.

Transfer pump 300 is configured to draw material from a source, such as a vessel 22*a*, 22*b* (FIG. 1), and drive the material to a downstream location, such as an applicator (e.g., applicator 16 (FIGS. 2A and 2B), applicator 116 (FIGS. 4A and 4B), applicator 216 (FIG. 5) or downstream pump, such as metering pumps 14*a*, 14*b* (FIG. 1) and metering pump 500 (FIGS. 10A and 10B). One or both of transfer pumps 12*a*, 12*b* (FIG. 1) can be formed by transfer pump 300. Transfer pump 300 is configured as a double displacement pump in that transfer pump 300 outputs the material as transfer piston 304 displaced in the first axial direction TPD1 and as transfer piston 304 displaces in the second axial direction TPD2.

Inlet housing 314 is connected to valve housing 316. Transfer pump cylinder 318 is connected to valve housing 316 at an opposite axial end of valve housing 316 from inlet housing 314. Outlet housing 320 is mounted to transfer pump cylinder 318 at an opposite axial end of transfer pump cylinder 318 from valve housing 316. Throat cartridge 322 is mounted to an end of outlet housing 320 opposite transfer pump cylinder 318. Transfer pump cylinder 318 is mounted to valve housing 316 at threaded interface 332*b* and pump cylinder is mounted to outlet housing 320 at threaded interface 332*a*. Transfer pump body 302 defines material flowpath 334 between transfer pump inlet 336 and transfer pump outlet 338. In the example shown, inlet housing 314, valve housing 316, transfer pump cylinder 318, and outlet housing 320 define a flowpath that is coaxial through each of the components of transfer pump body 302. Material flowpath 334 includes a downstream material chamber 340 disposed on a downstream side of piston valve 310 and an upstream material chamber 342 disposed on an upstream side of piston valve 310. More specifically, the upstream material chamber 342 is formed by a portion of the material flowpath between piston valve 310 and intake valve 312.

Cylinder sleeve 306 is mounted within material flowpath 334 to be exposed directly to the pumped material. Cylinder sleeve 306 is disposed radially between portions of transfer piston 304 and the body of transfer pump cylinder 318. A moving valve member of intake valve 312 interfaces with and seals against the inner radial surface 344 of cylinder sleeve 306. Cylinder sleeve 306 is a stationary component of the transfer pump body 302. Transfer piston 304 reciprocates relative to cylinder sleeve 306 and piston valve seal 360 of piston valve 310 interfaces with cylinder sleeve 306 and slides along the inner radial surface 344 and seals with the inner radial surface 344 during reciprocation of transfer piston 304. Inner radial surface 344 can be cylindrical to define a cylindrical portion of material flowpath 334 that is disposed coaxial with pump axis TPA.

Intake valve 312 and piston valve 310 regulate the flow of material through transfer pump body 302. Intake valve 312 is disposed within a material receiving portion of transfer pump body 302 that is formed by intake valve 312 and valve housing 316. Intake valve 312 is configured to actuate between a first, open state (FIG. 6B) and a second, closed state (FIG. 6A). Brace 348 is configured to interface with the valve member of intake valve 312 to limit movement of the valve member in first axial direction TAD1. Piston valve 310 is mounted on transfer pump piston 304. Brace 348 can be formed as a portion of valve housing 316. Piston valve 310 includes a valve member that engages with the transfer pump piston 304 to reciprocate with the transfer pump piston 304 along pump axis TPA. Piston valve 310 is configured to actuate between a first, open state (FIG. 6A) and a second, closed state (FIG. 6B).

Transfer piston 304 is at least partially disposed within transfer pump body 302. Transfer piston 304 is configured to reciprocate along piston axis TPA and relative to transfer pump body 302 during pumping. Transfer piston 304 displacing in first axial direction TPD1 opens intake valve 312, closes piston valve 310, draws material into transfer pump body 302, and displaces material downstream from transfer pump body 302. Transfer piston 304 displacing in second axial direction TPD2 closes intake valve 312, opens piston valve 310, and displaces material downstream from transfer pump body 302.

Proximal rod 324 is connected to a first axial end of intermediate rod 326. Proximal rod 324 extends out of a first end of transfer pump body 302. Proximal rod 324 is configured to connect to a driver that displaces transfer piston 304 axially. Drive connector 350 is disposed at an opposite axial end of proximal rod 324 from intermediate rod 326. Drive connector 350 is disposed at a free axial end of transfer piston 304 and is configured to interface with a driver that drives reciprocation of transfer piston 304. Drive connector 350 includes a transfer piston neck 352 and transfer piston head 354 disposed at a distal end of the transfer piston neck 352. An annular gap is disposed around the transfer piston neck 352 and between the transfer piston head 354 and a body of the proximal rod 324. During operation, a driver (not shown) can engage with both axial sides of transfer piston head 354 to drive reciprocation of transfer piston 304 by such direct engagement.

The valve member of piston valve 310 rides on transfer piston 304. In the example shown, the valve member of piston valve 310 rides on intermediate rod 326. Piston valve seal 360 is supported by the actuating valve member of piston valve 310. Piston valve seal 360 configured to interface with the inner radial surface 344 of cylinder sleeve 306. Distal rod 328 is connected to an opposite end of intermediate rod 326 from proximal rod 324. Distal rod 328 extends through the valve member and seat of intake valve 312. Scoop assembly 330 is disposed at an opposite axial end of distal rod 328 from intermediate rod 326. Scoop assembly 330 is configured to pull material into transfer pump body 302 through transfer pump inlet 336. Scoop assembly 330 is configured to move within the portion of material flowpath 334 defined by inlet housing 314 during reciprocation of transfer piston 304. In the example shown, scoop assembly 330 is disposed at least partially outside of transfer pump body 302 with transfer piston 304 at the end of a second stroke in second axial direction TAD2 (shown in FIG. 6A). More specifically, the portions of scoop assembly 330 that extend radially away from the pump axis TPA are disposed outside of material flowpath 334 and are spaced axially from the distal end of transfer pump body 302 at the end of the second stroke.

Transfer piston sleeves 308*a*, 308*b* are mounted on transfer piston 304 and reciprocate with transfer piston 304. Transfer piston sleeve 308*a* is mounted on proximal rod 324 in a cylindrical recess extending axially between shoulder 392*a* formed by proximal rod 324 and shoulder 394*a* formed by intermediate rod 326. Transfer piston sleeve 308*b* is mounted on distal rod 328 in a cylindrical recess extending axially between shoulder 392*b* formed by distal rod 328 and shoulder 394*b* formed by scoop assembly 330. Transfer piston sleeves 308*a*, 308*b* directly interface with and slide against seals of the transfer pump 300 during reciprocation of transfer piston 304. In the example shown, transfer piston sleeve 308*a* reciprocates relative to and directly engages with throat seal 356 and transfer piston sleeve 308*b* reciprocates relative to and directly engages with intake valve seal 358. Throat seal 356 is a stationary seal that can also be referred to as a throat seal. Throat seal 356 engages with the outer radial surface 346*a* of transfer piston sleeve 308*a*. Intake valve seal 358 is mounted to the valve member of intake valve 312. In the example shown, intake valve seal 358 travels with the moving valve member of intake valve 312 axially along valve axis TPA. As such, intake valve seal 358 can remain stationary relative to transfer piston 304 during a portion of each stroke and transfer piston 304 moves relative to intake valve seal 358 during other portions of each stroke. Intake valve seal 358 engages with the outer radial surface 346*b* of transfer piston sleeve 308*b*.

Transfer piston sleeve 308*a* is disposed in a cylindrical recess extending into the exterior of transfer piston 304. Transfer piston sleeve 308*a* is disposed on proximal rod 324. Transfer piston sleeve 308*a* can be retained on transfer piston 304 by portions of transfer piston 304 interfacing with the axial ends of transfer piston sleeve 308*a*. In the example shown, shoulders formed by proximal rod 324 and intermediate rod 326 interface with the axial ends of transfer piston sleeve 308*a*. While intermediate rod 326 interfaces with transfer piston sleeve 308*a*, intermediate rod 326 does not interface with piston sleeve 308*b*. Transfer piston sleeve 308*b* is disposed in a cylindrical recess extending into the exterior of transfer piston 304. Transfer piston sleeve 308*b* is disposed on distal rod 328. Transfer piston sleeve 308*b* can be retained on transfer piston 304 by portions of transfer piston 304 interfacing with the axial ends of transfer piston sleeve 308*b*. In the example shown, shoulders formed by distal rod 328 and scoop assembly 330 interface with the axial ends of transfer piston sleeve 308*b*.

During operation, transfer piston 304 is reciprocated along pump axis TPA through a first stroke in first axial direction TAD1 and a second stroke in second axial direction TAD2. The first stroke can also be referred to as a suction stroke because additional material is drawn into transfer pump 300 during the first stroke. The second stroke can also be referred to as a pressure stroke. It is understood, however, that transfer pump 300 is configured to output pumped material during both the first stroke and the second stroke.

Transfer piston 304 is shown at the end of the second stroke in FIG. 6A and at the end of the first stroke in FIG. 6B. Transfer piston 304 is driven from the end of the second stroke shown in FIG. 6A in first axial direction TAD1 through a first stroke. Scoop assembly 330 pulls the material into material flowpath 334 through transfer pump inlet 336. The material moving through material flowpath exerts pressure on the intake valve 312 to cause intake valve 312 to actuate to an open state, thereby opening the flowpath through intake valve 312. The material flows through intake valve 312 and into the expanding upstream material chamber 342.

Piston valve 310 shifts to the closed state as transfer piston 304 moves in first axial direction TAD1. Piston valve 310 prevents material in the downstream material chamber 340 from backflowing to the upstream material chamber 342 during the first stroke of transfer piston 304. Material in the downstream material chamber 340 is driven downstream from downstream material chamber 340 and through transfer pump outlet 338. Piston valve seal 360 interfaces with and slides along the inner radial surface 344 of cylinder sleeve 306 during reciprocation of transfer piston 304. Piston valve seal 360 seals against cylinder sleeve 306 to facilitate building pressure within material flowpath 334 and pumping of the abrasive material.

Piston valve 310 is in a closed state and intake valve 312 is in an open state as transfer piston 304 reaches the end of the first stroke. With transfer piston 304 at the end of the first stroke, proximal rod 324 is spaced axially from transfer pump outlet 338 such that no portion of proximal rod 324 radially overlaps with transfer pump outlet 338. Components can be considered to radially overlap when a radial line extending from the axis (pump axis TPA in this example) passes through each of those radially overlapping components. Transfer piston sleeve 308*a* is at least partially disposed outside of transfer pump body 302. Transfer piston sleeve 308*a* is spaced axially from cylinder sleeve 306 such that no portion of transfer piston sleeve 308*a* radially overlaps with cylinder sleeve 306. Transfer piston sleeve 308*a* does not extend through either threaded interface 332*b*, 332*a* with transfer piston 304 at the end of the first stroke. Unlike the proximal rod 324, distal rod 328 extends into the portion of material flowpath 334 defined by transfer pump cylinder 318. Transfer piston sleeve 308*b* interfaces with intake valve seal 358 of intake valve 312 and extends axially into transfer pump cylinder 318. Transfer piston sleeve 308*b* radially overlaps with cylinder sleeve 306 with transfer piston 304 at an end of the first stroke. Transfer piston sleeve 308*b* extends through threaded interface 332*b* such that a portion of transfer piston sleeve 308*b* is disposed on both axial sides of the threaded interface 332*b*.

The driver changes over and drives transfer piston 304 through the second stroke from the position shown in FIG. 6B to the position shown in FIG. 6A. Intake valve 312 actuates from an open state to a closed state to prevent material from backflowing out of the upstream material chamber 342 through intake valve 312. Piston valve 310 actuates to an open state as transfer piston 304 moves in second axial direction TAD2. Piston valve 310 opens to allow material to flow through piston valve 310 and to the downstream material chamber 340 from the upstream material chamber 342 during the second stroke of transfer piston 304. Material in the upstream material chamber 342 is driven downstream to the downstream material chamber 340 and material in the downstream material chamber 340 is driven downstream from downstream material chamber 340 and through transfer pump outlet 338.

As transfer piston 304 reaches an end of the second stroke, piston valve 310 is in an open state and intake valve 312 is in a closed state. Transfer piston sleeve 308*a* can be considered to be fully within transfer pump body 302 as components of transfer pump body 302 radially overlap with the full axial extent of transfer piston sleeve 308*a* with transfer piston 304 at the end of the second stroke. Transfer piston sleeve 308*a* extends axially into the portion of material flowpath 334 defined by cylinder sleeve 306. Transfer piston sleeve 308*a* radially overlaps with cylinder sleeve 306 with transfer piston 304 at an end of the second stroke. Transfer piston sleeve 308*a* extends through threaded interface 332*a* such that a portion of transfer piston sleeve 308*a* is disposed on both axial sides of the threaded interface 332*a*. Transfer piston sleeve 308*a* extends through throat seal 356 such that a portion of transfer piston sleeve 308*a* is disposed on both axial sides of throat seal 356 with transfer piston 304 at the end of the first stroke and with transfer piston 304 at the end of the second stroke. Distal rod 328 does not extend into the portion of material flowpath 334 defined by transfer pump cylinder 318. Transfer piston sleeve 308*b* interfaces with intake valve seal 358 of intake valve 312 and does not extend into transfer pump cylinder 318 such that no portion of transfer piston sleeve 308*b* radially overlaps with cylinder sleeve 306 with transfer piston 304 at the end of the second stroke. Transfer piston sleeve 308*b* does not extend through either threaded interface 332*b*, 332*a* with transfer piston 304 at the end of the second stroke.

During reciprocation, the various sleeves of transfer pump interface with the sliding seals to facilitate pumping by transfer pump 300. The interfaces are dynamic interfaces with relative movement between the interfacing components. Transfer piston sleeve 308*a* interfaces with throat seal 356 and seals at a downstream axial end of the downstream material chamber 340. Transfer piston sleeve 308*b* interfaces with intake valve seal 358 and seals at an upstream axial end of the upstream material chamber 342. Piston valve seal 360 interfaces with cylinder sleeve 306 and the seal therebetween is at an upstream end of the downstream material chamber 340 and a downstream end of the upstream material chamber 342.

The piston sleeves 308*a*, 308*b* are disposed over the metallic portions of transfer piston 304 to protect those components from the highly abrasive component materials. Specifically, piston sleeves 308*a*, 308*b* are disposed at the sliding interfaces along transfer piston 304. Each transfer piston sleeve 308*a*, 308*b* comprises highly polished surface exposed to the abrasive material that reduces or eliminates the microscopic abrasive particles from attaching to the surfaces of the piston sleeves 308*a*, 308*b*. Specifically, the smooth surfaces are formed by the outer radial surfaces 346*a*, 346*b* of piston sleeves 308*a*, 308*b*, respectively. The particulate can attach to blemishes of the sliding surfaces but such attachment is prevented by the smoothness of the surfaces of piston sleeves 308*a*, 308*b*, thus reducing or eliminating wear on the seals and sleeved components.

Cylinder sleeve 306 is disposed over a metallic portion of transfer pump body 302 to protect transfer pump body 302 from the highly abrasive component materials. Specifically, cylinder sleeve 306 is disposed within transfer pump cylinder 318. Cylinder sleeve 306 comprises a highly polished surface exposed to the abrasive material that reduces or eliminates the microscopic abrasive particles from attaching to the surfaces of the cylinder sleeve 306. Specifically, the smooth surface is formed by the inner radial surface 344 of cylinder sleeve 306. The particulate can attach to blemishes of the sliding surfaces but such attachment is prevented by the smoothness of the surface of cylinder sleeve 306, thus reducing or eliminating wear on the seals and sleeved components.

The smoothness of the cylinder sleeve 306 and piston sleeves 308*a*, 308*b* at the sliding interfaces must be maintained over the life of transfer pump 300, so protecting these surfaces is critical. C3 submicron tungsten carbide can be used to form sleeves due to its superior surface finish, but other types of tungsten or ceramic can be utilized as long as a highly polished surface finish can be achieved. The smooth surface finish inhibits adhesion of the abrasive materials on the surfaces of the cylinder sleeve 306 and piston sleeves 308*a*, 308*b*, preventing the abrasive particulate from being pulled under the seal interfacing with the sleeve and between the seal and the sleeve (e.g., between throat seal 356 and transfer piston sleeve 308*a*, between intake valve seal 358 and transfer piston sleeve 308*b*, between piston valve seal 360 and cylinder sleeve 306).

The mean roughness depth (Rz) of the sleeve surfaces exposed to the pumped material and configured to form a dynamic interface with a seal is controlled to provide the smooth surface that prevents adhesion of the abrasive particulate. The Rz can be determined by measuring the vertical distance from the highest peak to the lowest valley within five sampling lengths, then averaging these distances. The Rz averages the five tallest peaks and the five lowest valleys to provide an indication of the smoothness of the surface finish. Typically, a surface finish having an Rz of less than about 0.8 micrometers (μm) (about 31.5 microinches (On)) is required to achieve a mirror finish. The Rz of the surfaces of the one or more sleeves exposed to the pumped material (e.g., inner radial surface 344 of cylinder sleeve 306, outer radial surface 346*a* of piston sleeve 308*a*, outer radial surface 346*b* of piston sleeve 308*b*) can be up to about 0.8 μm (about 31.5 μin). In some examples, the Rz of the sleeve surfaces is up to about 0.3 μm (about 11.8 μin). Some examples of the sleeve surfaces have a Rz of up to about 0.25 μm (about 9.8 μin).

The surface finish can, in some examples, be enhanced by the use of any one of physical vapor deposition (PVD), plasma assisted chemical vapor deposition (PACVD), and chemical vapor deposition (CVD) coatings, which increase the hardness of the surface of the highly polished surface and which can assist in protecting the surface finish. The smooth sleeve surfaces can be formed by tungsten or ceramic and slide against the mating seal surfaces.

Throat seal 356, intake valve seal 358, and piston valve seal 360 are formed from resilient sealing material to further inhibit degradation of components of transfer pump 300. Throat seal 356, intake valve seal 358, and piston valve seal 360 can each be formed from an ultra-high molecular weight (UHMW) polyethylene, among other options, to provide a robust seal resistant to wear by the abrasive particulate in the component materials. As known in the art, UHMW polyethylene is a polymer material, available from a number of manufacturers, with extremely long chains with a molecular mass typically between 3.5 and 7.5 million atomic mass units. In some examples, one or more of throat seal 356, intake valve seal 358, and piston valve seal 360 can be formed from microsphere-filled UHMW. In some examples, one or more of throat seal 356, intake valve seal 358, and piston valve seal 360 are formed from Ceram P® UHMW polyethylene. The material forming and the configurations of throat seal 356, intake valve seal 358, and piston valve seal 360 prevents the abrasive particulate within the component material from migrating between the dynamically interfacing components. The material forming the throat seal 356, intake valve seal 358, and piston valve seal 360 is highly resistant to wear, providing an improved operational life.

Transfer pump 300 provides significant advantages. Piston sleeves 308*a*, 308*b* are formed with smooth exterior surfaces that inhibit adhesion of the particulate in the component materials, thereby preventing the particulate from being pulled between the sliding component and an interfacing seal. Cylinder sleeve 306 is formed with a smooth interior surface that inhibits adhesion of the particulate in the component materials, thereby preventing the particulate from being pulled between the sliding component and an interfacing sleeve. The particulate being pulled between such components can cause accelerated wear and degradation of the components. The smooth sleeve surfaces inhibit such migration, providing a more transfer pump 300 having a longer operational life. Piston sleeves 308*a*, 308*b* are mounted on transfer piston 304 such that if wear is experienced by the piston sleeves 308*a*, 308*b*, the piston sleeves 308*a*, 308*b* can be removed and replaced without requiring replacement of the full transfer piston 304, thereby reducing costs. Throat seal 356, intake valve seal 358, and piston valve seal 360 are formed from material resistant to wear to provide improved seal life and improved operational life for transfer pump 300.

Transfer piston 304 is configured such that piston sleeves 308*a*, 308*b* extend into transfer pump cylinder 318 during operation. Transfer piston sleeve 308*a* can extend through threaded interface 332*a* and transfer piston sleeve 308*b* can extend through threaded interface 332*a*. The overlapping configuration of the piston sleeves 308*a*, 308*b* with the cylinder sleeve 306 provides a compact pump configuration while protecting the components of transfer pump 300 at the dynamic interfaces.

The smooth sleeved surfaces significantly increase the operating lifespan of transfer pump 300. In some examples, the sleeved configuration of transfer pump 300 increased the operational lifespan from about 5,675 cycles and about 1,100 liters (L) pumped to more than 960,000 cycles and about 193,000 L pumped, a cycle and pump volume increase of about 17,000%. The smooth sleeved surfaces may provide even greater benefits than those discussed as the transfer pump 300 did not fail during the tests, but instead the testing was stopped for other reasons.

Figure 7:
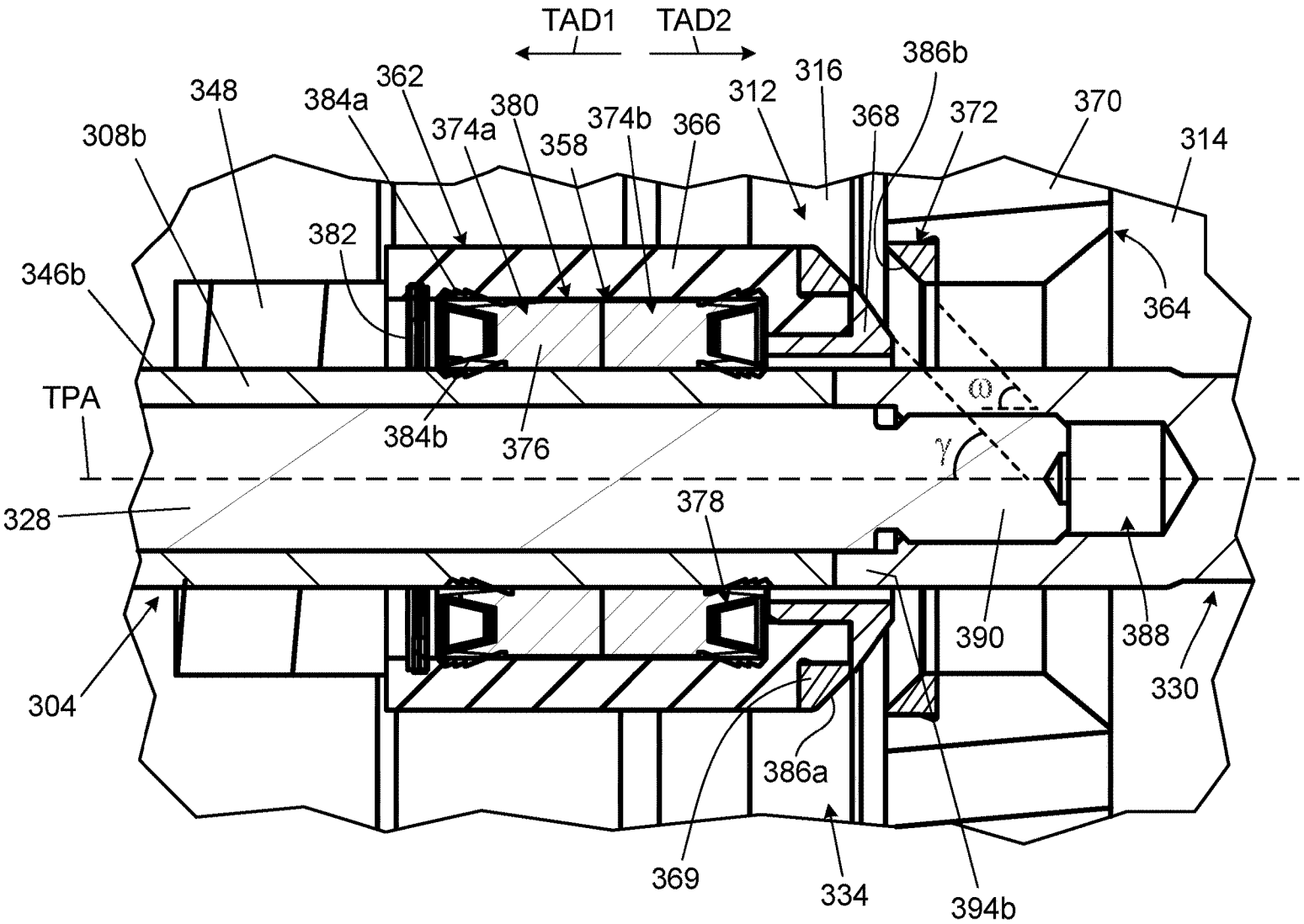
FIG. 7 is an enlarged view of detail 7 in FIG. 6B.

FIG. 7 is an enlarged view of detail 7 in FIG. 6B. Valve housing 316 of transfer pump body 302, intake valve 312, transfer piston 304, and transfer piston sleeve 308*b*. Intake valve 312 includes intake seal assembly 362 and intake seat 364. Intake seal assembly 362 includes intake seal 358, intake seal housing 366, and intake seal cap 368 and intake seal lip 369. Intake seat 364 includes intake seat body 370 and intake seat lip 372. Intake seal 358 includes intake dynamic seals 374*a*, 374*b*. Each intake dynamic seal 374*a*, 374*b* includes a seal body 376 and a seal cup 378.

Intake seal assembly 362 is configured to shift axially along pump axis TPA during actuation of intake valve 312 between the open and closed states. Intake valve 312 is in a closed state with intake seal assembly 362 engaged with intake seat 364. Intake valve 312 is in an open state with intake seal assembly 362 disengaged from intake seat 364. Transfer piston 304 extends through intake seal assembly 362 and intake seat 364. Intake seal assembly 362 engages transfer piston 304 during reciprocation of transfer piston 304 to form a liquid-tight seal between intake seal assembly 362 and transfer piston 304. Intake seal assembly 362 is configured to shift between a first position (FIG. 6B) associated with a fully open state and a second position (FIG. 6A) associated with a fully closed state. Intake seal assembly 362 engages brace 348 in the first position and engages intake seat 364 in the second position.

Intake seal 358 is supported by intake seal housing 366. Intake seal 358 engages with intake seal housing 366 and with transfer piston 304. More specifically, intake seal 358 engages with transfer piston sleeve 308*b* and seals with transfer piston sleeve 308*b* during reciprocation of transfer piston 304. Transfer piston 304 and intake valve 312 are configured such that the only portion of transfer piston 304 that intake seal 358 engages with is the outer radial surface

346*b* of transfer piston sleeve 308*b*. Intake seal 358 engaging only outer radial surface 346*b* protects transfer piston 304 from degradation by preventing abrasive material from being pulled into a dynamic interface between unsleeved portions of transfer piston 304 and intake seal 358. Instead, the dynamic interface at intake seal 358 is formed only between intake seal 358 and transfer piston sleeve 308*b* throughout operation of transfer pump 300.

In the example shown, intake seal 358 is formed from multiple sealing members. Intake dynamic seal 374*a* and intake dynamic seal 374*b* engage with outer radial surface 346*b* of transfer piston sleeve 308*b* to form the liquid-tight sliding interface. Intake dynamic seals 374*a*, 374*b* are disposed within intake seal groove 380 of intake seal housing 366. In the example shown, intake dynamic seals 374*a*, 374*b* are disposed axially between a first shoulder formed by intake seal housing 366 and a second shoulder formed by clip 382 mounted to intake seal housing 366. Intake dynamic seal 374*a* can be configured the same as intake dynamic seal 374*b*, but with intake dynamic seals 374*a*, 374*b* oriented in opposite axial directions when assembled together to form intake seal 358.

Intake dynamic seals 374*a*, 374*b* are configured such that the respective seal cups 378 are oriented axially outward and away from each other. Specifically, seal cup 378 of intake dynamic seal 374*a* is oriented with an open end facing in first axial direction TAD1 and seal cup 378 of intake dynamic seal 374*b* is oriented with an open end facing in second axial direction TAD2. Seal bodies 376 of intake dynamic seals 374*a*, 374*b* abut within the intake seal groove 380 of intake seal housing 366. Seal bodies 376 abut such that the non-cup ends of intake dynamic seals 374*a*, 374*b* interface within intake seal groove 380. Seal bodies 376 abut such that intake dynamic seals 374*a*, 374*b* provide axial support to each other. The seal cups 378 are oriented axially outward.

Intake dynamic seals 374*a*, 374*b* operate together to form the dual-directional seal of intake seal 358. The dual-opposing-seal configuration of intake seal 358 inhibits material migration into the space radially between intake seal 358 and transfer piston sleeve 308*b*. Seal cups 378 are formed as annular cups that can be pressure-assisted to enhance sealing between intake seal 358 and transfer piston sleeve 308*b*. Each seal cup 378 includes a first arm 384*a* and a second arm 384*b*. The arms 384*a*, 384*b* extend both axially and radially from the seal bodies 376. The arms 384*a* extend radially away from the arms 384*b* and into engagement with intake seal housing 366. The arms 384*b* extend radially away from the arms 384*a* and into engagement with transfer piston sleeve 308*b*. Arms 384*a*, 384*b* are formed as annular extensions from seal bodies 376 that extend fully around transfer piston 304. In the example shown, each intake dynamic seal 374 is formed as a multi-lip seal. The multi-lip seal is configured such that multiple annular lips are formed on each arm 384*a*, 384*b* and engage the sealed surface. In some examples, each arm 384*a*, 384*b* can be formed by multiple annular rings that are stacked axially. Specifically, the intake dynamic seals 374*a*, 374*b* are formed as triple lip seals in the example shown.

Intake dynamic seals 374*a*, 374*b* can be formed from an ultra-high molecular weight (UHMW) polyethylene, among other options, to provide a robust seal resistant to wear by the abrasive particulate in the component materials. As known in the art, UHMW polyethylene is a polymer material, available from a number of manufacturers, with extremely long chains with a molecular mass typically between 3.5 and 7.5 million atomic mass units. In some examples, intake dynamic seals 374*a*, 374*b* can be formed from microsphere-filled UHMW. In some examples, intake dynamic seals 374*a*, 374*b* are formed from Ceram P® UHMW polyethylene. The material forming intake dynamic seals 374*a*, 374*b* and the cup configurations of intake dynamic seals 374*a*, 374*b* prevent the abrasive particulate within the component material from migrating between intake seal 358 and transfer piston 304. The material forming intake dynamic seals 374*a*, 374*b* is highly resistant to wear providing an improved operational life.

Intake seal cap 368 is mounted to intake seal housing 366. Intake seal lip 369 mounted to intake seal housing 366. Intake seal cap 368 can extends over an axial end of intake seal lip 369 to retain intake seal lip 369 on intake seal housing 366. Intake seal lip 369 is formed from a resilient material, as intake seal lip 369 is configured to directly engage with and disengage from intake seat 364 during operation. For example, intake seal lip 369 can be formed from tungsten carbide, among other resilient material options. Intake seal cap 368 is mounted such that an annular gap is formed between intake seal cap 368 and transfer piston 304 during reciprocation of transfer piston 304. Intake seal cap 368 does not directly contact transfer piston sleeve 308*b* during reciprocation of transfer piston 304. Intake seal cap 368 is disposed at an axial end of intake seal housing 366 and extends over an inner radial side of intake seal housing 366. An annular axial projection of intake seal housing 366 is disposed radially between portions of the intake seal cap 368 and intake seal lip 369. During at least a portion of the stroke of transfer piston 304, a radial line extending from pump axis TPA extends through the body of transfer piston 304, second transfer piston sleeve 308*b*, intake seal cap 368, intake seal housing 366, and then intake seal lip 369. Contact surface 386*a* of intake seal lip 369 is sloped such that contact surface 386*a* is transverse to the pump axis TPA. Intake seal lip 369 is frustoconical in the example shown. Contact surface 386*a* extends annularly about pump axis TPA and can be considered to form a sloped ring surface. In the example shown, contact surface 386*a* is disposed at angle $\gamma$ relative to pump axis TPA. Contact surface 386*a* is formed on an outer radial side of intake seal lip 369.

Intake seat 364 is supported by transfer pump body 302. Specifically, intake seat body 370 is mounted at an interface between valve housing 316 and inlet housing 314, shown in FIGS. 6A and 6B. Intake seat lip 372 is supported by intake seat body 370. Intake seat lip 372 is formed from resilient material to facilitate mating with intake seat lip 372 during operation of intake valve 312. Intake seat lip 372 is formed from a resilient material, as intake seat lip 372 is configured to directly engage with and disengage from intake seal lip 369 during operation. For example, intake seat lip 372 can be formed from tungsten carbide, among other resilient material options. Contact surface 386*b* of intake seat lip 372 is sloped such that contact surface 386*b* is transverse to the pump axis TPA. Intake seat lip 372 is frustoconical in the example shown. Contact surface 386*b* extends annularly about pump axis TPA and can be considered to form a sloped ring surface. In the example shown, contact surface 386*b* is disposed at angle $\omega$ relative to pump axis TPA. Contact surface 386*b* is formed on an inner radial side of intake seat lip 372.

Intake seal lip 369 is sloped at angle $\gamma$ to mate with intake seat lip 372 that is sloped at angle $\omega$. Angle $\gamma$ of intake seal lip 369 can be the same as the angle $\omega$ of intake seat lip 372 to facilitate mating therebetween. In the example shown, intake seat lip 372 and intake seal lip 369 are formed at respective 45-degree angles. It is understood, however, that intake seat lip 372 and intake seal lip 369 can be formed at other acute angles, such as 30-degrees, 60-degrees or another acute angle. For example, intake seat lip 372 can be formed at 40-degrees and intake seal lip 369 can be formed at 50-degrees to facilitate mating therebetween.

Transfer piston 304 extends through brace 348, intake seal assembly 362, and intake seat 364 during operation of transfer pump 300 and throughout operation of transfer pump 300. Intake seal assembly 362 can be considered to ride on transfer piston 304 due to engagement of intake seal 358 and transfer piston sleeve 308*b*. Intake seal 358 directly engages with the outer radial surface 346*b* of transfer piston sleeve 308*b* and can travel with transfer piston 304 and slide on the outer radial surface 346*b* during relative movement between transfer piston 304 and intake seal assembly 362.

Scoop assembly 330 is mounted to distal rod 328. Specifically, bore 388 within the rod portion of scoop assembly 330 receives projection 390 of distal rod 328. In the example shown, the bore 388 and projection 390 are threaded to form a threaded interface connecting scoop assembly 330 and distal rod 328. Projection 390 can also be referred to as a shank.

Transfer piston sleeve 308*b* is disposed around the body of transfer piston 304. Specifically, transfer piston sleeve 308*b* is disposed around the body of distal rod 328. Transfer piston sleeve 308*b* is disposed in a cylindrical recess extending into the exterior of transfer piston 304. Transfer piston sleeve 308*b* is disposed on distal rod 328*b*. A first axial end of transfer piston sleeve 308*b* interfaces with first shoulder 392*b* (FIGS. 6A and 6B) and a second axial end of transfer piston sleeve 308*b* interfaces with second shoulder 394*b*. First shoulder 392*b* and second shoulder 394*b* define the axial ends of the cylindrical recess. Transfer piston sleeve 308*b* can be formed and mounted to distal rod 328 such that the exterior of the sleeved portion of the body of the distal rod 328 has the same diameter as the exterior of the unsleeved portion of the body of the distal rod 328. In the example shown, first shoulder 392*b* is formed by distal rod 328 and second shoulder 394*b* is formed by scoop assembly 330. Transfer piston sleeve 308*b* can be compressed between first shoulder 392*b* and second shoulder 394*b* during mounting of scoop assembly 330 to distal rod 328 to provide a tight fit, preventing undesired movement of transfer piston sleeve 308*b*. The tight fit inhibits migration of abrasive particulate into the interface between transfer piston sleeve 308*b* and the body of distal rod 328. In some examples, transfer piston sleeve 308*b* can be fixed to distal rod 328 by an adhesive. Second shoulder 394*b* is shown as interfacing with the axial end of transfer piston sleeve 308*b*. Second shoulder 394*b* is formed by the rod portion of scoop assembly 330 such that the position of second shoulder 394*b* can move axially along pump axis TPA relative to distal rod 328 to adjust a compressive load exerted on transfer piston sleeve 308*b*.

During operation, intake valve 312 is actuated between the open state and the closed state. With intake valve 312 in the closed state, intake seal lip 369 engages with intake seat lip 372 to seal the portion of material flowpath 334 through intake valve 312. Transfer piston 304 is at the end of a stroke in second axial direction TAD2 and begins the first stroke in the first axial direction TAD1. Transfer piston 304 shifts in first axial direction TAD1 and intake seal assembly 362 shifts from the position associated with the closed state of intake valve 312 to the position associated with the open state of intake valve 312, which open state is shown in FIG. 7. Brace 348 engages with an axial end of intake seal assembly 362 opposite intake seal lip 369 to limit axial displacement of intake seal assembly 362.

Intake seal assembly 362 is actuated to the position associated with the open state by the pressure generated upstream of intake valve 312 as transfer piston 304 moves through the first stroke. In some examples, friction between transfer piston sleeve 308*b* and intake seal 358 can cause transfer piston 304 to carry intake seal assembly 362 in first axial direction TAD1 during at least a portion of the axial displacement of intake seal assembly 362. Transfer piston 304 can cause displacement of intake seal assembly 362 during operation of transfer pump 300 by transfer piston 304 carrying intake seal assembly 362 due to engagement between transfer piston sleeve 308*b* and intake seal 358. Axial displacement of intake seal assembly 362 is limited by brace 348. With intake seal assembly 362 engaging brace 348, transfer piston 304 continues to move axially relative to intake seal assembly 362. Intake seal 358 maintains engagement with transfer piston sleeve 308*b* at a sliding interface that prevents migration of the abrasive particulate between intake seal 358 and transfer piston sleeve 308*b*.

Transfer piston sleeve 308*b* is the portion of transfer piston 304 that contacts with and slides against intake seal 358. The smoothness of transfer piston sleeve 308*b*, as discussed above, prevents the abrasive particulate from adhering on transfer piston sleeve 308*b* and being pulled radially between intake seal 358 and transfer piston 304. Transfer piston sleeve 308*b* is also formed from a harder, more resilient material than distal rod 328. The resilient transfer piston sleeve 308*b* provides a resilient substrate for the intake seal 358 to seal against. Deterioration of the substrate and degradation of the seal sliding relative to the substrate can be caused by abrasive particulate being pulled under the seal and between the seal and substrate. Transfer piston sleeve 308*b* inhibits deterioration by having the smooth exterior surface and by being formed from resilient material, such as C3 tungsten carbide, among other material options.

Mounting transfer piston sleeve 308*b* on transfer piston 304 prevents the body of transfer piston 304 from directly experiencing degradation due to the sliding seal interface. Transfer piston sleeve 308*b* being formed separately from and mounted on transfer piston 304 provides material and cost savings as transfer piston sleeve 308*b* can be formed form a more resilient and costly material while distal rod 328 is formed from a less costly material, such as stainless steel. Transfer piston 304 and intake seal assembly 362 are configured such that intake seal 358 engages only second transfer piston sleeve 308*b* during operation of transfer pump 300.

The dual cup configuration of intake seal 358 further protects transfer pump 300 during operation. The intake dynamic seals 374*a*, 374*b* are configured with annular seal cups 378 that can flex to maintain engagement with transfer piston sleeve 308*b* and prevent migration of the adhesive material between intake seal 358 and transfer piston sleeve 308*b*. The dual intake dynamic seals 374*a*, 374*b* facilitate simple assembly of intake seal assembly 362 as only two seal components are utilized in the configuration of intake seal assembly 362 shown. Intake dynamic seals 374*a*, 374*b* are formed from resilient sealing material that provides robust sealing that is resistant to wear by the abrasive particulate in the component materials.

After completing the first stroke, transfer piston 304 changes over and moves through the second stroke in second axial direction TAD2. Transfer piston 304 moves through second axial direction TAD2 in the second stroke and intake valve 312 shifts from the open state to the closed state. Intake seal assembly 362 shifts in second axial direction TAD2 until intake seal lip 369 engages with intake seat lip 372 to place intake valve 312 in the closed state. Transfer piston 304 continues to shift in second axial direction TAD2 with intake valve 312 in the closed state such that transfer piston sleeve 308*b* slides relative to intake seal 358 until transfer piston 304 reaches the end of the second stroke.

Transfer pump 300 provides significant advantages. Intake seal assembly 362 is configured to form a first seal interface with intake seat 364 with intake valve 312 in the closed state, and intake seal assembly 362 is configured to form a second seal interface with transfer piston 304 throughout operation. The second seal interface can have no relative movement during portions of the stroke, such as at turnover and during at least a portion of each stroke between the changeover points. The second seal interface has relative movement between transfer piston 304 and intake seal 358 during at least a portion of each of the first stroke and the second stroke. The smooth exterior surface of transfer piston sleeve 308*b* inhibits migration of the abrasive particulate between transfer piston sleeve 308*b* and intake seal 358, providing a more robust pump and increasing the operational life of the pumping components. Intake dynamic seals 374*a*, 374*b* effectively seal against both upstream and downstream pressures. The seal cups 378 are formed as multi-lip seals that further inhibit migration of the abrasive particulate.

Figure 8:
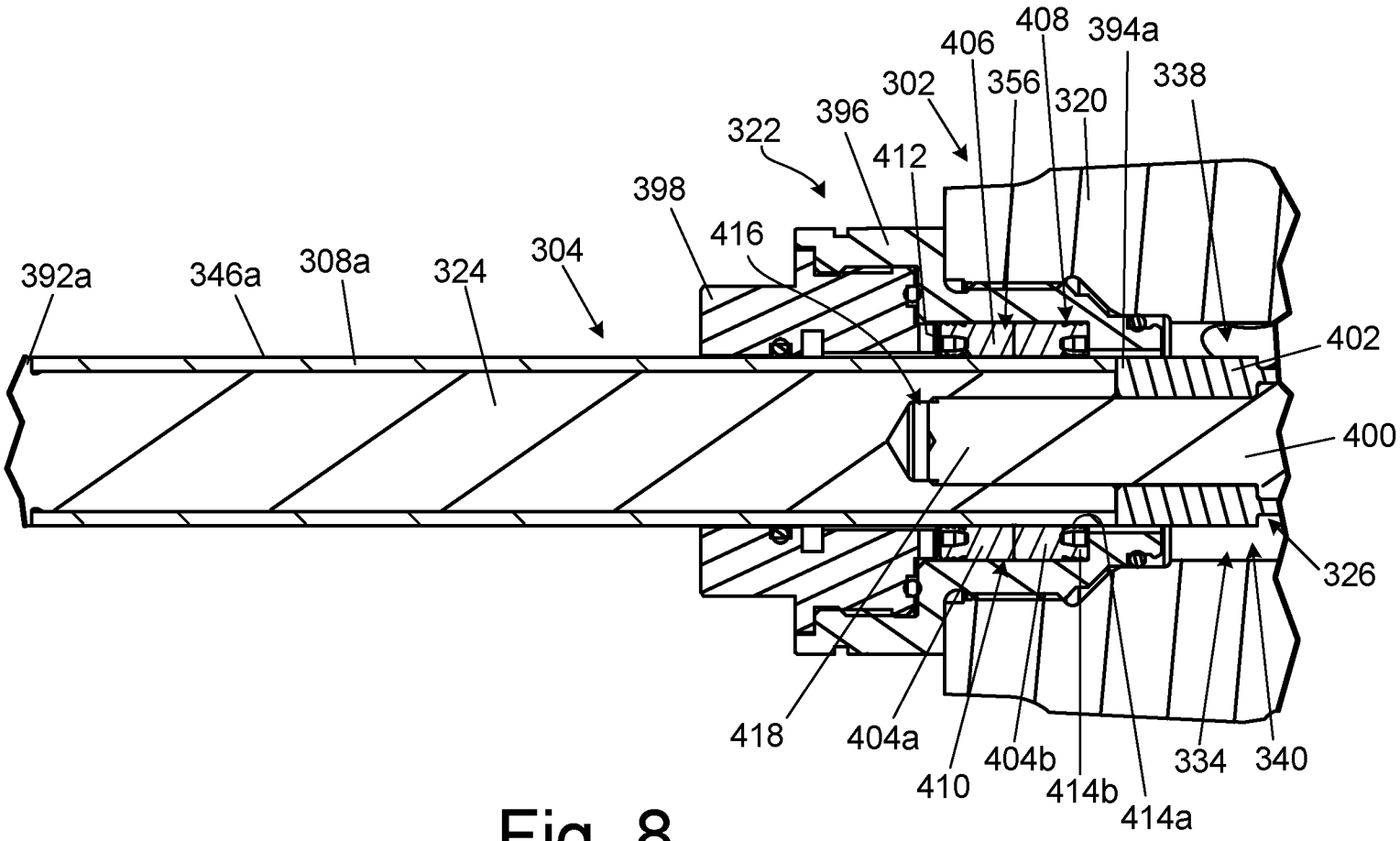
FIG. 8 is an enlarged view of detail 8 in FIG. 6B.

FIG. 8 is an enlarged view of detail 8 in FIG. 6B. Outlet housing 320, throat cartridge 322, transfer piston 304, transfer piston sleeve 308*a*, and throat seal 356 of transfer pump 300 are shown. Throat cartridge 322 includes cartridge body 396 and cartridge cap 398. Proximal rod 324 and intermediate rod 326 of transfer piston 304 are shown. Rod body 400 and a portion of guide body 402 of intermediate rod 326 are shown. Throat seal 356 includes throat dynamic seal 404*a* and throat dynamic seal 404*b*. Each throat dynamic seal 404*a*, 404*b* includes a seal body 406 and a seal cup 408.

Transfer pump outlet 338 extends through outlet housing 320 and provides a flowpath for the pumped material to exit from transfer pump body 302. Throat cartridge 322 is mounted to outlet housing 320. Throat cartridge 322 is mounted to outlet housing 320 on an opposite axial side of transfer pump outlet 338 from the transfer pump inlet 336 (FIGS. 6A and 6B). Cartridge body 396 is mounted to outlet housing 320. For example, cartridge body 396 can be threadedly engaged with outlet housing 320. Cartridge cap 398 is mounted to cartridge body 396, such as by interfaced threading, among other options.

Throat seal 356 engages with transfer piston 304 throughout reciprocation of transfer piston 304. Throat seal 356 can be considered to define an axial end of the material flowpath 334 through transfer pump 300. Throat seal 356 is configured to prevent material from leaking out of transfer pump 300 at the dynamic interface between transfer piston 304 and non-moving components. In the example shown, throat seal 356 is disposed within throat seal groove 410 within throat cartridge 322. In the example shown, the throat seal groove 410 is at least partially defined by cartridge body 396. A shoulder is integrally formed by the body of cartridge body 396 at the axial end of throat seal groove 410 in second axial direction TAD2, which shoulder engages with throat seal 356 to retain throat seal 356. In the example shown, a clip 412 is disposed at an opposite axial end of throat seal 356 from the shoulder, which clip 412 axially retains throat seal 356.

In the example shown, throat seal 356 is a multi-component seal that interfaces with transfer piston sleeve 308*a*. Throat seal 356 interfaces with transfer piston sleeve 308*a* throughout operation and during reciprocation of transfer piston 304. Throat seal 356 directly engages with transfer piston sleeve 308*a*. Throat seal 356 and transfer piston sleeve 308*a* mate at a sliding sealed interface to prevent migration of the pumped material out of transfer pump 300 through that sliding interface. Throat dynamic seal 404*a* and throat dynamic seal 404*b* abut each other and interface with transfer piston sleeve 308*a*.

Transfer piston 304 and throat seal 356 are configured such that the only portion of transfer piston 304 that throat seal 356 engages with is the outer radial surface 346*a* of transfer piston sleeve 308*a*. In the example shown, throat seal 356 is formed from multiple sealing members. Throat dynamic seal 404*a* and throat dynamic seal 404*b* engage with outer radial surface 346*a* of transfer piston sleeve 308*a* to form the liquid-tight sliding interface. Throat dynamic seals 404*a*, 404*b* are configured such that the respective first seal cups 408 are oriented axially outward and away from each other. Specifically, the seal cup 408 of throat dynamic seal 404*a* is oriented with an open end facing in first axial direction TAD1 and the seal cup 408 of throat dynamic seal 404*b* is oriented with an open end facing in second axial direction TAD2. Seal bodies 406 of throat dynamic seals 404*a*, 404*b* abut within the throat seal groove 410 of throat cartridge 322. Seal bodies 406 abut such that first throat dynamic seals 404*a*, 404*b* provide axial support to each other. The seal cups 408 are oriented axially outward. Throat dynamic seal 404*a* can be configured the same as throat dynamic seal 404*b*, but with throat dynamic seals 404*a*, 404*b* oriented in opposite axial directions when assembled together to form throat seal 356. It is further understood that throat dynamic seals 404*a*, 404*b* can be the same configuration as intake dynamic seals 374*a*, 374*b* (FIG. 7).

Seal cups 408 are formed as annular cups that can be pressure-assisted to enhance sealing between throat seal 356 and transfer piston sleeve 308*ac*. Each seal cup 408 includes a first arm 414*a* and a second arm 414*b*. The arms 414*a*, 414*b* extend both axially and radially from the seal bodies 406. The arms 414*a* extend radially away from the arms 414*b* and into engagement with cartridge body 396. The arms 414*b* extend radially away from the arms 414*a* and into engagement with transfer piston sleeve 308*a*. Arms 414*a*, 414*b* are formed as annular extensions from seal bodies 406 that extend fully around transfer piston 304. In the example shown, each throat dynamic seal 404 is formed as a multi-lip seal. The multi-lip seal is configured such that one or more annular lips extend from each arm 414*a*, 414*b* and into engagement with the opposing seal surface, formed by transfer piston sleeve 308*a* for arm 414*b* and cartridge body 396*b* for arm 414*a*. The lips extend radially into engagement with the opposing seal surface. In the example shown, throat dynamic seals 404*a*, 404*b* include multiple lips formed on each arm 414*a*, 414*b*. Specifically, the throat dynamic seals 404*a*, 404*b* are formed as triple lip seals in the example shown.

While throat seal 356 is shown as including dual throat dynamic seals 404 that include oppositely oriented seal cups 408, it is understood that throat seal 356 can be configured with a single seal cup 408 oriented towards material flowpath 334. For example, throat seal 356 can be formed as a single component seal having a single seal cup 408 facing in second axial direction TAD2. In some examples, throat seal 356 can be configured as a multi-component seal that includes throat dynamic seal 404*a* formed as a block, similar to a seal body 406, and throat dynamic seal 404*b* formed with a seal cup 408 as shown. Throat dynamic seal 404*a* can engage with transfer piston 304 to inhibit migration but may not include a seal cup as the seal cup 408 of throat dynamic seal 404*a* is not exposed to the pressurized material chamber 340.

Throat dynamic seals 404*a*, 404*b* can be formed from an ultra-high molecular weight (UHMW) polyethylene, among other options, to provide a robust seal resistant to wear by the abrasive particulate in the component materials. As known in the art, UHMW polyethylene is a polymer material, available from a number of manufacturers, with extremely long chains with a molecular mass typically between 3.5 and 7.5 million atomic mass units. In some examples, throat dynamic seals 404*a*, 404*b* can be formed from microsphere-filled UHMW. In some examples, throat dynamic seals 404*a*, 404*b* are formed from Ceram P® UHMW polyethylene. The material forming throat dynamic seals 404*a*, 404*b* and the cup configurations of throat dynamic seals 404*a*, 404*b* prevent the abrasive particulate within the component material from migrating between throat seal 356 and transfer piston 304. The material forming throat dynamic seals 404*a*, 404*b* is highly resistant to wear providing an improved operational life.

Transfer piston 304 reciprocates relative to throat seal 356 and engages with throat seal 356. Proximal rod 324 extends out of transfer pump body 302 through throat seal 356 and throat cartridge 322 to connect to a driver (not shown). The driver drives reciprocation of transfer piston 304 to pump the material. Intermediate rod 326 is connected to an axial end of proximal rod 324 opposite the end connected to the driver. In the example shown, intermediate rod 326 is formed by rod body 400 that connects to both proximal rod 324 and distal rod 328 and by guide body 402 that mounts on rod body 400. As discussed in more detail below, guide body 402 interfaces with a guide sleeve to facilitate operation of the piston valve 310.

The intermediate rod 326 connects to the proximal rod 324 by an interface between the rod body 400 and the body of proximal rod 324. Specifically, a bore 416 within proximal rod 324 receives a projection 418 extending axially from rod body 400. Projection 418 can also be referred to as a shank. In the example shown, the bore 416 and projection 418 are threaded to form a threaded interface connecting intermediate rod 326 and proximal rod 324. Transfer piston sleeve 308*a* is disposed around the body of transfer piston 304. Specifically, transfer piston sleeve 308*a* is disposed around the body of proximal rod 324.

Transfer piston sleeve 308*a* is disposed in a cylindrical recess extending into the exterior of transfer piston 304. Transfer piston sleeve 308*a* is disposed on proximal rod 324. A first axial end of transfer piston sleeve 308*a* interfaces with first shoulder 392*a* and a second axial end of transfer piston sleeve 308*a* interfaces with second shoulder 394*a*. First shoulder 392*a* and second shoulder 394*a* define the axial ends of the cylindrical recess. Transfer piston sleeve 308*a* is mounted to proximal rod 324 such that the exterior of the sleeved portion of the body of the proximal rod 324 has the same diameter as the exterior of the unsleeved portion of the body of the proximal rod 324. In the example shown, first shoulder 392*a* is formed by an integral portion of proximal rod 324 and second shoulder 394*a* is formed by guide body 402 of intermediate rod 326. Transfer piston sleeve 308*a* can be compressed between first shoulder 392*a* and second shoulder 394*a* during mounting of intermediate rod 326 provide a tight fit, preventing undesired movement of transfer piston sleeve 308*a*. The compression preloads transfer piston sleeve 308*a* to facilitate forming the tight fit that inhibits migration of abrasive particulate into the interface between transfer piston sleeve 308*a* and throat seal 356. In some examples, transfer piston sleeve 308*a* can be fixed to proximal rod 324 by an adhesive.

During operation, transfer piston 304 reciprocates relative to throat seal 356. A sliding seal interface is formed between transfer piston 304 and throat seal 356. Throat seal 356 engages with transfer piston sleeve 308*a* throughout reciprocation of transfer piston 304 to form the dynamic sealing interface between transfer piston 304 and throat seal 356. Transfer piston sleeve 308*a* is the portion of transfer piston 304 that contacts with and slides against throat seal 356. The smoothness of transfer piston sleeve 308*a* prevents the abrasive particulate from adhering on transfer piston sleeve 308*a* and being pulled radially between throat seal 356 and transfer piston 304. Transfer piston sleeve 308*a* is also formed from a harder, more resilient material than proximal rod 324. The resilient transfer piston sleeve 308*a* provides a resilient substrate for the throat seal 356 to seal against. Abrasive particulate entering into the dynamic interface can cause deterioration of the substrate and degradation of the seal sliding relative to the substrate. Transfer piston sleeve 308*a* inhibits deterioration by having the smooth exterior surface that prevents adhesion of the abrasive particulate on transfer piston sleeve 308*a* and inhibits deterioration by being formed from resilient material. For example, transfer piston sleeve 308*a* can be formed by C3 tungsten carbide, among other material options, while proximal rod 324 can be formed by stainless steel.

Mounting transfer piston sleeve 308*a* on transfer piston 304 prevents the body of transfer piston 304 from directly experiencing degradation due to abrasive particulate being trapped in the sliding seal interface. Transfer piston sleeve 308*a* being formed separately from and mounted on transfer piston 304 provides material and cost savings as transfer piston sleeve 308*a* can be formed form a more resilient and costly material while proximal rod 324 is formed from a less costly material. Transfer piston 304 and transfer pump 300 are configured such that transfer piston sleeve 308*a* is the only portion of transfer piston 304 that throat seal 356 engages during operation.

The cup configuration of throat seal 356 further protects transfer pump 300 during operation. The annular seal cup 408 can flex to maintain engagement with transfer piston sleeve 308*a* and prevent migration of the adhesive material between throat seal 356 and transfer piston sleeve 308*a*. The dual throat dynamic seals 404*a*, 404*b* facilitate simple assembly of throat seal 356 as only two seal components are utilized in the configuration of throat seal 356 shown. Throat dynamic seals 404*a*, 404*b* are formed from resilient sealing material that provides robust sealing and that is resistant to wear by the abrasive particulate in the pumped component materials.

Figure 9:
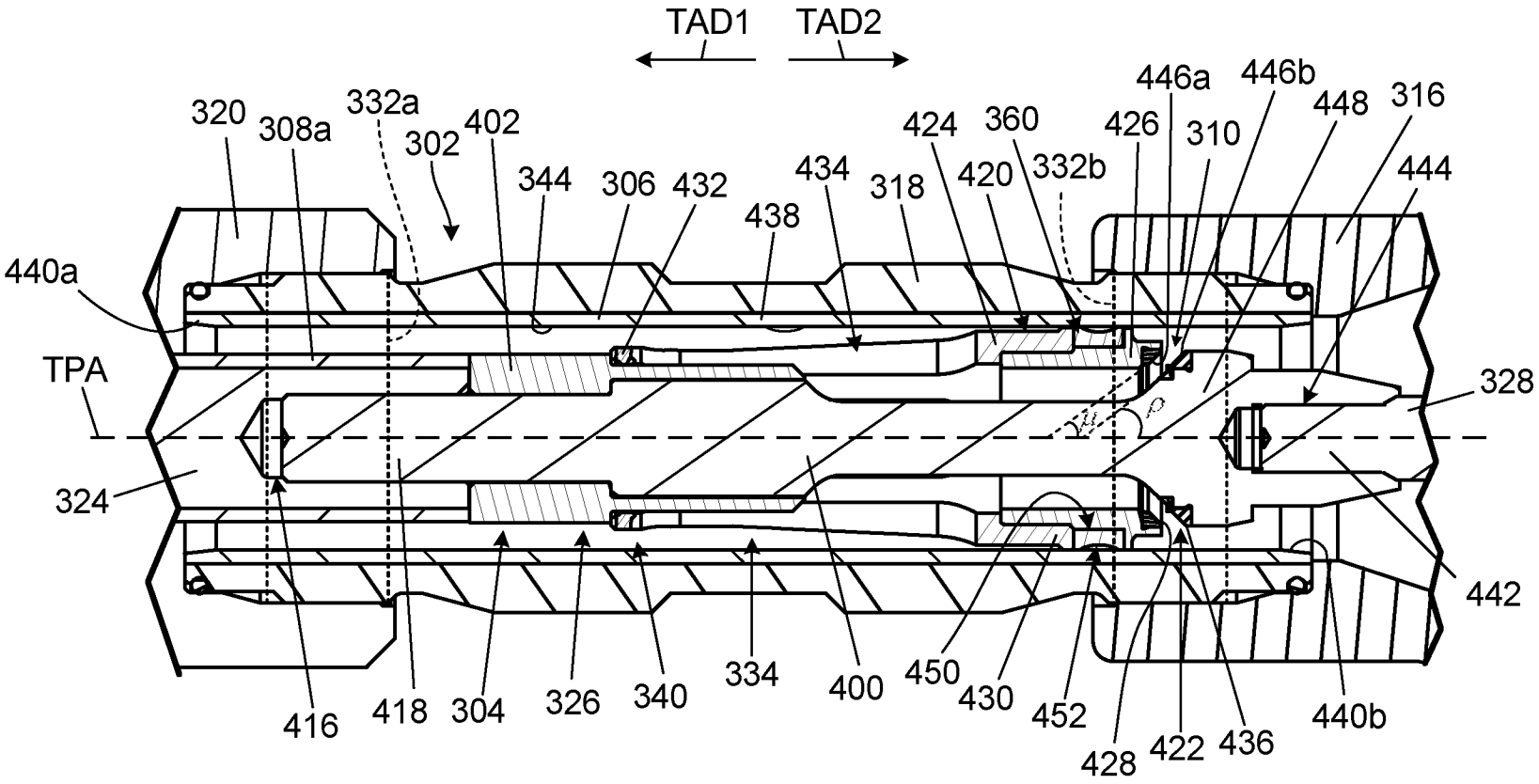
FIG. 9 is an enlarged view of detail 9 in FIG. 6A.

FIG. 9 is an enlarged view of detail 9 in FIG. 6A. Transfer pump body 302, transfer piston 304, cylinder sleeve 306, piston sleeve 308*a*, and piston valve 310 are shown. Valve housing 316, transfer pump cylinder 318, and outlet housing 320 of transfer pump body 302 are shown. Proximal rod 324, intermediate rod 326, and distal rod 328 of transfer piston 304 are shown. Intermediate rod 326 includes rod body 400 and guide body 402. Piston valve 310 includes piston seal assembly 420 and piston valve seat 422. Piston seal assembly 420 includes guide slider 424, piston seal cap 426, piston seal lip 428, and piston seal 360. Guide slider 424 includes support end 430, free end 432, and windows 434. Piston valve seat 422 includes piston seat lip 436. Cylinder sleeve 306 includes sleeve body 438 and sleeve ends 440*a*, 440*b*.

Transfer pump cylinder 318 is disposed axially between valve housing 316 and outlet housing 320. Transfer pump cylinder 318 is directly connected to outlet housing 320 at threaded interface 332*a* and is directly connected to valve housing 316 at threaded interface 332*b*. Cylinder sleeve 306 is mounted to transfer pump cylinder 318. Cylinder sleeve 306 is mounted to transfer pump cylinder 318 such that cylinder sleeve 306 covers the inner radial surface of transfer pump cylinder 318 such that that surface of transfer pump cylinder 318 is not exposed to the pumped material. Cylinder sleeve 306 can be mounted to transfer pump cylinder 318 in any desired manner. For example, cylinder sleeve 306 can be mounted by heat shrinking. For example, transfer pump cylinder 318 can be heated to cause expansion of the bore through transfer pump cylinder 318 and cylinder sleeve 306 can then be inserted into transfer pump cylinder 318. Transfer pump cylinder 318 shrinks during cooling and captures cylinder sleeve 306 to retain cylinder sleeve 306 on and within transfer pump cylinder 318.

Cylinder sleeve 306 includes sleeve body 438 that piston seal 360 engages with during reciprocation of transfer piston 304. Sleeve end 440*a* is formed at a first axial end of sleeve body 438 and sleeve end 440*b* is formed at a second, opposite axial end of sleeve body 438. Sleeve end 440*a* includes a sloped inner radial surface that slopes radially inward towards pumps axis TPA along the inner radial surface from the axially outer free end of sleeve end 440*a* and axially towards the sleeve body 438. Similarly, sleeve end 440*b* includes a sloped inner radial surface that slopes radially inward towards pump axis TPA along the inner radial surface from the axially outer free end of sleeve end 440*b* and axially towards the sleeve body 438. Cylinder sleeve 306 has a smaller inner diameter along sleeve body 438 and a larger inner diameter along sleeve ends 440*a*, 440*b*. In the example shown, sleeve ends 440*a*, 440*b* can be considered to include frustoconical inner radial surfaces. The sloped surfaces of sleeve ends 440*a*, 440*b* facilitate assembly of transfer pump 300. The sloped surfaces facilitate piston valve seal 360 passing over sleeve end 440*a*, 440*b* during assembly of transfer pump 300 by providing a smooth transition for piston seal 360 to move along and into engagement with sleeve body 438. The transitioning diameter along sleeve ends 440*a*, 440*b* facilitates a smooth transition of piston valve seal 460 into the area defined by sleeve body 438 and into engagement with sleeve body 438. Both sleeve ends 440*a*, 440*b* are tapered in the example shown such that cylinder sleeve 306 can be assembled to transfer pump cylinder 318 with either sleeve end 440*a*, 440*b* disposed closer to the end of transfer pump cylinder 318 configured to mount to outlet housing 320. The tapered sleeve ends 440*a*, 440*b* can further assist in locating cylinder sleeve 306 within transfer pump cylinder 318 during assembly to ensure proper alignment during setting of the cylinder sleeve 306 within transfer pump cylinder 318.

Intermediate rod 326 extends between and connects proximal rod 324 and distal rod 328. Guide body 402 is disposed on rod body 400. Guide body 402 is mounted to rod body 400 to move axially with rod body 400. Rod body 400 extends between and connects to both proximal rod 324 and distal rod 328. In the example shown, intermediate rod 326 is fixed to proximal rod 324 by at a first mating interface and is fixed to distal rod 328 by a second mating interface. The first mating interface is formed by a projection 418 from intermediate rod 326 extending into a bore 416 of proximal rod 324. The first mating interface can be a threaded interface between the male threaded projection 418 formed by rod body 400 and the female threaded bore 416 in proximal rod 324. The second mating interface is formed by a projection 442 from distal rod 328 extending into a bore 444 of intermediate rod 326. The second mating interface can be a threaded interface between the male threaded projection 442 formed by distal rod 328 and the female threaded bore 444 formed in the rod body 400. Each of projection 418 and projection 442 can also be referred to as a shank.

Piston valve 310 is disposed within the material flowpath 334 downstream of intake valve 312 (best seen in FIG. 7). Piston seal assembly 420 is configured to shift between a first position associated with a fully open state of piston valve 310 (shown in FIG. 6B) and a second position associated with a fully closed state of piston valve 310 (shown in FIG. 6A). Guide slider 424 of piston valve 310 is axially elongate and extends around rod body 400. Guide slider 424 is configured to shift axially relative to rod body 400 and guide body 402 during actuation of piston valve 310 between an open state and a closed state. free end 432 of guide slider 424 is disposed over a portion of guide body 402 and can interface with that portion of guide body 402. Guide body 402 locates free end 432 to align guide slider 424 during reciprocation of guide slider 424. Support end 430 is disposed at an opposite end of guide slider 424 from free end 432. Piston seal cap 426 is mounted to support end 430 of guide slider 424. Windows 434 are formed through guide slider 424 and provide flowpaths for the material to flow downstream through piston valve 310.

Piston seal lip 428 is supported by piston seal cap 426. Piston seal lip 428 is mounted to piston seal cap 426. Piston seal lip 428 is formed from a resilient material, as piston seal lip 428 is configured to directly engage with and disengage from piston valve seat 422 during operation. For example, piston seal lip 428 can be formed from tungsten carbide, among other resilient material options. Contact surface 446*a* of piston seal lip 428 is sloped such that contact surface 446*a* is transverse to the pump axis TPA. Piston seal lip 428 is frustoconical in the example shown. Contact surface 446*a* extends annularly about pump axis TPA and can be considered to form a sloped ring surface. In the example shown, contact surface 446*a* is disposed at angle μ relative to pump axis TPA. Contact surface 446*a* is formed on an inner radial side of piston seal lip 428.

Piston valve seat 422 is formed on transfer piston 304. Piston seat lip 436 is supported by intermediate rod 326. In the example shown, piston seat lip 436 is disposed on rod body 400. Specifically, piston seat lip 436 is mounted to bulb 448 formed by rod body 400. The bulb 448 is a radially enlarged portion of rod body 400. Piston seat lip 436 is formed from resilient material to facilitate mating with piston seal lip 428 during operation of piston valve 310. Piston seat lip 436 is formed from a resilient material, as piston seat lip 436 is configured to directly engage with and disengage from piston seal assembly 420 during operation. For example, piston seat lip 436 can be formed from tungsten carbide, among other resilient material options. Contact surface 446*b* of piston seat lip 436 is sloped such that contact surface 446*b* is transverse to the pump axis TPA. Piston seat lip 436 is frustoconical in the example shown. Contact surface 446*b* extends annularly about pump axis TPA and can be considered to form a sloped ring surface. In the example shown, contact surface 446*b* is disposed at angle ρ relative to pump axis TPA. Contact surface 446*b* is formed on an outer radial side of piston seat lip 436.

Piston seal lip 428 is sloped at angle μ to mate with piston seat lip 436 that is sloped at angle ρ. Angle μ of piston seal lip 428 can be the same as the angle ρ of piston seat lip 436 to facilitate mating therebetween. In the example shown, piston seat lip 436 and piston seal lip 428 are formed at respective 45-degree angles. It is understood, however, that piston seat lip 436 and piston seal lip 428 can be formed at other acute angles, such as 30-degrees, 60-degrees or another acute angle. For example, piston seat lip 436 can be formed at 40-degrees and piston seal lip 428 can be formed at 50-degrees to facilitate mating therebetween. In the example shown, piston seal lip 428 and piston seat lip 436 are measured counterclockwise from pump axis TPA. However, piston seal lip 428 and piston seat lip 436 are sloped opposite to intake seal lip 369 and intake seat lip 372. As such, angles μ and ρ can be considered to form 135-degree angles while angles γ and ω form 45-degree angles when measured clockwise from pump axis TPA.

Piston valve 310 is configured oppositely from intake valve 312 in that the moving valve member of piston valve 310, formed by piston seal assembly 420, forms the outer radial component at the sealed interface with piston valve 310 in the closed state, while the moving valve member of intake valve 312, formed by intake seal assembly 362, forms the inner radial component at the sealed interface with intake valve 312 in the closed state. In the example shown, piston seal lip 428 is radially outward of piston seat lip 436 while intake seal lip 369 is radially inward of intake seat lip 372. The opposite sealing configurations facilitate efficient sealing and pumping during operation.

Piston seal 360 is supported by piston seal assembly 420. Piston seal 360 is configured to engage with the inner radial surface 344 of cylinder sleeve 306. In the example shown, piston seal 360 is formed as an annular seal extending fully about the pump axis TPA. Piston seal 360 can be considered to form a ring seal. In the example shown, piston seal 360 is disposed in seal groove 450*c* formed on the body of piston seal assembly 420. More specifically, seal groove 450*c* is open on a radially outer side and closed on a radially inner side formed by piston seal cap 426. Seal groove 450*c* is defined axially by piston seal cap 426 and guide slider 424. More specifically, seal groove 450*c* is defined axially between a radial flange extending from piston seal cap 426 and by the axial face of support end 430 of guide slider 424.

Piston seal 360 is formed as a dynamic seal that seals against cylinder sleeve 306 at a sliding interface. Piston seal 360 is disposed in the seal groove 450*c* and interfaces with both the cylinder sleeve 306 and guide slider 424. Piston seal 360 is axially bracketed within seal groove 450*c*. Separate components of piston valve 310 form the two axial ends of the seal groove 450*c* that bracket piston seal 360. Piston seal 360 can be axially compressed between the portions of piston seal cap 426 and guide slider 424 that are disposed on the opposite axial sides of piston seal 360. Piston seal 360 can be crushed axially to facilitate deforming piston seal 360 to enhance engagement between piston seal 360 and cylinder sleeve 306.

Seal face 452 of piston seal 360 is oriented towards cylinder sleeve 306. Seal face 452 is formed on an outer radial side of piston seal 360, in the example shown. Seal face 452 is formed such that the axial ends of seal face 452 project further from the base of seal groove 450*c* than the axial center of seal face 452. In the example shown, seal face 452 is concave. Piston seal 360 is configured such that seal face 452 of piston seal 360 has a U-shaped cross-sectional profile. The prongs at the axial ends of seal face 452 directly engage and seal with the inner radial surface 344 of cylinder sleeve 306. In the example shown, piston seal 360 is the only component of piston valve 310 that engages with and seals against cylinder sleeve 306. In the example shown, piston seal 360 is a single-component seal, though it is understood that piston seal 360 can be configured as a multi-component seal in other examples.

Piston seal 360 can be formed from an ultra-high molecular weight (UHMW) polyethylene, among other options, to provide a robust seal resistant to wear by the abrasive particulate in the component materials. As known in the art, UHMW polyethylene is a polymer material, available from a number of manufacturers, with extremely long chains with a molecular mass typically between 3.5 and 7.5 million atomic mass units. In some examples, piston seal 360 can be formed from microsphere-filled UHMW. In some examples, piston seal 360 is formed from Ceram P® UHMW polyethylene. The material forming piston seal 360 and the cup configuration of piston seal 360 oriented radially for engagement with cylinder sleeve 306 prevent the abrasive particulate within the component material from migrating between piston seal 360 and cylinder sleeve 306. The material forming piston seal 360 is highly resistant to wear providing an improved operational life.

During operation, transfer piston 304 reciprocates within cylinder sleeve 306. Piston valve 310 is actuated between the open state (FIG. 6A) and the closed state (FIG. 6B). With piston valve 310 in the closed state, piston seal lip 428 engages with piston seat lip 436 to seal the portion of material flowpath 334 through piston valve 310. Transfer piston 304 is at the end of the first stroke in the first axial direction TAD1 and begins the second stroke in the second axial direction TAD2. Transfer piston 304 shifts axially in second axial direction TAD2 and piston seal assembly 420 shifts from the position associated with the closed state of piston valve 310 to the position associated with the open state of piston valve 310.

Piston seal assembly 420 is actuated to the position associated with the open state by the pressure upstream of piston valve 310 as piston moves through the second stroke. In some examples, friction between cylinder sleeve 306 and piston seal 360 can cause piston seal assembly 420 to remain stationary along axis TPA as transfer piston 304 moves in second axial direction TAD2. Intermediate rod 326 engages with guide slider 424 to limit displacement of transfer piston 304 relative to piston seal assembly 420. Specifically, free end 432 of guide slider 424 engages a bracing shoulder formed by guide body 402 to limit axial displacement of piston seal assembly 420 in first axial direction TAD1 relative to piston valve seat 422. The engagement between free end 432 and the bracing shoulder of guide body 402 pulls piston seal assembly 420 axially with the transfer piston 304.

Piston seal 360 is the portion of transfer piston 304 that contacts with and slides against cylinder sleeve 306 during reciprocation of transfer piston 304. The smoothness of cylinder sleeve 306 prevents the abrasive particulate from adhering on cylinder sleeve 306 and being pulled radially between piston seal 360 and cylinder sleeve 306. Cylinder sleeve 306 is also formed from a harder, more resilient material than transfer pump body 302, such as cylinder sleeve 306 being formed from tungsten carbide and transfer pump cylinder 318 being formed from stainless steel. The cylinder sleeve 306 provides a resilient substrate for the piston seal 360 to seal against. Deterioration of the substrate and degradation of the seal sliding relative to the substrate can be caused by abrasive particulate being pulled under the seal and between the seal and substrate. Cylinder sleeve 306 inhibits deterioration by having the smooth exterior surface and by being formed from resilient material, such as C3 tungsten carbide, among other material options.

Mounting cylinder sleeve 306 on transfer pump body 302 prevents the transfer pump body 302 from directly experiencing degradation due to the sliding seal interface. Cylinder sleeve 306 being formed separately from and mounted on transfer pump body 302 provides material and cost savings as cylinder sleeve 306 can be formed form a more resilient and costly material while transfer piston 304 is formed from a less costly material. Piston seal assembly 420 is configured such that the piston seal 360 is the only component of piston valve 310 engaging transfer pump body 302 during operation. Piston seal 360 maintains sealing engagement with cylinder sleeve 306 throughout operation of transfer pump 300. The interface between piston seal 360 and cylinder sleeve 306 prevents leakage and migration of the pumped material around the piston valve 310. Piston seal 360 facilitates simple assembly of piston seal assembly 420 as only a single seal component is utilized in the configuration of piston seal assembly 420 shown. Piston seal 360 is formed from resilient sealing material that provides robust sealing that is resistant to wear by the abrasive particulate in the component materials.

After completing the second stroke, transfer piston 304 changes over and moves through the first stroke in first axial direction TAD1. Transfer piston 304 moves in first axial direction TAD1 through the first stroke and piston valve 310 shifts from the open state to the closed state. Piston valve 310 is actuated such that piston seal lip 428 engages with piston seat lip 436 to place piston valve 310 in the closed state. For example, friction between cylinder sleeve 306 and piston seal 360 can maintain piston seal assembly 420 stationary until piston valve seat 422 engages with piston seal assembly 420. As such, some examples, of piston valve 310 can include a piston seal assembly 420 that is configured to remain stationary after changeover until transfer piston 304 moves a sufficient axial distance relative to piston seal assembly 420 to engage with piston seal assembly 420 and drive piston seal assembly 420 axially. Transfer piston 304 shifts in first axial direction TAD1 and piston seal lip 428 engages with piston seat lip 436 to place piston valve 310 in the closed state. Transfer piston 304 continues to shift in first axial direction TAD1 with piston valve 310 in the closed state. Transfer piston 304 carries piston seal assembly 420 in first axial direction TAD1 with piston valve 310 in the closed state. Piston seal 360 maintains a sealing engagement with cylinder sleeve 306 throughout reciprocation and as piston seal 360 slides relative to cylinder sleeve 306.

Transfer pump 300 provides significant advantages. Piston seal assembly 420 is configured to form a first seal with piston valve seat 422 with piston valve 310 in the closed state, and piston seal assembly 420 is configured to form a second seal with transfer pump body 302 throughout operation. The piston seal 360 can be stationary relative to transfer pump cylinder 318 during portions of the stroke, such as at turnover and during at least a portion of each stroke between the changeover points. Relative movement between piston seal 360 and cylinder sleeve 306 occurs during at least a portion of each of the first stroke and the second stroke. Relative movement along the axis TPA occurs between cylinder sleeve 306 and piston seal 360 during at least a portion of each of the first stroke and the second stroke. The smooth exterior surface of cylinder sleeve 306 inhibits migration of the abrasive particulate between cylinder sleeve 306 and piston seal 360, providing a more robust pump and increasing the operational life of the pumping components. Piston seal 360 effectively seals against both upstream and downstream pressures.

FIG. 10A is a cross-sectional view of metering pump 500 showing meter piston 504 at an end of a first stroke in a first axial direction MAD1. FIG. 10B is a cross-sectional view of metering pump 500 showing meter piston 504 at an end of a second stroke in a second axial direction MAD2 opposite the first axial direction MAD1. Metering pump 500 includes meter pump body 502, meter piston 504, cylinder sleeve 506, meter piston sleeve 508, inlet valve 510, outlet valve 512, throat seal 514, and meter piston seal 516. Meter pump body 502 includes inlet housing 518, outlet housing 520, meter pump cylinder 522, throat cartridge 524, and transfer tube 526. Meter piston 504 includes meter rod 528, piston head 530, piston cap 532, and support ring 534.

Metering pump 500 is configured to pump the abrasive material downstream to an applicator, such as applicator 16 (FIGS. 2A and 2B), applicator 116 (FIGS. 4A and 4B), or applicator 216 (FIG. 5), for application at a dispense point. One or both of metering pumps 14*a*, 14*b* (FIG. 1) can be formed by metering pump 500. Metering pump 500 receives pressurized material from an upstream pressurizer, such as transfer pumps 12*a*, 12*b* (FIG. 1) and transfer pump 300 (best seen in FIGS. 6A and 6B), increases the pressure on the material, and drives the material downstream. Metering pump 500 can be used as part of a proportioning assembly, which includes two metering pumps 500 linked together to be driven out-of-phase. As such, metering pump 500 can also be referred to as a proportioner pump. The linked driving configuration ensures a desired ratio of component materials are output by the linked metering pumps 500 and provided to the downstream applicator.

Meter piston 504 is connected to drive connector 536 to receive a reciprocating input that drives meter piston 504 in an axial reciprocating manner along pump axis MPA. A motor (not shown) is connected to the drive connector 536 to drive displacement the drive connector 536, and thus the meter piston 504, along pump axis MPA. A second meter piston of a second metering pump can be connected to the drive connector 536 such that both meter pistons are actuated simultaneously but move through opposite strokes. In other examples, the drive can extend axially between the two metering pumps 500 such that the drive connects to a first drive connector 536 of the first metering pump 500 and to a second drive connector 536 of the second metering pump 500. It is understood that the linked metering pumps 500 can have different displacement volumes to provide different output ratios. For example, the first and second metering pumps 500 can have the same displacement volume to provide a 1:1 ratio, the first metering pump 500 can have twice the displacement volume of the second metering pump 500 to provide a 2:1 ratio, etc.

Inlet housing 518 defines a meter pump inlet 588 of metering pump 500. Outlet housing 520 defines meter pump outlet 590 of metering pump 500. Meter pump cylinder 522 and transfer tube 526 extend between and interface with inlet housing 518 and outlet housing 520. Transfer tube 526 defines a flowpath for material to flow from inlet housing 518 to outlet housing 520. Meter piston 504 is at least partially disposed within meter pump cylinder 522 and reciprocates relative to meter pump cylinder 522 during operation. Inlet valve 510 and outlet valve 512 are supported by inlet housing 518. In the example shown, inlet valve 510 is a ball valve that includes a spring to bias the ball to a closed state. It is understood, however, that inlet valve 510 can be of any desired configuration suitable for facilitating unidirectional material flow through inlet valve 510. In the example shown, outlet valve 512 is a ball valve that includes a spring to bias the ball to a closed state. It is understood, however, that outlet valve 512 can be of any desired configuration suitable for facilitating unidirectional material flow through outlet valve 512. Inlet valve 510 and outlet valve 512 are disposed coaxially on a valve axis VA that is transverse to the pump axis MPA. Specifically, the valve axis VA is orthogonal to the pump axis MPA in the example shown, which provides a compact metering pump 500 having a smaller footprint.

Meter pump cylinder 522 extends between and is supported by inlet housing 518 and outlet housing 520. Cylinder sleeve 506 is mounted to meter pump cylinder 522 on an inner radial surface of meter pump cylinder 522. Cylinder sleeve 506 is mounted to meter pump cylinder 522 such that cylinder sleeve 506 covers the inner radial surface of meter pump cylinder 522. The inner radial surface of meter pump cylinder 522 is shielded by cylinder sleeve 506 and not exposed to the pumped material. Cylinder sleeve 506 can be mounted to meter pump cylinder 522 in any desired manner. For example, cylinder sleeve 506 can be mounted by heat shrinking. For example, meter pump cylinder 522 can be heated to cause expansion of the bore through meter pump cylinder 522 and cylinder sleeve 506 can then be inserted into meter pump cylinder 522. Meter pump cylinder 522 shrinks during cooling and captures cylinder sleeve 506 to retain cylinder sleeve 506 on and within meter pump cylinder 522.

Cylinder sleeve 506 includes sleeve body 538 that meter piston seal 516 engages with during reciprocation of meter piston 504. Cylinder sleeve 506 is elongate along pump axis MPA. Specifically, meter piston seal 516 engages with and forms a sliding seal with the inner radial surface 542 of cylinder sleeve 506. Cylinder sleeve 506 can be identical to cylinder sleeve 306 (best seen in FIG. 9) such that only a single configuration of a cylinder sleeve needs to be manufactured and can be utilized in multiple different pumps. Such a common configuration provides significant savings in material and manufacturing costs.

Sleeve end 540*a* is formed at a first axial end of sleeve body 538 and sleeve end 540*b* is formed at a second, opposite axial end of sleeve body 538. Sleeve end 540*a* includes a sloped inner radial surface that is sloped to extend inward towards pumps axis MPA from the distal axial end of sleeve end 540*a* and axially towards the sleeve body 538. Similarly, sleeve end 540*b* includes a sloped inner radial surface that is sloped to extend inward towards pump axis MPA from the distal axial end of sleeve end 540*b* and axially towards the sleeve body 538. As such, cylinder sleeve 506 has a narrower diameter along sleeve body 538 than at the outer axial ends of cylinder sleeve 506. In the example shown, sleeve ends 540*a*, 540*b* can be considered to include frustoconical inner radial surfaces. The sloped surfaces of sleeve ends 540*a*, 540*b* facilitate assembly of metering pump 500. The sloped surfaces facilitate meter piston seal 516 passing over a sleeve end 540*a*, 540*b* during assembly of metering pump 500 without meter piston seal 516 having to encounter a sharp edge. The transitioning diameter along sleeve ends 540*a*, 540*b* facilitates a smooth transition of meter piston seal 516 into the area defined by sleeve body 538 and into sealing engagement with sleeve body 538. Both sleeve ends 540*a*, 540*b* are tapered in the example shown such that cylinder sleeve 506 can be assembled to meter pump cylinder 522 with either sleeve end 540*a*, 540*b* disposed closer to the end of meter pump cylinder 522 configured to mount to outlet housing 520. The tapered sleeve ends 540*a*, 540*b* can further assist in locating cylinder sleeve 506 within meter pump cylinder 522 during assembly to ensure proper alignment during setting of the cylinder sleeve 506 within meter pump cylinder 522. For example, the tapered sleeve end 540*a*, 540*b* can be engaged by a located that holds cylinder sleeve 506 stationary relative to meter pump cylinder 522 as meter pump cylinder 522 cools and shrinks.

Throat cartridge 524 is mounted to outlet housing 520. Throat cartridge 524 can be mounted by interfaced threading between throat cartridge 524 and outlet housing 520, among other connection options. More specifically, cartridge body 546 of throat cartridge 524 is connected to outlet housing 520. Cartridge cap 548 is disposed within outlet housing 520 and interfaces with cartridge body 546. Throat cartridge 524 includes a passage therethrough that meter piston 504 extends through. Throat cartridge 524 is disposed coaxially with meter pump cylinder 522 on pump axis MPA. Throat cartridge 524 is mounted to an opposite side of outlet housing 520 from meter pump cylinder 522 along the pump axis MPA.

Throat seal 514 is supported by throat cartridge 524. Throat seal 514 is configured to remain stationary during operation as meter piston 504 reciprocates relative to throat seal 514. Throat seal 514 engages with outer radial surface 544 of meter piston sleeve 508. Throat seal 514 is disposed in throat seal groove 564 formed by throat cartridge 524. Throat seal groove 564 is defined axially by a flange of cartridge body 546 and a flange of cartridge cap 548. The base of throat seal groove 564 is formed by cartridge body 546 such that an outer radial side of throat seal 514 engages and seals against cartridge body 546.

Meter piston 504 is at least partially disposed within meter pump body 502. Meter piston 504 extends out of meter pump body 502 through throat cartridge 524. Specifically, meter rod 528 extends through throat seal 514 and from within meter pump body 502 to outside of meter pump body 502. Rod end 550 is formed at an end of meter piston 504 disposed outside of meter pump body 502. In the example shown, rod end 550 is integrally formed as a portion of meter rod 528. Rod end 550 includes meter piston head 552 and meter piston neck 554. Meter piston head 552 is captured within drive connector 536 to connect meter piston 504 to the driver via drive connector 536. Meter piston neck 554 has a smaller diameter than meter piston head 552 to extend through an opening of drive connector 536 and such that driving force can be exerted on either axial side of meter piston head 552. An annular gap can be formed axially between meter piston head 552 and the body of meter rod 528.

Piston head 530 is connected to meter rod 528. Piston head 530 is connected to an opposite axial end of meter rod 528 from rod end 550. In the example shown, projection 556 extends from meter rod 528 and into bore 558 formed in piston head 530 to connect meter rod 528 to piston head 530. For example, the projection 556 and bore 558 can each include threading such that meter rod 528 is connected to piston head 530 at a threaded interface. Projection 556 can also be referred to as a shank.

Meter piston sleeve 508 is mounted to meter piston 504. Meter piston sleeve 508 is disposed in a cylindrical recess extending into the exterior of meter piston 504. Meter piston sleeve 508 is cylindrical and axially elongate. Meter piston sleeve 508 is disposed on the body of meter rod 528. The axial ends of meter piston sleeve 508 are braced by meter rod 528 and piston head 530, in the example shown. A first axial end of meter piston sleeve 508 interfaces with rod shoulder 560 and a second axial end of meter piston sleeve 508 interfaces with head shoulder 562. Rod shoulder 560 and head shoulder 562 define the axial ends of the cylindrical recess. Rod shoulder 560 and head shoulder 562 are annular and project radially outward relative to the recessed surface that meter piston sleeve 508 is disposed over.

Meter piston sleeve 508 is mounted to meter rod 528 such that the exterior of the sleeved portion of the body of the meter rod 528 has the same diameter as the exterior of the unsleeved portion of the body of the meter rod 528, in the example shown. In the example shown, rod shoulder 560 is formed by meter rod 528 and head shoulder 562 is formed by piston head 530. Meter piston sleeve 508 can be compressed between rod shoulder 560 and head shoulder 562 during mounting of piston head 530 to meter rod 528 to provide a tight fit, preventing undesired movement of meter piston sleeve 508 and preloading meter piston sleeve 508. The tight fit inhibits migration of abrasive particulate into the interface between meter piston sleeve 508 and the body of meter rod 528. In some examples, meter piston sleeve 508 can be fixed to meter rod 528 by an adhesive.

Piston cap 532 is connected to piston head 530 at an opposite axial end of piston head 530 from meter rod 528. In the example shown, piston cap 532 includes a projection that extends into a bore formed in piston head 530. For example, the projection and bore can be threaded such that piston cap 532 is connected to piston head 530 by interfaced threading, though it is understood that other connection types are possible.

Meter piston seal 516 is mounted on meter piston 504 and is configured to engage with cylinder sleeve 506 to provide a liquid-tight seal therebetween. Meter piston seal 516 slides along the inner radial surface 542 of cylinder sleeve 506 and seals with the inner radial surface of cylinder sleeve 506 throughout operation of metering pump 500. Meter piston seal 516 is disposed on and supported by piston head 530. More specifically, piston seal groove 566 is formed on an exterior of meter piston 504 and meter piston seal 516 is disposed in the piston seal groove 566. The piston seal groove 566 includes a radially inner base that is formed by piston head 530 and axial sides that are formed by piston head 530 and piston cap 532. Support ring 534 is disposed within piston seal groove 566 adjacent to meter piston seal 516. Support ring 534 engages both piston cap 532 and meter piston seal 516 to facilitate a tight fit of meter piston seal 516 in piston seal groove 566 and to axially compress meter piston seal 516 within piston seal groove 566. It is understood that, in some examples, piston seal groove 566 is sized to receive only the meter piston seal 516 such that meter piston 504 does not include support ring 534. In some examples, support ring 534 is integrally formed with piston cap 532 as an annular, axial projection. In some examples, support ring 534 is disposed on an opposite axial side of meter piston seal 516 from that shown, such that support ring 534 is disposed axially between the portion of meter piston head 552 defining piston seal groove 566 and meter piston seal 516.

Piston head 530 is disposed in meter pump cylinder 522 and divides meter pump cylinder 522 into a downstream pump chamber 568 on a first axial side of piston head 530 and an upstream pump chamber 570 on a second axial side of piston head 530. The seal formed between meter piston seal 516 and cylinder sleeve 506 fluidly separates the downstream pump chamber 568 from the upstream pump chamber 570 throughout pumping. The material within upstream pump chamber 570 must flow through outlet valve 512 and transfer tube 526 to flow to downstream pump chamber 568.

During operation, meter piston 504 reciprocates along pump axis MPA through a first stroke in first axial direction MAD1 and second stroke in second axial direction MAD2. The first stroke can also be referred to as a suction stroke because additional material is being drawn into metering pump 500 and the second stroke can also be referred to as a pressure stroke. It is understood that metering pump 500 is configured to output pumped material during both the first stroke and the second stroke. Metering pump 500 can thus be referred to as a double displacement pump.

Meter piston 504 is at an end of the second stroke as shown in FIG. 10B. At the end of the second stroke, the meter piston sleeve 508 is disposed within and radially overlaps with cylinder sleeve 506, providing a compact configuration of metering pump 500. Meter piston 504 is pulled in first axial direction MAD1 and through the first stroke. The displacement of meter piston 504 creates suction in upstream pump chamber 570 that can cause inlet valve 510 to shift to the open state and outlet valve 512 to shift to the closed state. With inlet valve 510 in the open state, the material flows through pump inlet 588 and inlet valve 510 and into upstream pump chamber 570. The meter piston 504 displacing in the first axial direction MAD1 decreases a volume of the downstream pump chamber 568 and drives material downstream out of metering pump 500 through pump outlet 590. Outlet valve 512 is closed to prevent material backflow to upstream pump chamber 570.

After completing the first stroke, meter piston 504 changes over from the first stroke to the second stroke. Meter piston 504 can be in the position shown in FIG. 10B at the beginning of the second stroke. During the second stroke, meter piston 504 moves in second axial direction MAD2 to decrease the volume of upstream pump chamber 570 and increase the volume of downstream pump chamber 568. Inlet valve 510 shifts to a closed state and outlet valve 512 shifts to an open state. Material from within upstream pump chamber 570 flows through outlet valve 512 and transfer tube 526 and into outlet housing 520. As meter piston 504 moves in the second axial direction MAD2, the material previously within transfer tube 526 and outlet housing 520 and the material being displaced by meter piston 504 can flow downstream and out of metering pump 500 through meter pump outlet 590. A portion of the material flows into downstream fluid chamber 568 to preload metering pump 500 with material to output during the next first stroke.

After the second stroke, meter piston 504 again changes over and displaces in first axial direction MAD1 and through the first stroke. Meter piston 504 continues to reciprocate through the first stroke and second stroke to pump the material downstream.

The dynamic interfaces of metering pump 500, formed at the sliding interfaces between throat seal 514 and meter piston sleeve 508 and between meter piston seal 516 and cylinder sleeve 506, are locations that are susceptible to wear. Metering pump 500 is configured to inhibit wear at those locations to provide a pump having increased operational lifespan and that requires less maintenance. Specifically, throat seal 514 interfaces with meter piston sleeve 508 at the first dynamic interface and meter piston seal 516 interfaces with cylinder sleeve 506 at the second dynamic interface. Meter piston sleeve 508 interfaces with the throat seal 514 and meter piston seal 516 interfaces with cylinder sleeve 506 to facilitate pumping by metering pump 500. The interfaces are dynamic interfaces with relative movement between the interfacing components.

Meter piston sleeve 508 is disposed over a metallic portions of meter piston 504 to protect the metallic components from the highly abrasive component materials. For example, meter piston sleeve 508 can be formed from C3 tungsten carbide and meter rod 528 can be formed from stainless steel. Meter piston sleeve 508 comprises highly polished surface exposed to the abrasive material that reduces or eliminates the microscopic abrasive particles from attaching to the surfaces of the meter piston sleeve 508. The smooth surface is formed by the outer radial surface 544 of meter piston sleeve 508. The particulate can attach to blemishes of the sliding surfaces but such attachment is prevented by the smoothness of the exterior surfaces, thus reducing or eliminating wear on the seals and sleeved components.

Similarly, cylinder sleeve 506 is disposed over the metallic portion of the meter pump cylinder 522 to protect the metallic components from the abrasive component materials. For example, cylinder sleeve 506 can be formed from C3 tungsten carbide and meter pump cylinder 522 can be formed from stainless steel. Cylinder sleeve 506 comprises a highly polished surface exposed to the abrasive material that reduces or eliminates the microscopic abrasive particles from attaching to the surfaces of the cylinder sleeve 506. The smooth surface is formed by the inner radial surface 542 of cylinder sleeve 506. The particulate can attach to blemishes of the sleeved surfaces but such attachment is prevented by the smoothness of the surfaces exposed to the pumped material, thus reducing or eliminating wear on the seals and sleeved components.

The smoothness of the meter piston sleeve 508 and cylinder sleeve 506 at the sliding interfaces must be maintained over the life of metering pump 500, so protecting these surfaces is critical. C3 submicron tungsten carbide can be used to form meter piston sleeve 508 and/or cylinder sleeve 506 due to its superior surface finish, but other types of tungsten or ceramic can be utilized as long as a highly polished surface finish can be achieved. The smooth surface finish inhibits adhesion of the abrasive materials on the surfaces of the meter piston sleeve 508 and cylinder sleeve 506, preventing the abrasive particulate from being pulled under the seal interfacing with that sleeve and radially between the sealing components. The mean roughness depth (Rz) of the sleeve surfaces exposed to the pumped material is controlled to provide the smooth surface that prevents adhesion of the abrasive particulate. The Rz can be determined by measuring the vertical distance from the highest peak to the lowest valley within five sampling lengths, then averaging these distances. The Rz averages the five tallest peaks and the five lowest valleys to provide an indication of the smoothness of the surface finish. Typically, a surface finish having an Rz of less than about 0.8 micrometers (μm) (about 31.5 microinches (μin)) is required to achieve a mirror finish. The Rz of the exterior surface of the one or more sleeves of the sleeve assembly 48 can be up to about 0.8 μm (about 31.5 μin). In some examples, the Rz of the sleeve surfaces is up to about 0.3 μm (about 11.8 μin). Some examples of the sleeve surfaces have a Rz of up to about 0.25 μm (about 9.8 μin).

The surface finish can, in some examples, be enhanced by the use of any one of physical vapor deposition (PVD), plasma assisted chemical vapor deposition (PACVD), and chemical vapor deposition (CVD) coatings, which increase the hardness of the surface of the highly polished surface and which can assist in protecting the surface finish. The smooth sleeve surfaces can be formed by tungsten or ceramic and slide against the mating seal surfaces.

Throat seal 514 engages with meter piston 504 throughout reciprocation of meter piston 504. Specifically, throat seal 514 engages with and seals against the outer radial surface 544 of meter piston sleeve 508. Throat seal 514 is configured to prevent material from leaking out of metering pump 500 at the dynamic interface between meter piston 504 and non-moving components. Throat seal 514 is configured to remain stationary along the pump axis MPA as meter piston 504 reciprocates relative to throat seal 514. In the example shown, throat seal 514 is a multi-component seal that interfaces with meter piston sleeve 508. Specifically, throat seal 514 includes throat dynamic seals 572*a*, 572*b* that interface with meter piston sleeve 508.

Throat seal 514 interfaces with meter piston sleeve 508 throughout operation and during reciprocation of meter piston 504. Throat seal 514 directly engages with meter piston sleeve 508. Meter piston sleeve 508 is the only portion of meter piston 504 that throat seal 514 contacts during reciprocation of the meter piston 504. Throat seal 514 and meter piston sleeve 508 mate at a sliding sealed interface to prevent migration of the pumped material out of metering pump 500 through that sliding interface. Throat dynamic seal 572*a* and throat dynamic seal 572*b* abut each other and interface with meter piston sleeve 508.

Meter piston 504 and throat seal 514 are configured such that the only portion of meter piston 504 that throat seal 514 engages is the outer radial surface 544 of meter piston sleeve 508. In the example shown, throat seal 514 is formed from multiple sealing members. Throat dynamic seal 572*a* and throat dynamic seal 572*b* engage with the outer radial surface 544 of meter piston sleeve 508 to form the liquid-tight sliding interface. Throat dynamic seals 572*a*, 572*b* are configured such that the respective seal cup 576 of each throat dynamic seal 572*a*, 572*b* is oriented axially outward and away from the seal cup 576 of the other throat dynamic seal 572*a*, 572*b*. Specifically, the seal cup 576 of throat dynamic seal 572*a* is oriented with an open end facing in first axial direction TAD1 and the seal cup 576 of throat dynamic seal 572*b* is oriented with an open end facing in second axial direction TAD2. Seal bodies 574 of throat dynamic seals 572*a*, 572*b* abut within throat seal groove 564 of throat cartridge 524. Seal bodies 574 abut such that throat dynamic seals 572*a*, 572*b* provide axial support to each other. The seal cups 576 are oriented axially outward. Throat dynamic seal 572*a* can be configured the same as throat dynamic seal 572*b*, but with throat dynamic seals 572*a*, 572*b* oriented in opposite axial directions when assembled together to form throat seal 514.

Seal cups 576 are formed as annular cups that can be pressure-assisted to enhance sealing between throat seal 514 and meter piston sleeve 508. Each seal cup 576 includes a first arm 578*a* and a second arm 578*b*. The arms 578*a*, 578*b* extend both axially and radially from the seal bodies 574. The arms 578*a* extend radially away from the arms 578*b* and into engagement with the body of throat cartridge 524. The arms 578*b* extend radially away from the arms 578*a* and into engagement with meter piston sleeve 508. Arms 578*a*, 578*b* are formed as annular extensions from seal bodies 574 that extend fully around meter piston 504. In the example shown, each throat dynamic seal 572*a*, 572*b* is formed as a multi-lip seal. The multi-lip seal is configured such that multiple annular lips extends from each arm 578*a*, 578*b* and into engagement with the substrate that the throat seal 514 seals against. The lips project radially and facilitate sealing against the opposing surface, such as the body of throat cartridge 524 and the outer radial surface 544 of meter piston sleeve 508. Specifically, the throat dynamic seals 572*a*, 572*b* are formed as triple lip seals in the example shown.

While throat seal 514 is shown as including dual throat dynamic seals 572*a*, 572*b* that include oppositely oriented seal cups 576, it is understood that throat seal 514 can be configured with a single seal cup 576 oriented towards the material flowpath of metering pump 500, such as towards downstream pump chamber 568. For example, throat seal 514 can be formed as a single component seal having a single seal cup 576 facing in second axial direction TAD2. In some examples, throat seal 514 can be configured as a multi-component seal that includes throat dynamic seal 572*a* formed as a block, similar to a seal body 574 or support ring 534, and throat dynamic seal 572*b* formed with a seal cup 576, such as is shown in FIGS. 10A and 10B. In such an example, throat dynamic seal 572*a* can engage with meter piston 504 to inhibit migration but may not include a seal cup as throat dynamic seal 572*a* is not directly exposed to the pressurized material being pumped through meter pump body 502.

Throat dynamic seals 572*a*, 572*b* can be formed from an ultra-high molecular weight (UHMW) polyethylene, among other options, to provide a robust seal resistant to wear by the abrasive particulate in the component materials. As known in the art, UHMW polyethylene is a polymer material, available from a number of manufacturers, with extremely long chains with a molecular mass typically between 3.5 and 7.5 million atomic mass units. In some examples, throat dynamic seals 572*a*, 572*b* can be formed from microsphere-filled UHMW. In some examples, throat dynamic seals 572*a*, 572*b* are formed from Ceram P® UHMW polyethylene. The material forming throat dynamic seals 572*a*, 572*b* and the cup configurations of throat dynamic seals 572*a*, 572*b* prevent the abrasive particulate within the component material from migrating between throat seal 514 and meter piston 504. The material forming throat dynamic seals 572*a*, 572*b* is highly resistant to wear providing an improved operational life.

The smoothness of meter piston sleeve 508 prevents abrasive particulate from adhering on meter piston sleeve 508 and being pulled radially between throat seal 514 and meter piston sleeve 508. Meter piston sleeve 508 is formed from a harder, more resilient material than meter rod 528. The resilient meter piston sleeve 508 provides a resilient substrate for the throat seal 514 to seal against. Deterioration of the substrate and degradation of the seal sliding relative to the substrate can be caused by abrasive particulate being pulled under the seal and between the seal and substrate. Meter piston sleeve 508 inhibits deterioration by having the smooth exterior surface and by being formed from resilient material, such as C3 tungsten carbide, among other material options. Throat seal 514 further inhibits deterioration by being formed from the durable sealing material, such as the UHMW polyethylene.

Meter piston seal 516 is configured similar to throat seal 514. In some examples, meter piston seal 516 can be configured the same as throat seal 514. Meter piston seal 516 engages with cylinder sleeve 506 throughout reciprocation of meter piston 504. Meter piston seal 516 is configured to seal with cylinder sleeve 506 to prevent material from leaking around meter piston 504 between downstream pump chamber 568 and upstream pump chamber 570. Meter piston seal 516 is configured to engage with and slide along the inner radial surface 542 of cylinder sleeve 506 as meter piston 504 reciprocates relative to cylinder sleeve 506. In the example shown, meter piston seal 516 is a multi-component seal that interfaces with cylinder sleeve 506. Specifically, meter piston seal 516 includes piston dynamic seals 580*a*, 580*b* that interface with cylinder sleeve 506.

Meter piston seal 516 interfaces with cylinder sleeve 506 throughout operation and during reciprocation of meter piston 504. Meter piston seal 516 directly engages with cylinder sleeve 506. Meter piston seal 516 is the only portion of meter piston 504 that directly contacts cylinder sleeve 506 during reciprocation of the meter piston 504. Meter piston seal 516 and cylinder sleeve 506 mate at a sliding sealed interface to prevent migration of the pumped material through that sliding interface. Piston dynamic seal 580*a* and piston dynamic seal 580*b* abut each other and interface with cylinder sleeve 506.

Meter piston 504 and meter pump body 502 are configured such that the only portion of meter pump body 502 that meter piston seal 516 engages is the inner radial surface 542 of cylinder sleeve 506. More specifically, meter piston seal 516 engages to engages only the portion of inner radial surface 542 along sleeve body 538 during operation of metering pump 500. In the example shown, meter piston seal 516 is formed from multiple sealing members. Piston dynamic seal 580*a* and piston dynamic seal 580*b* engage with the inner radial surface 542 of cylinder sleeve 506 to form the liquid-tight sliding interface. Piston dynamic seals 580*a*, 580*b* are configured such that the respective seal cups 584 of each piston dynamic seal 580*a*, 580*b* are oriented axially outward and away from each other. Specifically, the seal cup 584 of piston dynamic seal 580*a* is oriented with an open end facing in first axial direction TAD1 and the seal cup 584 of piston dynamic seal 580*b* is oriented with an open end facing in second axial direction TAD2. Seal bodies 582 of piston dynamic seals 580*a*, 580*b* abut within piston seal groove 566 of meter piston 504. Seal bodies 582 abut such that piston dynamic seals 580*a*, 580*b* provide axial support to each other. The seal cups 584 are oriented axially outward. Piston dynamic seal 580*a* can be configured the same as piston dynamic seal 580*b*, but with piston dynamic seals 580*a*, 580*b* oriented in opposite axial directions when assembled together to form meter piston seal 516.

Piston dynamic seals 580*a*, 580*b* operate together to form the dual-directional seal of meter piston seal 516. The dual-opposing seal configuration of meter piston seal 516 inhibits material migration into the space radially between meter piston seal 516 and cylinder sleeve 506. Seal cups 584 are formed as annular cups that can be pressure-assisted to enhance sealing between meter piston seal 516 and cylinder sleeve 506. Seal cups 584 are formed as annular cups that can be pressure-assisted to enhance sealing between throat seal 514 and meter piston sleeve 508. Each seal cup 584 includes a first arm 586*a* and a second arm 586*b*. The arms 586*a*, 586*b* extend both axially and radially from the seal bodies 582. The arms 586*a* extend radially away from the arms 586*b* and into engagement with cylinder sleeve 506. The arms 586*b* extend radially away from the arms 586*a* and into engagement with meter piston 504, and specifically into engagement with piston head 530. Arms 586*a*, 586*b* are formed as annular extensions from seal bodies 582 that extend fully around meter piston 504. In the example shown, each piston dynamic seal 580*a*, 580*b* is formed as a multi-lip seal. The multi-lip seal is configured such that multiple annular lips extends from each arm 586*a*, 586*b* and into engagement with the substrate that meter piston seal 516 seals against. The lips project radially and provide the seal against the opposing surface, such as meter piston 504 and the inner radial surface 542 of cylinder sleeve 506. Specifically, the piston dynamic seals 580*a*, 580*b* are formed as triple lip seals in the example shown.

Piston dynamic seals 580*a*, 580*b* can be formed from an ultra-high molecular weight (UHMW) polyethylene, among other options, to provide a robust seal resistant to wear by the abrasive particulate in the component materials. As known in the art, UHMW polyethylene is a polymer material, available from a number of manufacturers, with extremely long chains with a molecular mass typically between 3.5 and 7.5 million atomic mass units. In some examples, piston dynamic seals 580*a*, 580*b* can be formed from microsphere-filled UHMW. In some examples, piston dynamic seals 580*a*, 580*b* are formed from Ceram P® UHMW polyethylene. The material forming piston dynamic seals 580*a*, 580*b* and the cup configurations of piston dynamic seals 580*a*, 580*b* prevent the abrasive particulate within the component material from migrating between meter piston seal 516 and meter piston 504. The material forming piston dynamic seals 580*a*, 580*b* is highly resistant to wear providing an improved operational life.

The smoothness of cylinder sleeve 506 prevents abrasive particulate from adhering on cylinder sleeve 506 and being pulled radially between meter piston seal 516 and cylinder sleeve 506. Cylinder sleeve 506 is formed from a harder, more resilient material than meter pump cylinder 522. The resilient cylinder sleeve 506 provides a resilient substrate for the meter piston seal 516 to seal against. Deterioration of the substrate causes degradation of the seal sliding relative to the substrate due to direct contact with the degraded surface and due to abrasive particulate being pulled under the seal engaging the substrate. Cylinder sleeve 506 inhibits deterioration by having the smooth exterior surface and being formed from resilient material, such as C3 tungsten carbide, among other material options. Meter piston seal 516 further inhibits deterioration by being formed from the durable sealing material, such as the UHMW polyethylene.

Metering pump 500 provides significant advantages. The dynamic interfaces of metering pump 500 are locations that are susceptible to wear. Metering pump 500 is configured to inhibit wear at those locations to provide a pump having increased lifespan that requires less maintenance. Specifically, throat seal 514 interfaces with meter piston sleeve 508 at the first dynamic interface and meter piston seal 516 interfaces with cylinder sleeve 506 at the second dynamic interface. Meter piston sleeve 508 and cylinder sleeve 506 are formed with smooth exterior surfaces that inhibit adhesion of the abrasive particulate in the component materials, thereby preventing the abrasive particulate from being pulled between the sliding component and an interfacing seal. The particulate being pulled between such components causes accelerated wear and degradation of the components. The smooth sleeve surfaces inhibit such migration, providing a more robust metering pump 500 having a longer operational life. The sleeves are formed from harder material than the component supporting the sleeve, to protect those supporting components, such as by protecting meter pump body 502 and the body of meter piston 504. Meter piston sleeve 508 is mounted on meter piston 504 such that if wear is experienced by the meter piston sleeve 508, the meter piston sleeve 508 can be removed and replaced without requiring replacement of the full meter piston 504, thereby reducing costs.

The smooth sleeved surfaces significantly increase the operating lifespan of metering pump 500. In some examples, the sleeved configuration of metering pump 500 increased the operational lifespan from about 18,925 cycles and about 3,785 liters (L) pumped to more than 1,000,000 cycles and about 200,000 L pumped, a cycle and pump volume increase of about 5,000%. The smooth sleeved surfaces may provide even greater benefits than those discussed as the metering pump 500 did not fail during the tests, but instead the testing was stopped for other reasons.

Discussion of Non-Exclusive Examples

The following are non-exclusive descriptions of possible examples of the present invention.

A pump for pumping an abrasive material includes a pump body; a first seal supported by the pump body; a piston at least partially disposed within the pump body and configured to reciprocate along a pump axis; a first piston sleeve mounted on the piston, wherein the first piston sleeve interfaces with the first seal during reciprocation of the piston; a second piston sleeve mounted on the piston and spaced axially from the first piston sleeve along the piston; and an intake valve disposed within the pump body, wherein the intake valve includes an intake seal assembly disposed on the piston, wherein the intake seal assembly interfaces with the second piston sleeve during reciprocation of the piston, and wherein the intake valve is actuatable between an open state with the intake seal assembly disengaged from an intake seat and a closed state with the intake seal assembly engaged with the intake seat.

The pump of the preceding paragraph can optionally include, additionally and/or alternatively, any one or more of the following features, configurations and/or additional components:

The intake seal assembly rides on the second piston sleeve.

The intake seal assembly includes an intake seal housing; and an intake seal disposed within the intake seal housing, the intake seal engaging the second piston sleeve.

The intake seal includes a first intake dynamic seal and a second dynamic seal, and wherein both the first dynamic seal and the second intake dynamic seal engage with the second piston sleeve.

The first intake dynamic seal includes a first seal body and a first seal cup, the second intake dynamic seal includes a second seal body and a second seal cup, the first seal body abuts the second seal body, and the first seal cup is oriented in a first axial direction along the axis and the second seal cup is oriented in a second axial direction along the axis opposite the first axial direction.

The first intake dynamic seal and the second intake dynamic seal are formed from microsphere-filled ultra-high molecular weight polyethylene.

The piston includes a proximal rod extending out of the pump body, an intermediate rod connected to the proximal rod, a distal rod connected to the intermediate rod at an opposite end of the intermediate rod from the proximal rod, the first piston sleeve is mounted on the proximal rod, and the second piston sleeve is mounted on the distal rod.

The intermediate rod interfaces with the first piston sleeve and does not interface with the second piston sleeve.

The first piston sleeve is mounted on the proximal rod in a cylindrical recess that extends axially between a first shoulder formed by the proximal rod and a second shoulder formed by the intermediate rod.

The second piston sleeve is mounted on the distal rod in a cylindrical recess that extends axially between a first shoulder formed by the distal rod and a second shoulder formed by a scoop assembly mounted to an end of the distal rod opposite the intermediate rod.

An exterior surface of the first piston sleeve has a mean roughness depth (Rz) of up to 0.8 micrometers.

The exterior surface of the first piston sleeve has an Rz of up to 0.3 micrometers.

The exterior surface of the first piston sleeve has an Rz of up to 0.25 micrometers.

An exterior surface of the first piston sleeve is formed from one of C3 tungsten carbide and ceramic and an exterior surface of the second piston sleeve is formed from one of C3 tungsten carbide and ceramic.

A cylinder sleeve mounted to the pump body; and a piston valve disposed within the pump body, wherein the piston valve includes a piston seal assembly disposed on the piston, wherein the piston seal assembly interfaces with the cylinder sleeve during reciprocation of the piston, and wherein the piston valve is actuatable between an open state with the piston seal assembly disengaged from a piston valve seat and a closed state with the piston seal assembly engaged with the piston valve seat.

The piston seat is formed on the piston.

A piston seal is supported by the piston seal assembly and engaging the cylinder sleeve.

The piston seal includes a seal face engaging the cylinder sleeve, and wherein the seal face is concave.

The pump body includes an inlet housing; a valve housing mounted to the inlet housing, wherein the intake seal assembly is disposed within the valve housing; a pump cylinder mounted to an opposite end of the valve housing from the inlet housing, wherein the cylinder sleeve is mounted on an inner surface of the pump cylinder; and an outlet housing mounted to an opposite end of the pump cylinder from the valve housing.

A throat cartridge is mounted to an opposite end of the outlet housing from the pump cylinder, and wherein the first seal is disposed within the throat cartridge and engages with the first piston sleeve.

The first seal includes a first throat dynamic seal having a first seal body and a first seal cup; and a second throat dynamic seal having a second seal body and a second seal cup. The first seal body abuts the second seal body and the first seal cup is oriented in a first axial direction along the axis and the second seal cup is oriented in a second axial direction along the axis opposite the first axial direction.

A pump for pumping an abrasive material includes a pump body having an intake housing, a valve housing mounted to the intake housing, a pump cylinder mounted to an end of the valve housing opposite the intake housing, an outlet housing mounted to an end of the pump cylinder opposite the valve housing, and a throat cartridge mounted to an end of the outlet housing opposite the pump cylinder; a first seal supported by the throat cartridge; a piston at least partially disposed within the pump body and configured to reciprocate along a pump axis; a first piston sleeve mounted on the piston, wherein the first piston sleeve interfaces with the first seal during reciprocation of the piston; a second piston sleeve mounted on the piston and spaced axially from the first piston sleeve along the piston; a cylinder sleeve mounted to the pump cylinder such that an interior radial surface is exposed within a material flowpath through the pump body; an intake valve disposed within the pump body, wherein the intake valve includes an intake seal assembly disposed on the piston, wherein the intake seal assembly interfaces with the second piston sleeve during reciprocation of the piston, and wherein the intake valve is actuatable between a first open state with the intake seal assembly disengaged from an intake seat and a first closed state with the intake seal assembly engaged with the intake seat; and a piston valve disposed within the pump body, wherein the piston valve includes a piston seal assembly disposed on the piston, wherein the piston seal assembly interfaces with the cylinder sleeve during reciprocation of the piston, and wherein the piston valve is actuatable between a second open state with the piston seal assembly disengaged from a piston valve seat and a second closed state with the piston seal assembly engaged with the piston valve seat.

A pump for pumping an abrasive material includes a pump body; a first seal supported by the pump body; a cylinder sleeve supported by the pump body; a piston at least partially disposed within the pump body and configured to reciprocate along a pump axis; a first piston sleeve mounted on the piston, wherein the first piston sleeve interfaces with the first seal during reciprocation of the piston; and a piston seal mounted on the piston and interfacing with the cylinder sleeve, wherein the piston seal is an only portion of the piston interfacing with the cylinder sleeve during reciprocation of the piston.

The pump of the preceding paragraph can optionally include, additionally and/or alternatively, any one or more of the following features, configurations and/or additional components:

The pump body includes an inlet housing having a material inlet; an outlet housing having a material outlet; a pump cylinder extending between and supported by the inlet housing and the outlet housing; and a transfer tube extending between the inlet housing and the outlet housing and defining a flowpath between the inlet housing and the outlet housing. The cylinder sleeve is mounted to the pump cylinder. The piston seal interfaces with the cylinder sleeve to divide the pump cylinder into an upstream material chamber and a downstream material chamber and prevent material flow between the upstream material chamber and the downstream material chamber within the pump cylinder.

The pump body includes a throat cartridge mounted to an end of the outlet housing opposite the pump cylinder, wherein the piston extends through the throat cartridge.

The first seal is disposed in a throat seal groove formed in the throat cartridge.

The first seal includes a first throat dynamic seal having a first seal body and a first seal cup; and a second throat dynamic seal having a second seal body and a second seal cup. The first seal body abuts the second seal body and the first seal cup is oriented in a first axial direction along the axis and the second seal cup is oriented in a second axial direction along the axis opposite the first axial direction.

An inlet valve is disposed in the inlet housing and an outlet valve is disposed in the inlet housing.

The piston includes a piston rod extending through the outlet housing and into the pump body; and a piston head mounted to an end of the piston rod within the pump housing. The piston seal is mounted on the piston head.

The piston further includes a piston cap connected to the piston head. The piston seal is disposed in a piston seal groove extending axially between a first groove end formed by the piston head and a second groove end formed by the piston cap.

A brace ring is disposed in the seal groove adjacent to the piston seal.

The piston seal includes a first piston dynamic seal having a first seal body and a first seal cup; and a second piston dynamic seal having a second seal body and a second seal cup. The first seal body abuts the second seal body and the first seal cup is oriented in a first axial direction along the axis and the second seal cup is oriented in a second axial direction along the axis opposite the first axial direction.

An exterior surface of the first piston sleeve has a mean roughness depth (Rz) of up to 0.8 micrometers.

The exterior surface of the first piston sleeve has an Rz of up to 0.3 micrometers.

The exterior surface of the first piston sleeve has an Rz of up to 0.25 micrometers.

An inner radial surface of the cylinder sleeve has a mean roughness depth (Rz) of up to 0.8 micrometers.

The inner radial surface of the cylinder sleeve has an Rz of up to 0.3 micrometers.

The inner radial surface of the cylinder sleeve has an Rz of up to 0.25 micrometers.

An exterior surface of the first piston sleeve is formed from one of C3 tungsten carbide and ceramic and an interior surface of the cylinder sleeve is formed from one of C3 tungsten carbide and ceramic.

The first seal and the piston seal are formed from microsphere-filled ultra-high molecular weight polyethylene.

The first seal includes a first cup oriented towards the pump cylinder, wherein the first cup including a first arm engaging the pump body and a second arm engaging the first piston sleeve, and wherein multiple lips are formed on the first arm and engage the pump body and multiple lips are formed on the second arm and engage the first piston sleeve.

A second piston sleeve mounted on the piston and spaced axially from the first piston sleeve along the piston.

An intake valve disposed within the pump body, wherein the intake valve includes an intake seal assembly disposed on the piston, wherein the intake seal assembly interfaces with the second piston sleeve during reciprocation of the piston, and wherein the intake valve is actuatable between an open state with the intake seal assembly disengaged from an intake seat and a closed state with the intake seal assembly engaged with the intake seat.

The piston includes a proximal rod extending out of the pump body, an intermediate rod connected to the proximal rod, a distal rod connected to the intermediate rod at an opposite end of the intermediate rod from the proximal rod, the first piston sleeve is mounted on the proximal rod, and the second piston sleeve is mounted on the distal rod.

The intermediate rod interfaces with the first piston sleeve and does not interface with the second piston sleeve.

The first piston sleeve is mounted on the proximal rod in a cylindrical recess that extends axially between a first shoulder formed by the proximal rod and a second shoulder formed by the intermediate rod.

The second piston sleeve is mounted on the distal rod in a cylindrical recess that extends axially between a first shoulder formed by the distal rod and a second shoulder formed by a scoop assembly mounted to an end of the distal rod opposite the intermediate rod.

A pumping system for pumping abrasive material includes a transfer pump configured to draw material from a vessel and pump the material downstream through a first conduit and a metering pump connected to the first conduit to receive the material from the transfer pump, the metering pump configured to pump the material downstream through a downstream conduit to an applicator. The transfer pump includes a transfer pump body; a first transfer seal supported by the transfer pump body; a transfer piston at least partially disposed within the transfer pump body and configured to reciprocate along a transfer pump axis; a first transfer piston sleeve mounted on the transfer piston, wherein the first transfer piston sleeve interfaces with the first transfer seal during reciprocation of the transfer piston; a second transfer piston sleeve mounted on the transfer piston and spaced axially from the first transfer piston sleeve along the transfer piston; and an intake valve disposed within the pump body, wherein the intake valve includes an intake seal assembly disposed on the transfer piston, wherein the intake seal assembly interfaces with the second transfer piston sleeve during reciprocation of the transfer piston, and wherein the intake valve is actuatable between an open state with the intake seal assembly disengaged from an intake seat and a closed state with the intake seal assembly engaged with the intake seat. The metering pump includes a metering pump body; a first metering seal supported by the metering pump body; a metering cylinder sleeve supported by the metering pump body; a metering piston at least partially disposed within the metering pump body and configured to reciprocate along a metering pump axis; a metering piston sleeve mounted on the metering piston, wherein the metering piston sleeve interfaces with the first metering seal during reciprocation of the metering piston; and a metering piston seal mounted on the metering piston and interfacing with the metering cylinder sleeve, wherein the metering piston seal is an only portion of the metering piston interfacing with the metering cylinder sleeve during reciprocation of the metering piston.

An applicator for a dispensing system includes an applicator body having a first flowpath extending therethrough; a control valve disposed within the applicator body, the control valve including: a first seat disposed in the first flowpath; and a valve member configured to shift between a first position in which a first needle of the valve member is engaged with the first seat such that the control valve is in a closed state and a second position in which the first needle is disengaged from the first seat such that the control valve is in an open state. The first needle is elongate along a needle axis, and wherein an exterior surface of the first needle has a mean roughness depth (Rz) of up to 0.8 micrometers.

The applicator of the preceding paragraph can optionally include, additionally and/or alternatively, any one or more of the following features, configurations and/or additional components:

The first needle extends through a first seal into the first flowpath, and wherein the first seal is a cup seal oriented towards the first seat.

The first seal is formed from ultra-high molecular weight polyethylene.

The first seal is formed from microsphere-filled ultra-high molecular weight polyethylene.

The valve member is configured to shift axially between the open state and the closed state.

The first needle engages an upstream side of the seat with the control valve in the closed state.

The first needle engages a downstream side of the first seat with the control valve in the closed state.

The first needle extends through the first seat.

The first needle includes a head configured to engage the first seat, and wherein an interface between the head and the first seat is formed between a first sloped surface of the head and a sloped lip of the seat.

The first needle includes a needle body elongate along the needle axis; and a sleeve disposed on the needle body, wherein the exterior surface of the first needle is formed by the sleeve.

The needle body includes a barrel having a first diameter and a stem extending from the barrel and having a second diameter, wherein the first diameter is larger than the second diameter, and wherein the sleeve is disposed on the stem.

The first needle includes a needle body having a barrel and a stem extending from the barrel, the stem having a smaller diameter than the barrel; and a sleeve assembly disposed on the stem. The sleeve assembly includes a first sleeve mounted on the stem, wherein the first sleeve is configured to engage the first seat with the control valve in the closed state; and a second sleeve mounted on the stem between the first sleeve and the barrel. The exterior surface of the first needle is formed by the sleeve assembly.

The first sleeve includes a neck; and a head disposed at an opposite end of the neck from the second sleeve. The head has a larger diameter than the neck.

The neck extends through the first seat and the head engages a downstream side of the first seat with the control valve in the closed state.

The head includes a first axial side configured to interface with the first seat; a second axial side; and an outer edge extending between the first axial side and the second axial side. The first axial side is sloped at a first angle that is transverse to the needle axis and non-orthogonal to the needle axis.

The first axial side is an upstream face of the head.

The first needle includes a needle body having a barrel and a stem extending from the barrel, the stem having a smaller diameter than the barrel; and a first sleeve disposed on the stem and configured to engage the first seat with the control valve in the closed state. The first sleeve includes a neck extending through the first seat; and a head extending from the neck, the head having a sloped upstream face oriented towards the first seat, wherein the head has a first diameter. The first seat includes a sloped lip and the sloped lip engages the sloped upstream face with the control valve in the closed state.

The first needle further includes a retainer disposed on the stem and maintaining the first sleeve on the stem, wherein the retainer has a second diameter smaller than the first diameter.

A second seat is disposed in a second flowpath through the applicator body and the valve member further includes an actuator piston disposed in an actuation chamber forming the applicator body, the first needle connected to the actuator piston to be actuated by the actuator piston; and a second needle extending from the actuator piston, the second needle configured to engage the second seat with the control valve in the closed state. An exterior surface of the second needle has a mean roughness depth (Rz) of up to 0.8 micrometers.

The exterior surface of the first needle has an Rz of up to 0.3 micrometers.

The exterior surface of the first needle has an Rz of up to 0.25 micrometers.

The exterior surface of the first needle is formed from one of C3 tungsten carbide and ceramic.

A needle for use in an applicator includes a needle body elongate along an axis between a first end and a second end; and an exterior surface having a mean roughness depth (Rz) of up to 0.8 micrometers.

The needle of the preceding paragraph can optionally include, additionally and/or alternatively, any one or more of the following features, configurations and/or additional components:

The exterior surface of the first needle has an Rz of up to 0.3 micrometers.

The exterior surface of the first needle has an Rz of up to 0.25 micrometers.

The exterior surface of the first needle is formed from one of C3 tungsten carbide and ceramic.

The exterior surface is formed by a first sleeve mounted on a needle body of the needle.

The needle body includes a barrel having a first diameter and a stem extending from the barrel and having a second diameter smaller than the first diameter; and the first sleeve is mounted on the stem.

The first sleeve includes a head extending radially, the head formed at a distal end of the first sleeve, the head including a first sloped surface oriented towards the second end of the needle body and a second surface oriented towards the first end of the needle body.

A retainer is mounted to the first end of the needle body and interfaces with the second side of the head.

The first side of the head is frustoconical.

A second sleeve mounted to the needle body adjacent to the first sleeve, wherein the exterior surface is formed by both the first sleeve and the second sleeve.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump for pumping an abrasive material, the pump comprising:

a pump body;

a first seal supported by the pump body;

a piston at least partially disposed within the pump body and configured to reciprocate along a pump axis;

a first piston sleeve mounted on the piston, wherein the first piston sleeve interfaces with the first seal during reciprocation of the piston;

a second piston sleeve mounted on the piston and spaced axially from the first piston sleeve along the piston; and an intake valve disposed within the pump body, wherein the intake valve includes an intake seal assembly disposed on the piston, wherein the intake seal assembly interfaces with the second piston sleeve during reciprocation of the piston, and wherein the intake valve is actuatable between an open state with the intake seal assembly disengaged from an intake seat and a closed state with the intake seal assembly engaged with the intake seat;

wherein the piston includes a proximal rod, an intermediate rod connected to the proximal rod, a distal rod connected to the intermediate rod at an opposite end of the intermediate rod from the proximal rod, the first piston sleeve is mounted on the proximal rod, and the second piston sleeve is mounted on the distal rod; and wherein the intermediate rod interfaces with the first piston sleeve and does not interface with the second piston sleeve.

2. The pump of claim 1, wherein the intake seal assembly rides on the second piston sleeve.

3. The pump of claim 2, wherein the intake seal assembly comprises:

an intake seal housing; and an intake seal disposed within the intake seal housing, the intake seal engaging the second piston sleeve.

4. The pump of claim 3, wherein the intake seal comprises:

a first intake dynamic seal having a first seal body and a first seal cup; and a second intake dynamic seal having a second seal body and a second seal cup;

wherein both the first intake dynamic seal and the second intake dynamic seal engage the second piston sleeve;

wherein the first seal body abuts the second seal body; and wherein the first seal cup is oriented in a first axial direction along the axis and the second seal cup is oriented in a second axial direction along the axis opposite the first axial direction.

5. The pump of claim 1, wherein the intermediate rod comprises:

a rod body interfacing with the distal rod to connect the intermediate rod to the distal rod; and a guide body disposed on the rod body, wherein the guide body interfaces with the first piston sleeve.

6. The pump of claim 1, wherein an exterior surface of the first piston sleeve has a mean roughness depth (Rz) of up to 0.8 micrometers.

7. The pump of claim 6, wherein the exterior surface of the first piston sleeve has an Rz of up to 0.3 micrometers.

8. The pump of claim 7, wherein the exterior surface of the first piston sleeve has an Rz of up to 0.25 micrometers.

9. The pump of claim 1, wherein an exterior surface of the first piston sleeve is formed from one of C3 tungsten carbide and ceramic and an exterior surface of the second piston sleeve is formed from one of C3 tungsten carbide and ceramic.

10. The pump of claim 1, further comprising:

a cylinder sleeve mounted to the pump body; and a piston valve disposed within the pump body, wherein the piston valve includes a piston seal assembly disposed on the piston, wherein the piston seal assembly interfaces with the cylinder sleeve during reciprocation of the piston, and wherein the piston valve is actuatable between an open state with the piston seal assembly disengaged from a piston valve seat and a closed state with the piston seal assembly engaged with the piston valve seat.

11. The pump of claim 10, wherein the piston valve seat is formed on the piston.

12. The pump of claim 10, wherein a piston seal is supported by the piston seal assembly and engaging the cylinder sleeve.

13. The pump of claim 12, wherein the piston seal includes a seal face engaging the cylinder sleeve, and wherein the seal face is concave.

14. The pump of claim 10, wherein the pump body comprises:

an inlet housing;

a valve housing mounted to the inlet housing, wherein the intake seal assembly is disposed within the valve housing;

a pump cylinder mounted to an opposite end of the valve housing from the inlet housing, wherein the cylinder sleeve is mounted on an inner surface of the pump cylinder; and an outlet housing mounted to an opposite end of the pump cylinder from the valve housing.

15. The pump of claim 14, further comprising:

a throat cartridge mounted to an opposite end of the outlet housing from the pump cylinder;

wherein the first seal is disposed within the throat cartridge and engages with the first piston sleeve and the first seal comprises:

a first throat dynamic seal having a first seal body and a first seal cup; and a second throat dynamic seal having a second seal body and a second seal cup;

wherein the first seal body abuts the second seal body and the first seal cup is oriented in a first axial direction along the axis and the second seal cup is oriented in a second axial direction along the axis opposite the first axial direction.

16. A pumping system for pumping abrasive material, the pumping system comprising:

a transfer pump configured to draw material from a vessel and pump the material downstream through a first conduit, the transfer pump formed by the pump of claim 1; and a metering pump connected to the first conduit to receive the material from the transfer pump, the metering pump configured to pump the material downstream through a downstream conduit to an applicator, the metering pump comprising:

a metering pump body;

a first metering seal supported by the metering pump body;

a metering cylinder sleeve supported by the metering pump body;

a metering piston at least partially disposed within the metering pump body and configured to reciprocate along a metering pump axis;

a metering piston sleeve mounted on the metering piston, wherein the metering piston sleeve interfaces with the first metering seal during reciprocation of the metering piston; and a metering piston seal mounted on the metering piston and interfacing with the metering cylinder sleeve, wherein the metering piston seal is an only portion of the metering piston interfacing with the metering cylinder sleeve during reciprocation of the metering piston.

17. A pump for pumping an abrasive material, the pump comprising:

a pump body;

a first seal supported by the pump body;

a piston at least partially disposed within the pump body and configured to reciprocate along a pump axis;

a first piston sleeve mounted on the piston, wherein the first piston sleeve interfaces with the first seal during reciprocation of the piston;

a second piston sleeve mounted on the piston and spaced axially from the first piston sleeve along the piston; and an intake valve disposed within the pump body, wherein the intake valve includes an intake seal assembly disposed on the piston, wherein the intake seal assembly interfaces with the second piston sleeve during reciprocation of the piston, and wherein the intake valve is actuatable between an open state with the intake seal assembly disengaged from an intake seat and a closed state with the intake seal assembly engaged with the intake seat;

wherein the piston includes a proximal rod, an intermediate rod connected to the proximal rod, a distal rod connected to the intermediate rod at an opposite end of the intermediate rod from the proximal rod, the first piston sleeve is mounted on the proximal rod, and the second piston sleeve is mounted on the distal rod;

wherein the first piston sleeve is mounted on the proximal rod in a first cylindrical recess that extends axially between a first shoulder formed by the proximal rod and a second shoulder formed by the intermediate rod; and wherein the second piston sleeve is mounted on the distal rod in a second cylindrical recess that extends axially between a third shoulder formed by the distal rod and a fourth shoulder formed by a scoop assembly mounted to an end of the distal rod opposite the intermediate rod.

18. The pump of claim 7, wherein the intermediate rod comprises:

a rod body interfacing with the distal rod to connect the intermediate rod to the distal rod; and a guide body disposed on the rod body, wherein the second shoulder is formed by the guide body.

19. A pump for pumping an abrasive material, the pump comprising:

a pump body comprising:

an intake housing;

a valve housing mounted to the intake housing;

a pump cylinder mounted to an end of the valve housing opposite the intake housing;

an outlet housing mounted to an end of the pump cylinder opposite the valve housing; and a throat cartridge mounted to an end of the outlet housing opposite the pump cylinder;

a first seal supported by the throat cartridge;

a piston at least partially disposed within the pump body and configured to reciprocate along a pump axis, the piston comprising:

a proximal rod;

an intermediate rod connected to the proximal rod; and a distal rod connected to the intermediate rod at an opposite end of the intermediate rod from the proximal rod;

a first piston sleeve mounted on the proximal rod, wherein the first piston sleeve interfaces with the first seal during reciprocation of the piston, the first piston sleeve mounted in a first recess that extends axially between a first shoulder formed by the proximal rod and a second shoulder formed by the intermediate rod;

a second piston sleeve mounted on the distal rod and spaced axially from the first piston sleeve along the piston, the second piston sleeve mounted in a second recess that extends axially between a third shoulder formed by the distal rod and a fourth shoulder formed by a scoop assembly mounted to an end of the distal rod opposite the intermediate rod;

a cylinder sleeve mounted to the pump cylinder such that an interior radial surface is exposed within a material flowpath through the pump body;

an intake valve disposed within the pump body, wherein the intake valve includes an intake seal assembly disposed on the piston, wherein the intake seal assembly interfaces with the second piston sleeve during reciprocation of the piston, and wherein the intake valve is actuatable between a first open state with the intake seal assembly disengaged from an intake seat and a first closed state with the intake seal assembly engaged with the intake seat; and a piston valve disposed within the pump body, wherein the piston valve includes a piston seal assembly disposed on the piston, wherein the piston seal assembly interfaces with the cylinder sleeve during reciprocation of the piston, and wherein the piston valve is actuatable between a second open state with the piston seal assembly disengaged from a piston valve seat and a second closed state with the piston seal assembly engaged with the piston valve seat.

* * * * *